US008696405B2

(12) United States Patent
Duescher

(10) Patent No.: US 8,696,405 B2
(45) Date of Patent: Apr. 15, 2014

(54) PIVOT-BALANCED FLOATING PLATEN LAPPING MACHINE

(76) Inventor: Wayne O. Duescher, Roseville, MN (US)

( * ) Notice: Subject to any disclaimer, the term of this patent is extended or adjusted under 35 U.S.C. 154(b) by 393 days.

(21) Appl. No.: 13/267,305

(22) Filed: Oct. 6, 2011

(65) Prior Publication Data

US 2012/0028545 A1 Feb. 2, 2012

Related U.S. Application Data

(63) Continuation-in-part of application No. 13/207,871, filed on Aug. 11, 2011, now Pat. No. 8,328,600, which is a continuation-in-part of application No. 12/807,802, filed on Sep. 14, 2010, now Pat. No. 8,500,515, which is a continuation-in-part of application No. 12/799,841, filed on May 3, 2010, now Pat. No. 8,602,842, which is a continuation-in-part of application No. 12/661,212, filed on Mar. 12, 2010.

(51) Int. Cl.
*B24B 7/22* (2006.01)

(52) U.S. Cl.
CPC .. *B24B 7/22* (2013.01); *B24B 7/228* (2013.01)
USPC ..... 451/11; 451/5; 451/288

(58) Field of Classification Search
CPC ..... B24B 7/22; B24B 37/10; B24B 37/107
USPC ..... 451/5, 11, 28, 36, 37, 41, 59, 64, 259, 451/260, 270, 271, 280, 283, 285, 288, 287
See application file for complete search history.

(56) References Cited

U.S. PATENT DOCUMENTS

| | | | |
|---|---|---|---|
| 4,593,495 | A | 6/1986 | Kawakami et al. |
| 4,918,870 | A | 4/1990 | Torbert et al. |
| 5,014,468 | A | 5/1991 | Ravipati et al. |
| 5,205,082 | A | 4/1993 | Shendon et al. |
| 5,314,513 | A | 5/1994 | Miller et al. |
| 5,364,655 | A | 11/1994 | Nakamura et al. |
| 5,569,062 | A | 10/1996 | Karlsrud |
| 5,643,067 | A | 7/1997 | Katsuoka et al. |
| 5,769,697 | A | 6/1998 | Nishio |
| 5,800,254 | A | 9/1998 | Motley et al. |
| 5,863,306 | A | 1/1999 | Wei et al. |
| 5,910,041 | A | 6/1999 | Duescher |
| 5,916,009 | A | 6/1999 | Izumi et al. |
| 5,964,651 | A | 10/1999 | Hose |

(Continued)

*Primary Examiner* — Robert Rose
(74) *Attorney, Agent, or Firm* — Mark A. Litman & Associates, PA

(57) ABSTRACT

A low friction flat-lapping abrading apparatus and method for releasably attaching flexible abrasive disks to a flat-surfaced platen that floats in three-point abrading contact with flat-surfaced workpieces that are attached to three rotary spindles. The rigid equal-height flat-surfaced rotatable fixed-position workpiece spindles are mounted on a flat abrading machine base. They are positioned to form a triangle to provide stable support of the floating platen. All three spindle-tops are co-planar aligned to provide a precision-flat reference plane for mounting of the workpieces. The lapping operation has very high abrading speeds and very low abrading forces. The light-weight but strong lapping machine employs a pivot-balance structure where the weight of the drive motor is used to balance the weight of the abrading platen. Use of low-friction air bearings provides the capability for precision control of the abrading forces. The lapping machine is robust and well suited for a harsh abrading environment.

20 Claims, 25 Drawing Sheets

(56) References Cited

U.S. PATENT DOCUMENTS

| | | | | |
|---|---|---|---|---|
| 5,967,882 | A | 10/1999 | Duescher | |
| 5,975,997 | A | 11/1999 | Minami | |
| 5,989,104 | A | 11/1999 | Kim et al. | |
| 5,993,298 | A | 11/1999 | Duescher | |
| 6,001,008 | A | 12/1999 | Fujimori et al. | |
| 6,048,254 | A | 4/2000 | Duescher | |
| 6,077,153 | A * | 6/2000 | Fujita et al. | 451/259 |
| 6,089,959 | A | 7/2000 | Nagahashi | |
| 6,102,777 | A | 8/2000 | Duescher et al. | |
| 6,120,352 | A | 9/2000 | Duescher | |
| 6,149,506 | A | 11/2000 | Duescher | |
| 6,165,056 | A | 12/2000 | Hayashi et al. | |
| 6,168,506 | B1 | 1/2001 | McJunken | |
| 6,217,433 | B1 | 4/2001 | Herrman et al. | |
| 6,371,838 | B1 | 4/2002 | Holzapfel | |
| 6,398,906 | B1 | 6/2002 | Kobayashi et al. | |
| 6,425,809 | B1 * | 7/2002 | Ichimura | 451/287 |
| 6,439,965 | B1 | 8/2002 | Ichino et al. | |
| 6,506,105 | B1 | 1/2003 | Kajiwara et al. | |
| 6,607,157 | B1 | 8/2003 | Duescher | |
| 6,752,700 | B2 | 6/2004 | Duescher | |
| 6,769,969 | B1 * | 8/2004 | Duescher | 451/59 |
| 6,786,810 | B2 | 9/2004 | Muilenberg et al. | |
| 6,893,332 | B2 | 5/2005 | Castor | |
| 6,896,584 | B2 | 5/2005 | Perlov et al. | |
| 6,899,603 | B2 | 5/2005 | Homma et al. | |
| 6,935,013 | B1 | 8/2005 | Markevitch et al. | |
| 7,001,251 | B2 | 2/2006 | Doan et al. | |
| 7,008,303 | B2 | 3/2006 | White et al. | |
| 7,014,535 | B2 | 3/2006 | Custer et al. | |
| 7,029,380 | B2 | 4/2006 | Horiguchi et al. | |
| 7,033,251 | B2 | 4/2006 | Elledge | |
| 7,044,838 | B2 | 5/2006 | Maloney et al. | |
| 7,125,313 | B2 | 10/2006 | Zelenski et al. | |
| 7,144,304 | B2 | 12/2006 | Moore | |
| 7,147,541 | B2 | 12/2006 | Nagayama et al. | |
| 7,166,016 | B1 | 1/2007 | Chen | |
| 7,250,368 | B2 | 7/2007 | Kida et al. | |
| 7,276,446 | B2 | 10/2007 | Robinson et al. | |
| 7,357,699 | B2 | 4/2008 | Togawa et al. | |
| 7,367,867 | B2 | 5/2008 | Boller | |
| 7,393,790 | B2 | 7/2008 | Britt et al. | |
| 7,422,634 | B2 | 9/2008 | Powell et al. | |
| 7,446,018 | B2 | 11/2008 | Brogan et al. | |
| 7,456,106 | B2 | 11/2008 | Koyata et al. | |
| 7,470,169 | B2 | 12/2008 | Taniguchi et al. | |
| 7,491,342 | B2 | 2/2009 | Kamiyama et al. | |
| 7,507,148 | B2 | 3/2009 | Kitahashi et al. | |
| 7,520,800 | B2 | 4/2009 | Duescher | |
| 7,527,722 | B2 | 5/2009 | Sharan | |
| 7,582,221 | B2 | 9/2009 | Netsu et al. | |
| 7,614,939 | B2 | 11/2009 | Tolles et al. | |
| 7,632,434 | B2 | 12/2009 | Duescher | |
| 8,062,098 | B2 | 11/2011 | Duescher | |
| 2005/0118939 | A1 | 6/2005 | Duescher | |
| 2008/0299875 | A1 | 12/2008 | Duescher | |
| 2010/0003904 | A1 | 1/2010 | Duescher | |
| 2011/0223835 | A1 | 9/2011 | Duescher | |
| 2011/0223836 | A1 | 9/2011 | Duescher | |
| 2011/0223838 | A1 | 9/2011 | Duescher | |

* cited by examiner

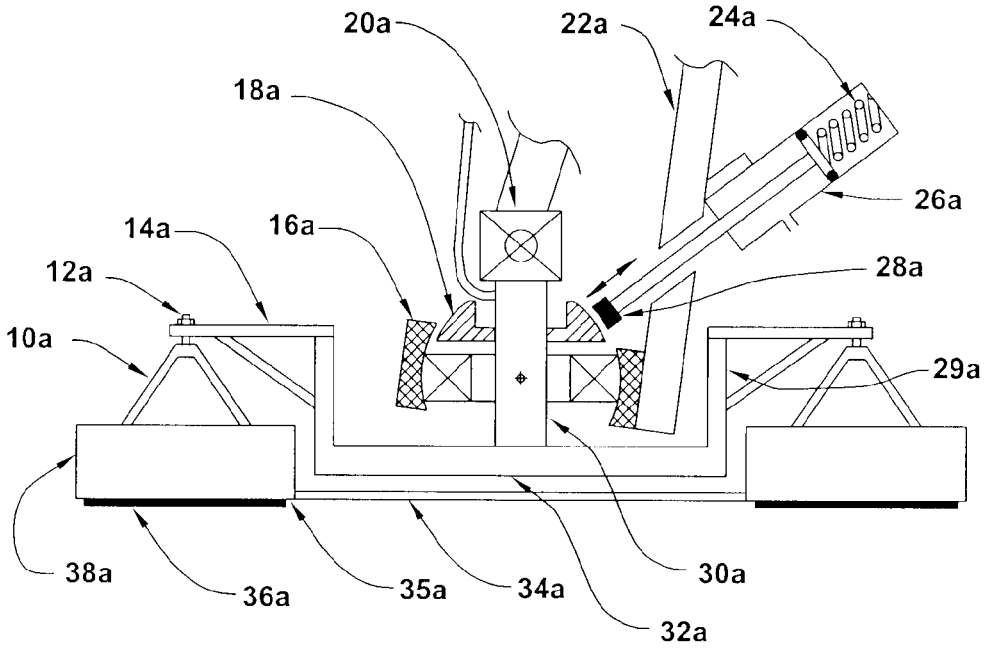
*Fig. 14.1*
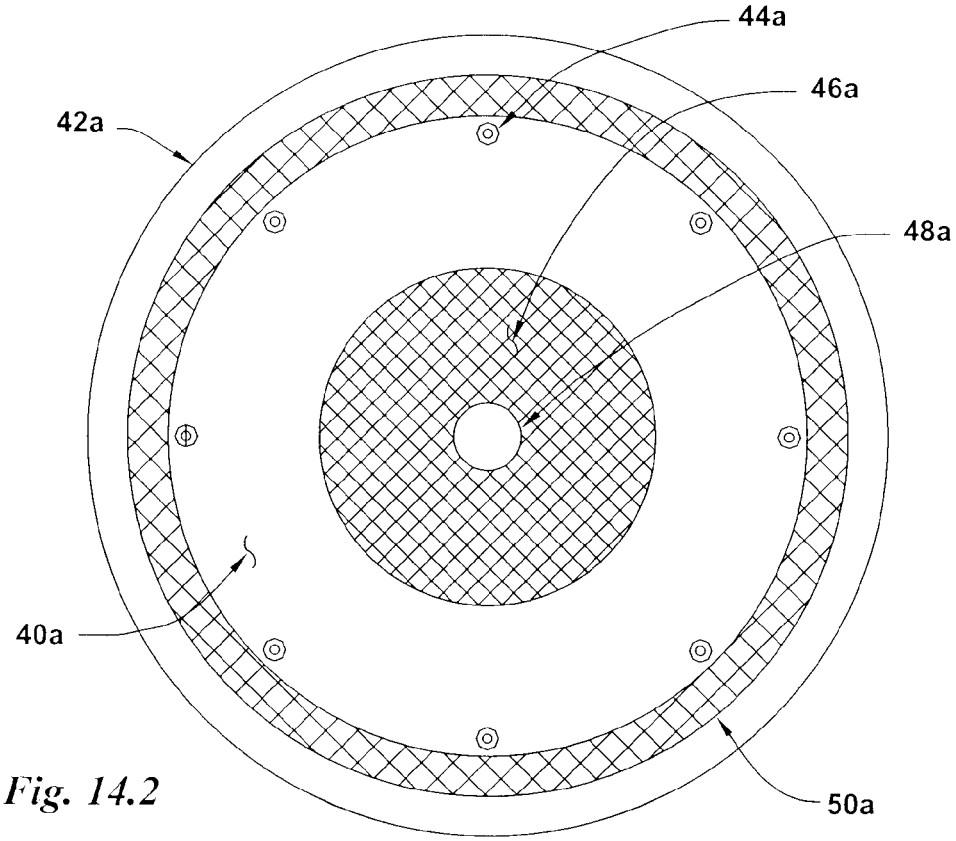
*Fig. 14.2*

PIVOT-BALANCED FLOATING PLATEN LAPPING MACHINE

CROSS REFERENCE TO RELATED APPLICATION

This invention and application claims priority as a continuation-in-part application from U.S. patent application Ser. No. 13/207,871 filed Aug. 11, 2011, now U.S. Pat. No. 8,328,600 which in turn is a continuation-in-part of U.S. patent application Ser. No. 12/807,802 filed Sep. 14, 2010, now U.S. Pat. No. 8,500,515 which in turn is a continuation-in-part of U.S. patent application Ser. No. 12/799,841 filed May 3, 2010, now U.S. Pat. No. 8,602,842, which is in turn a continuation-in-part of the U.S. patent application Ser. No. 12/661,212 filed Mar. 12, 2010. These are each incorporated herein by reference in their entirety.

BACKGROUND OF THE INVENTION

Field of the Invention

The present invention relates to the field of abrasive treatment of surfaces such as grinding, polishing and lapping. In particular, the present invention relates to a high speed lapping system that provides simplicity, quality and efficiency to existing lapping technology using multiple floating platens.

Flat lapping of workpiece surfaces used to produce precision-flat and mirror smooth polished surfaces is required for many high-value parts such as semiconductor wafer and rotary seals. The accuracy of the lapping or abrading process is constantly increased as the workpiece performance, or process requirements, become more demanding. Workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance. Also, it is highly desirable to eliminate the use of messy liquid abrasive slurries. Changing the abrading process set-up of most of the present abrading systems to accommodate different sized abrasive particles, different abrasive materials or to match abrasive disk features or the size of the abrasive disks to the workpiece sizes is typically tedious and difficult.

Fixed-Spindle-Floating-Platen System

The present invention relates to methods and devices for a single-sided lapping machine that is capable of producing ultra-thin semiconductor wafer workpieces at high abrading speeds. This is done by providing a flat surfaced granite machine base that is used for mounting three individual rigid flat-surfaced rotatable workpiece spindles. Flexible abrasive disks having annular bands of fixed-abrasive coated raised islands are attached to a rigid flat-surfaced rotary platen. The platen annular abrading surface floats in three-point abrading contact with flat surfaced workpieces that are mounted on the three equal-spaced flat-surfaced rotatable workpiece spindles. Water coolant is used with these raised island abrasive disks.

Presently, floating abrasive platens are used in double-sided lapping and double-sided micro-grinding (flat-honing) but the abrading speeds of both of these systems are very low. The upper floating platen used with these systems are positioned in conformal contact with multiple equal-thickness workpieces that are in flat contact with the flat abrading surface of a lower rotary platen. Both the upper and lower abrasive coated platens are typically concentric with each other and they are rotated independent of each other. Often the platens are rotated in opposite directions to minimize the net abrading forces that are applied to the workpieces that are sandwiched between the flat annular abrading surfaces of the two platens.

In order to compensate for the different abrading speeds that exist at the inner and outer radii of the annular band of abrasive that is present on the rotating platens, the workpieces are rotated. The speed of the rotated workpiece reduces the too-fast platen speed at the outer periphery of the platen and increases the too-slow speed at the inner periphery when the platen and the workpiece are both rotated in the same direction. However, if the upper abrasive platen and the lower abrasive platen are rotated in opposite directions, then rotation of the workpieces is favorable to the platen that is rotated in the same direction as the workpiece rotation and is unfavorable for the other platen that rotates in a direction that opposes the workpiece rotation direction. Here, the speed differential provided by the rotated workpiece acts against the abrading speed of the opposed rotation direction platen. Because the localized abrading speed represents the net speed difference between the workpieces and the platen, rotating them in opposite directions increases the localized abrading speeds to where it is too fast. Providing double-sided abrading where the upper and lower platens are rotated in opposed directions results over-speeding of the abrasive on one surface of a workpiece compared to an optimum abrading speed on the opposed workpiece surface.

In double-sided abrading, rotation of the workpieces is typically done with thin gear-driven planetary workholder disks that carry the individual workpieces while they are sandwiched between the two platens. Workpieces comprising semiconductor wafers are very thin so the planetary workholders must be even thinner to allow unimpeded abrading contact with both surfaces of the workpieces. The gear teeth on these thin workholder disks that are used to rotate the disks are very fragile, which prevents fast rotation of the workpieces. The resultant slow-rotation workpieces prevent fast abrading speeds of the abrasive platens. Also, because the workholder disks are fragile, the upper and lower platens are often rotated in opposite directions to minimize the net abrading forces on individual workpieces because a portion of this net workpiece abrading force is applied to the fragile disk-type workholders. It is not practical to abrade very thin workpieces with double-sided platen abrasive systems because the required very thin planetary workholder disks are so fragile.

Multiple workpieces are often abrasive slurry lapped using flat-surfaced single-sided platens that are coated with a layer of loose abrasive particles that are in a liquid mixture. Slurry lapping is very slow, and also, very messy.

The platen slurry abrasive surfaces also wear continually during the workpiece abrading action with the result that the platen abrasive surfaces become non-flat. Non-flat platen abrasive surfaces result in non-flat workpiece surfaces. These platen abrasive surfaces must be periodically reconditioned to provide flat workpieces. Conditioning rings are typically placed in abrading contact with the moving annular abrasive surface to re-establish the planar flatness of the platen annular band of abrasive.

In single-sided slurry lapping, a rigid rotating platen has a coating of abrasive in an annular band on its planar surface. Floating-type spherical-action workholder spindles hold individual workpieces in flat-surfaced abrading contact with the moving platen slurry abrasive with controlled abrading pressure.

The fixed-spindle-floating-platen abrading system has many unique features that allow it to provide flat-lapped precision-flat and smoothly-polished thin workpieces at very high abrading speeds. Here, the top flat surfaces of the individual spindles are aligned in a common plane where the flat surface of each spindle top is co-planar with each other. Each of the three rigid spindles is positioned with approximately equal spacing between them to form a triangle of spindles that provide three-point support of the rotary abrading platen. The rotational-centers of each of the spindles are positioned on the granite so that they are located at the radial center of the annular width of the precision-flat abrading platen surface. Equal-thickness flat-surfaced workpieces are attached to the flat-surfaced tops of each of the spindles. The rigid rotating floating-platen abrasive surface contacts all three rotating workpieces to perform single-sided abrading on the exposed surfaces of the workpieces. The fixed-spindle-floating platen system can be used at high abrading speeds with water cooling to produce precision-flat and mirror-smooth workpieces at very high production rates. There is no abrasive wear of the platen surface because it is protected by the attached flexible abrasive disks. Use of abrasive disks that have annular bands of abrasive coated raised islands prevents the common problem of hydroplaning of workpieces when contacting coolant water-wetted continuous-abrasive coatings. Hydroplaning of workpieces causes non-flat workpiece surfaces.

This abrading system can also be used to recondition the flat surface of the abrasive that is on the abrasive disk that is attached to the platen. A platen annular abrasive surface tends to experience uneven wear across the radial surface of the annular abrasive band after continued abrading contact with the flat surfaced workpieces. When the non-even wear of the abrasive surface becomes excessive and the abrasive can no longer provide precision-flat workpiece surfaces it must be reconditioned to re-establish its precision planar flatness. Reconditioning the platen abrasive surface can be easily accomplished with this fixed-spindle floating-platen system by attaching equal-thickness abrasive disks, or other abrasive devices such as abrasive coated conditioning rings, to the flat surfaces of the rotary spindle tops in place of the workpieces. Here, the platen annular abrasive surface reconditioning takes place by rotating the spindle abrasive disks, or conditioning rings, while they are in flat-surfaced abrading contact with the rotating platen abrasive annular band.

Also, the bare platen (no abrasive coating) annular abrading surface can be reconditioned with this fixed-spindle floating-platen system by attaching equal-thickness abrasive disks, or other abrasive devices such as abrasive coated conditioning rings, to the flat surfaces of the rotary spindle tops in place of the workpieces. Here, the platen annular abrading surface reconditioning takes place by rotating the spindle abrasive disks, or conditioning rings, while they are in flat-surfaced abrading contact with the rotating platen annular abrading surface. Most conventional platen abrading surfaces have original-condition flatness tolerances of 0.0001 inches (3 microns) that typically wear down into a non-flat condition during abrading operations to approximately 0.0006 inches (15 microns) before they are reconditioned to re-establish the original flatness variation of 0.0001 inches (3 microns).

Furthermore, the system can be used to recondition the flat surfaces of the spindles or the surfaces of workpiece carrier devices that are attached to the spindle tops by bringing an abrasive coated floating platen into abrading contact with the bare spindle tops, or into contact with the workpiece carrier devices that are attached to the spindle tops, while both the spindles and the platen are rotated.

This fixed-spindle-floating-platen system is particularly suited for flat-lapping large diameter semiconductor wafers. High-value large-sized workpieces such as 12 inch diameter (300 mm) semiconductor wafers can be attached with vacuum or by other means to ultra-precise flat-surfaced air bearing spindles for precision lapping of the wafers. Commercially available abrading machine components can be easily assembled to construct these lapper machines. Ultra-precise 12 inch diameter air bearing spindles can provide flat rotary mounting surfaces for flat wafer workpieces. These spindles typically provide spindle top flatness accuracy of 5 millionths of an inch (0.13 micron) (or less, if desired) during rotation. They are also very stiff for resisting abrading load deflections and can support loads of 900 lbs. A typical air bearing spindle having a stiffness of 4,000,000 lbs/inch is more resistant to deflections from abrading forces than a mechanical spindle having steel roller bearings.

The thicknesses of the workpieces can be measured during the abrading or lapping procedure by the use of laser, or other, measurement devices that can measure the workpiece thicknesses. These workpiece thickness measurements can be made by direct workpiece exposed-edge side measurements. They also can be made indirectly by measuring the location of the bottom position of the moving abrasive surface that makes contact with the workpiece surfaces as the abrasive surface location measurement is related to an established reference position.

Air bearing workpiece spindles can be replaced or extra units added as needed. These air bearing spindles are preferred because of their precision flatness of the spindle surfaces at all abrading speeds and their friction-free rotation. Commercial 12 inch (300 mm) diameter air bearing spindles that are suitable for high speed flat lapping are available from Nelson Air Corp, Milford, N.H. Air bearing spindles are preferred for high speed flat lapping but suitable rotary flat-surfaced spindles having conventional roller bearings can also be used.

Thick-section granite bases that have the required surface flatness accuracy, structural stiffness and dimensional stability to support these heavy air bearing spindles without distortion are also commercially available from numerous sources. Fluid passageways can be provided within the granite bases to allow the circulation of heat transfer fluids that thermally stabilize the bases. This machine base temperature control system provides long-term dimensional stability of the precision-flat granite bases and isolates them from changes in the ambient temperature changes in a production facility. Floating platens having precision-flat planar annular abrading surfaces can also be fabricated or readily purchased.

The flexible abrasive disks that are attached to the platen annular abrading surfaces typically have annular bands of fixed-abrasive coated rigid raised-island structures. There is insignificant elastic distortion of the individual raised islands through the thickness of the raised island structures or elastic distortion of the complete thickness of the raised island abrasive disks when they are subjected to typical abrading pressures. These abrasive disks must also be precisely uniform in thickness across the full annular abrading surface of the disk. This is necessary to assure that uniform abrading takes place over the full flat surface of the workpieces that are attached onto the top surfaces of each of the three spindles. The term "precisely" as used herein refers to within ±5 wavelengths planarity and within ±0.01 degrees of perpendicular or parallel, and precisely coplanar means within ±0.01 degrees of parallel, thickness or flatness variations of less than 0.0001 inches (3 microns) and with a standard deviation between planes that does not exceed ±20 microns.

During an abrading or lapping procedure, both the workpieces and the abrasive platens are rotated simultaneously. Once a floating platen "assumes" a position as it rests conformably upon workpieces attached to the spindle tops and the platen is supported by the three spindles, the planar abrasive surface of the platen retains this nominal platen alignment even as the floating platen is rotated. The three-point spindles are located with approximately equal spacing between them circumferentially around the platen and their rotational centers are in alignment with the radial centerline of the platen annular abrading surface. A controlled abrading pressure is applied by the abrasive platen to the equal-thickness workpieces that are attached to the three rotary workpiece spindles. Due to the evenly-spaced three-point support of the floating platen, the equal-sized workpieces attached to the spindle tops experience the same shared platen-imposed abrading forces and abrading pressures. Here, precision-flat and smoothly polished semiconductor wafer surfaces can be simultaneously produced at all three spindle stations by the fixed-spindle-floating platen abrading system.

Because the floating-platen and fixed-spindle abrading system is a single-sided process, very thin workpieces such as semiconductor wafers or flat-surfaced solar panels can be attached to the rotatable spindle tops by vacuum or other attachment means. To provide abrading of the opposite side of a workpiece, it is removed from the spindle, flipped over and abraded with the floating platen. This is a simple two-step procedure. Here, the rotating spindles provide a workpiece surface that is precisely co-planar with the opposed workpiece surface.

The spindles and the platens can be rotated at very high speeds, particularly with the use of precision-thickness raised-island abrasive disks. These abrading speeds can exceed 10,000 surface feet per minute (SFPM) or 3,048 surface meters per minute. The abrading pressures used here for flat lapping are very low because of the extraordinary high material removal rates of superabrasives (including diamond or cubic boron nitride (CBN)) when operated at very high abrading speeds. The abrading pressures are often less than 1 pound per square inch (0.07 kilogram per square cm) which is a small fraction of the abrading pressures commonly used in abrading. Flat honing (micro-grinding) uses extremely high abrading pressures which can result in substantial sub-surface damage of high value workpieces. The low abrading pressures used here result in highly desired low subsurface damage. In addition, low abrading pressures result in lapper machines that have considerably less weight and bulk than conventional abrading machines.

Use of a platen vacuum disk attachment system allows quick set-up changes where abrasive disks having different sizes of abrasive particles and different types of abrasive material can be quickly attached to the flat platen annular abrading surfaces. Changing the sized of the abrasive particles on all of the other abrading systems is slow and tedious. Also, the use of messy loose-abrasive slurries is avoided by using the fixed-abrasive disks.

A minimum of three evenly-spaced spindles are used to obtain the three-point support of the upper floating platen by contacting the spaced workpieces. However, additional spindles can be mounted between any two of the three spindles that form three-point support of the floating platen. Here all of the workpieces attached to the spindle-tops are in mutual flat abrading contact with the rotating platen abrasive.

Semiconductor wafers or other workpieces can be processed with a fully automated easy-to-operate process that is especially easy to incorporate into the fixed-spindle floating-platen lapping or abrading system. Here, individual semiconductor wafers, workpieces or workpiece carriers can be changed on all three spindles with a robotic arm extending through a convenient gap-opening between two adjacent stand-alone workpiece rotary spindles. Flexible abrasive disks can be changed on the platen by using a robotic arm extending through a convenient gap-opening between two adjacent stand-alone workpiece rotary spindles.

This three-point fixed-spindle-floating-platen abrading system can also be used for chemical mechanical planarization (CMP) abrading of semiconductor wafers that are attached to the spindle-tops by using liquid abrasive slurry and chemical mixtures with resilient backed pads that are attached to the floating platen. The system can also be used with CMP-type fixed-abrasive shallow-island abrasive disks that are backed with resilient support pads. These abrasive shallow-islands can either be mold-formed on the surface of flexible backings or the abrasive shallow-islands can be coated on the backings using gravure-type coating techniques.

This three-point fixed-spindle-floating-platen abrading system can also be used for slurry lapping of the workpieces that are attached to the rotary spindle-tops by applying a coating of liquid abrasive slurry to the abrading surface of the platen. Also, a flat-surfaced annular metal or other material disk can be attached to the platen abrading surface and a coating of liquid abrasive slurry can be applied to the flat abrading surface of the attached annular disk.

The system has the capability to resist large mechanical abrading forces that can be present with abrading processes while maintaining unprecedented rotatable workpiece spindle tops flatness accuracies and minimum mechanical flatness out-of-planar variations, even at very high abrading speeds. There is no abrasive wear of the flat surfaces of the spindle tops because the workpieces are firmly attached to the spindle tops and there is no motion of the workpieces relative to the spindle tops. Rotary abrading platens are inherently robust, structurally stiff and resistant to deflections and surface flatness distortions when they are subjected to substantial abrading forces. Because the system is comprised of robust components, it has a long production usage lifetime with little maintenance even in the harsh abrading environment present with most abrading processes. Air bearing spindles are not prone to failure or degradation and provide a flexible system that is quickly adapted to different polishing processes. Drip shields can be attached to the air bearing spindles to prevent abrasive debris from contaminating the spindle. All of the precision-flat abrading processes presently in commercial lapping use typically have very slow abrading speeds of about 5 mph (8 kph). By comparison, the high speed flat lapping system operates at or above 100 mph (160 kph). This is a speed difference ratio of 20 to 1. Increasing abrading speeds increase the material removal rates. High abrading speeds result in high workpiece production rates and large cost savings.

To provide precision-flat workpiece surfaces, it is important to maintain the required flatness of annular band of fixed-abrasive coated raised islands during the full abrading life of an abrasive disk. This is done by selecting abrasive disks where the full surface of the abrasive is contacted by the workpiece surface. This results in uniform wear-down of the abrasive.

The many techniques already developed to maintain the abrasive surface flatness are also very effective for the fixed-spindle floating-platen lapping system. The primary technique is to use the abraded workpieces themselves to keep the abrasive flat during the lapping process. Here large workpieces (or small workpieces grouped together) are also rotated as they span the radial width of the rotating annular abrasive band. Another technique uses driven planetary workholders that move workpieces in constant orbital spiral path motions across the abrasive band width. Other techniques include the periodic use of annular abrasive coated conditioning rings to abrade the non-flat surfaces of the platen abrasive or the platen body abrading surface. These conditioning rings can be rotated while remaining at stationary positions. They also can be moved around the circumference of the platen while they are rotated by planetary circulation mechanism devices. Conditioning rings have been used for years to maintain the flatness of slurry platens that utilize loose abrasive particles. These same types of conditioning rings are also used to periodically re-flatten the fixed-abrasive continuous coated platens used in micro-grinding (flat-honing).

Workpieces are often rotated at rotational speeds that are approximately equal to the rotational speeds of the platens to provide approximately equal localized abrading speeds across the full radial width of the platen abrasive when the workpiece spindles are rotated in the same rotation direction as the platens.

Unlike slurry lapping, there is no abrasive wear of raised island abrasive disk platens because only the non-abrasive flexible disk backing surface contacts the platen surface. Here, the abrasive disk is firmly attached to the platen flat annular abrading surface. Also, the precision flatness of the high speed flat lapper abrasive surfaces can be completely re-established by simply and quickly replacing an abrasive disk having a non-flat abrasive surface with another abrasive disk that has a precision-flat abrasive surface.

Vacuum is used to quickly attach flexible abrasive disks, having different sized particles, different abrasive materials and different array patterns and styles of raised islands. Each flexible disk conforms to the precision-flat platen surface provide precision-flat planar abrading surfaces. Quick lapping process set-up changes can be made to process a wide variety of workpieces having different materials and shapes with application-selected raised island abrasive disks that are optimized for them individually. Small and medium diameter disks are very light in weight and have very little bulk thickness. They can be stored or shipped flat where individual disks lay in layers in flat contact with other companion disks. Large and very large raised island fixed-abrasive disks can be rolled and stored or shipped in polymer protective tubes. Abrasive disk and floating platens can have a wide range of abrading surface diameters that range from 2 inches (5 cm) to 72 inches (183 cm) or even much greater diameters. Abrasive disks that have non-island continuous coatings of abrasive material can also be used on the fixed-spindle floating-platen abrading system The abrasive disk quick change capability is especially desirable for laboratory lapping machines but it is also very useful for prototype lapping and for full-scale production lapping machines. This abrasive disk quick-change capability also provides a large advantage over micro-grinding (flat-honing) where it is necessary to change-out a worn heavy rigid platen or to replace it with one having different sized particles. Changing the non-flat fixed abrasive surface of a micro-grinding (flat-honing) thick abrasive wheel can not be done quickly because it is a bolted-on integral part of the rotating platen that supports it. Often, the abrasive particle sizes are sequentially changed from coarse to medium to fine during a flat lapping or abrading operation.

Hydroplaning of workpieces occurs when smooth abrasive surfaces, having a continuous thin-coated abrasive, are in fast-moving contact with a flat workpiece surface in the presence of surface water. However, hydroplaning does not occur when interrupted-surfaces, such as abrasive coated raised islands, contact a flat water-wetted workpiece surface. An analogy to the use of raised islands in the presence of coolant water films is the use of tread lugs on auto tires which are used on rain slicked roads. Tires with lugs grip the road at high speeds while bald smooth-surfaced tires hydroplane. In the same way, the abrasive coatings of the flat-surface tops of the raised islands remain in abrading contact with water-wetted flat-surfaced workpieces, even at very high abrading speeds.

A uniform thermal expansion and contraction of air bearing spindles occurs on all of the air bearing spindles mounted on the granite or other material machine bases when each of individual spindles are mounted with the same methods on the bases. The spindles can be mounted on spindle legs attached to the bottom of the spindles or the spindles can be mounted to legs that are attached to the upper portion of the spindle bodies and the length expansion or shrinkage of all of the spindles will be the same. This insures that precision abrading can be achieved with these fixed-spindle floating-platen abrading systems. This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800, commonly assigned U.S. patent application published numbers 20100003904; 20080299875 and 20050118939 and U.S. patent application Ser. Nos. 12/661,212, 12/799,841 and 12/807,802 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,786,810 (Muilenberg et al) describes a web-type fixed-abrasive CMP article. U.S. Pat. No. 5,014,486 (Ravipati et al) and U.S. Pat. No. 5,863,306 (Wei et al) describe a web-type fixed-abrasive article having shallow-islands of abrasive coated on a web backing using a rotogravure roll to deposit the abrasive islands on the web backing. U.S. Pat. No. 5,314,513 (Milleret al) describes the use of ceria for abrading.

U.S. Pat. No. 6,001,801 (Fujimori et al) describes an abrasive dressing tool that is used for abrading a rotatable CMP polishing pad that is attached to a rigidly mounted lower rotatable platen.

U.S. Pat. No. 6,077,153 (Fujita et al) describes a semiconductor wafer polishing machine where a polishing pad is attached to a rigid platen that rotates. The polishing pad is positioned to contact wafer-type workpieces that are attached to rotary workpiece spindles. These rotary workpiece spindles are mounted on a rigidly-mounted rotary platen. The rotatable abrasive polishing pad platen is rigidly mounted and travels along its rotation axis. However, it does not have a floating-platen action that allows the platen to have a spherical-action motion as it rotates. Because the workpiece spindles are mounted on a rotary platen they are not attached to a stationary machine base such as a granite base. Because of the configuration of the Fujita machine, it can not be used to provide a floating abrasive coated platen that allows the flat surface of the platen abrasive to be in floating conformal abrading contact with multiple workpieces that are attached to rotary workpiece spindles that are mounted on a rigid machine base.

U.S. Pat. No. 6,425,809 (Ichimura et al) describes a semiconductor wafer polishing machine where a polishing pad is attached to a rigid rotary platen. The polishing pad is in abrading contact with flat-surfaced wafer-type workpieces that are attached to rotary workpiece holders. These workpiece holders have a spherical-action universal joint. The universal joint allows the workpieces to conform to the surface of the platen-mounted abrasive polishing pad as the platen rotates. However, the spherical-action device is the workpiece holder and is not the rotary platen that holds the fixed abrasive disk.

U.S. Pat. No. 6,769,969 (Duescher) describes flexible abrasive disks that have annular bands of abrasive coated raised islands. These disks use fixed-abrasive particles for high speed flat lapping as compared with other lapping systems that use loose-abrasive liquid slurries. The flexible raised island abrasive disks are attached to the surface of a rotary platen to abrasively lap the surfaces of workpieces.

Various abrading machines and abrading processes are described in U.S. Pat. No. 5,364,655 (Nakamura et al), U.S. Pat. No. 5,569,062 (Karlsrud), U.S. Pat. No. 5,643,067 (Katsuoka et al), U.S. Pat. No. 5,769,697 (Nisho), U.S. Pat. No. 5,800,254 (Motley et al), U.S. Pat. No. 5,916,009 (Izumi et al), U.S. Pat. No. 5,964,651 (hose), U.S. Pat. No. 5,975,997 (Minami, U.S. Pat. No. 5,989,104 (Kim et al), U.S. Pat. No. 6,089,959 (Nagahashi, U.S. Pat. No. 6,165,056 (Hayashi et al), U.S. Pat. No. 6,168,506 (McJunken), U.S. Pat. No. 6,217,433 (Herrman et al), U.S. Pat. No. 6,439,965 (Ichino), U.S. Pat. No. 6,893,332 (Castor), U.S. Pat. No. 6,896,584 (Perlov et al), U.S. Pat. No. 6,899,603 (Homma et al), U.S. Pat. No. 6,935,013 (Markevitch et al), U.S. Pat. No. 7,001,251 (Doan et al), U.S. Pat. No. 7,008,303 (White et al), U.S. Pat. No. 7,014,535 (Custer et al), U.S. Pat. No. 7,029,380 (Horiguchi et al), U.S. Pat. No. 7,033,251 (Elledge), U.S. Pat. No. 7,044,838 (Maloney et al), U.S. Pat. No. 7,125,313 (Zelenski et al), U.S. Pat. No. 7,144,304 (Moore), U.S. Pat. No. 7,147,541 (Nagayama et al), U.S. Pat. No. 7,166,016 (Chen), U.S. Pat. No. 7,250,368 (Kida et al), U.S. Pat. No. 7,367,867 (Boller), U.S. Pat. No. 7,393,790 (Britt et al), U.S. Pat. No. 7,422,634 (Powell et al), U.S. Pat. No. 7,446,018 (Brogan et al), U.S. Pat. No. 7,456,106 (Koyata et al), U.S. Pat. No. 7,470,169 (Taniguchi et al), U.S. Pat. No. 7,491,342 (Kamiyama et al), U.S. Pat. No. 7,507,148 (Kitahashi et al), U.S. Pat. No. 7,527,722 (Sharan) and U.S. Pat. No. 7,582,221 (Netsu et al).

SUMMARY OF THE INVENTION

The presently disclosed technology includes a fixed-spindle, floating-platen system which is a new configuration of a single-sided lapping machine system. This system is capable of producing ultra-flat thin semiconductor wafer workpieces at high abrading speeds. This can be done by providing a precision-flat, rigid (e.g., synthetic, composite or granite) machine base that is used as the planar mounting surface for at least three rigid flat-surfaced rotatable workpiece spindles. Precision-thickness flexible abrasive disks are attached to a rigid flat-surfaced rotary platen that floats in three-point abrading contact with the three equal-spaced flat-surfaced rotatable workpiece spindles. These abrasive coated raised island disks have disk thickness variations of less than 0.0001 inches (3 microns) across the full annular bands of abrasive-coated raised islands to allow flat-surfaced contact with workpieces at very high abrading speeds and to assure that all of the expensive diamond abrasive particles that are coated on the island are fully utilized during the abrading process. Use of a platen vacuum disk attachment system allows quick set-up changes where different sizes of abrasive particles and different types of abrasive material can be quickly attached to the flat platen surfaces.

Water coolant is used with these raised island abrasive disks, which allows them to be used at very high abrading speeds, often in excess of 10,000 SFPM (160 km per minute). The coolant water is typically applied directly to the top surfaces of the workpieces. The applied coolant water results in abrading debris being continually flushed from the abraded surface of the workpieces. Here, when the water-carried debris falls off the spindle top surfaces it is not carried along by the platen to contaminate and scratch the adjacent high-value workpieces, a process condition that occurs in double-sided abrading and with continuous-coated abrasive disks.

The fixed-spindle floating-platen flat lapping system has two primary planar references. One planar reference is the precision-flat annular abrading surface of the rotatable floating platen. The other planar reference is the precision co-planar alignment of the flat surfaces of the rotary spindle tops of the three workpiece spindles that provide three-point support of the floating platen.

Flat surfaced workpieces are attached to the spindle tops and are contacted by the abrasive coating on the platen abrading surface. Both the workpiece spindles and the abrasive coated platens are simultaneously rotated while the platen abrasive is in controlled abrading pressure contact with the exposed surfaces of the workpieces. Workpieces are sandwiched between the spindle tops and the floating platen. This lapping process is a single-sided workpiece abrading process. The opposite surfaces of the workpieces can be lapped by removing the workpieces from the spindle tops, flipping them over, attaching them to the spindle tops and abrading the second opposed workpiece surfaces with the platen abrasive.

A granite machine base provides a dimensionally stable platform upon which the three (or more) workpiece spindles are mounted. The spindles must be mounted where their spindle tops are precisely co-planar within 0.0001 inches (3 microns) in order to successfully perform high speed flat lapping. The rotary workpiece spindles must provide rotary spindle tops that remain precisely flat at all operating speeds. Also, the spindles must be structurally stiff to avoid deflections in reaction to static or dynamic abrading forces.

Air bearing spindles are the preferred choice over roller bearing spindles for high speed flat lapping. They are extremely stiff, can be operated at very high rotational speeds and are frictionless. Because the air bearing spindles have no friction, torque feedback signal data from the internal or external spindle drive motors can be used to determine the state-of-finish of lapped workpieces. Here, as workpieces become flatter and smoother, the water wetted adhesive bonding stiction between the flat surfaced workpieces and the flat-type abrasive media increase. The relationship between the state-of-finish of the workpieces and the adhesive stiction is a very predictable characteristic and can be readily used to control or terminate the flat lapping process.

Air bearing or mechanical roller bearing workpiece spindles having equal precision heights can be mounted on precisely flat granite bases to provide a system where the flat spindle tops are precisely co-planar with each other. These precision height spindles and precision flat granite bases are more expensive than commodity type spindles and granite bases. Commodity type air bearing spindles and non-precision flat granite bases can be utilized with the use of adjustable height legs that are attached to the bodies of the spindles. The flat surfaces of the spindle tops can be aligned to be precisely co-planar within the required 0.0001 inches (3 microns) with the use of a rotating laser beam measurement device supplied by Hamar Laser Inc. of Danbury, Conn.

An alternative method that can be used to attach spindles to granite bases is to provide spherical-action mounts for each spindle. These spherical mounts allow each spindle top to be aligned to be co-planar with the other attached spindles. Workpiece spindles are attached to the rotor portion of the spherical mount that has a spherical-action rotation within a spherical base that has a matching spherical shaped contacting area. The spherical-action base is attached to the flat surface of a granite machine base. After the spindle tops are precisely aligned to be co-planar with each other, a mechanical or adhesive-based fastener device is used to fixture or lock the spherical mount rotor to the spherical mount base. Using these spherical-action mounts, the precision aligned workpiece spindles are structurally attached to the granite base.

Another very simple technique that can be used for co-planar alignment of the spindle-tops is to use the precision-flat surface of a floating platen annular abrading surface as a physical planar reference datum for the spindle tops. Platens must have precision flat surfaces where the flatness variation is less than 0.0001 inches (3 microns) in order to successfully perform high speed flat lapping. Here, the precision-flat platen is brought into flat surfaced contact with the spindle-tops where pressurized air or a liquid can be applied through fluid passageways to form a spherical-action fluid bearing that allows the spherical rotor to freely float without friction within the spherical base. This platen surface contacting action aligns the spindle-tops with the flat platen surface. By this platen-to-spindles contacting action, the spindle tops are also aligned to be co-planar with each other. After co-planar alignment of the spindle tops, vacuum can be applied through the fluid passageways to temporarily lock the spherical rotors to the spherical bases. Then, a mechanical fastener or an adhesive-based fastener device is used to fixture or lock the spherical mount rotor to the spherical mount base. When using an adhesive rotor locking system, an adhesive can be applied in a small gap between a removable bracket that is attached to the spherical rotor and a removable bracket that is attached to the spherical base to rigidly bond the spherical rotor to the spherical base after the adhesive is solidified. If it is desired to re-align the spindle top, the removable spherical mount rotor and spherical base adhesive brackets can be discarded and replaced with new individual brackets that can be adhesively bonded together to again lock the spherical mount rotors to the respective spherical bases.

The fixed-platen floating-spindle lapping system can also be used to recondition the abrasive surface of the abrasive disk that is attached to the platen. This rotary platen annular abrasive surface tends to experience uneven wear across the radial surface of the annular abrasive band after continued abrading contact with the spindle workpieces. When the non-even wear of the abrasive surface becomes excessive and the abrasive can no longer provide precision-flat workpiece surfaces it must be reconditioned to re-establish its planar flatness.

Reconditioning the platen abrasive surface can be easily accomplished with this system by attaching equal-thickness abrasive disks to the flat surfaces of the spindles in place of the workpieces. Here, the abrasive surface reconditioning takes place by rotating the spindle abrasive disks while they are in flat-surfaced abrading contact with the rotating platen abrasive annular band.

In addition, the fixed-platen floating-spindle lapping system can also be used to recondition the platen bare (no abrasive coating) abrading surface by attaching equal-thickness abrasive disks, or other abrasive devices such as abrasive coated conditioning rings, to the flat surfaces of the rotary spindle tops in place of the workpieces. Here, the platen annular abrading surface reconditioning takes place by rotating the spindle abrasive disks, or conditioning rings, while they are in flat-surfaced abrading contact with the rotating platen annular abrading surface.

Automatic robotic devices can be added to the fixed-spindle-floating-platen system to change both the workpieces and the abrasive disks.

The fixed-platen floating-spindle lapping system has the capability to resist large mechanical abrading forces present with abrading processes with unprecedented flatness accuracies and minimum mechanical planar flatness variations. Because the system is comprised of robust components it has a long lifetime with little maintenance even in the harsh abrading environment present with most abrading processes. Air bearing spindles are not prone to failure or degradation and provide a flexible system that is quickly adapted to different polishing processes.

Platen surfaces have patterns of vacuum port holes that extend under the abrasive annular portion of an abrasive disk to assure that the disk is firmly attached to the platen surface. When an abrasive disk is attached to a flat platen surface with vacuum, the vacuum applies in excess of 10 pound per square inch (0.7 kg per square cm) hold-down clamping forces to bond the flexible abrasive disk to the platen. Because the typical abrasive disks have such a large surface area, the total vacuum clamping forces can easily exceed thousands of pounds of force which results in the flexible abrasive disk becoming an integral part of the structurally stiff and heavy platen. Use of the vacuum disk attachment system assures that each disk is in full conformal contact with the platen flat surface. Also, each individual disk can be marked so that it can be remounted in the exact same tangential position on the platen by using the vacuum attachment system. Here, a disk that is "worn-in" to compensate for the flatness variation of a given platen will recapture the unique flatness characteristics of that platen position by orienting the disk and attaching it to the platen at its original platen circumference position. This abrasive disk will not have to be "worn-in" again upon reinstallation. Expensive diamond abrasive particles are sacrificed each time it is necessary to wear-in an abrasive disk to establish a precision flatness of the disk abrasive surface. The original surface-flatness of the abrasive disk is re-established by simply mounting the previously removed abrasive disk in the same circumferential location on the platen that it had before it was removed from that same platen

BRIEF DESCRIPTION OF THE DRAWING

FIG. 14.1 is a top view of a floating-platen having an external annular support rib.

FIG. 14.2 is a top view of a floating-platen having an external annular support rib.

DETAILED DESCRIPTION OF THE INVENTION

Figure 1:
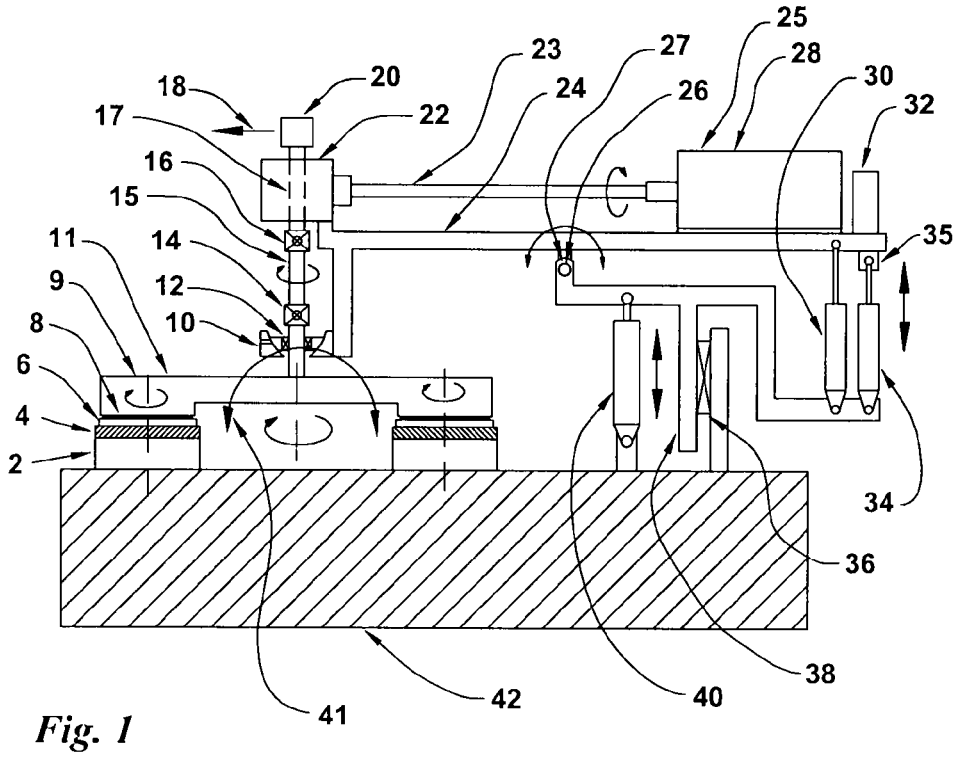
FIG. 1 is a cross section view of a pivot-balance floating-platen lapper machine.

The fixed-spindle floating-platen lapping machines used for high speed flat lapping require very precisely controlled abrading forces that change during a flat lapping procedure. Very low abrading forces are used because of the extraordinarily high cut rates when diamond abrasive particles are used at very high abrading speeds. As per Preston's equation, high abrading pressures result in high material removal rates. The high cut rates are used initially with coarse abrasive particles to develop the flatness of the non-flat workpiece. Then, lower cut rates are used with medium or fine sized abrasive particles during the polishing portion of the flat lapping operation.

When the abrading forces are accurately controlled, the friction that is present in the lapper machine components can create large variations in the abrading forces that are generated by machine members. Here, even though the generated forces are accurate, these forces are either increased or decreased by machine element friction. Abrading forces that are not precisely accurate prevent successful high speed flat lapping. Also, the lapping machines must be robust to resist abrading forces without distortion of the machine members in a way that affects the flatness of the workpieces. Further, the machine must be light in weight, easy to use and tolerant of the harsh abrasive environment.

Pivot-Balance Floating-Platen Machine

The fixed-spindle floating-platen lapping machines used for high speed flat lapping require very precisely controlled abrading forces that change during a flat lapping procedure. Very low abrading forces are used because of the extraordinarily high cut rates when diamond abrasive particles are used at very high abrading speeds. As per Preston's equation, high abrading pressures result in high material removal rates. The high cut rates are used initially with coarse abrasive particles to develop the flatness of the non-flat workpiece. Then, lower cut rates are used with medium or fine sized abrasive particles during the polishing portion of the flat lapping operation.

When the abrading forces are accurately controlled, the friction that is present in the lapper machine components can create large variations in the abrading forces that are generated by machine members. Here, even though the generated forces are accurate, these forces are either increased or decreased by machine element friction. Abrading forces that are not precisely accurate prevent successful high speed flat lapping.

Also, the lapping machines must be robust to resist abrading forces without distortion of the machine members in a way that affects the flatness of the workpieces. Further, the machine must be light in weight, easy to use and tolerant of the harsh abrasive environment The pivot-balance floating-platen lapping machine provides these desirable features. The lapper machine components such as the platen drive motor are used to counterbalance the weight of the abrasive platen assembly. Low friction pivot bearings are used. The whole pivot frame can be raised or lowered from a machine base by an electric motor driven screw jack. Zero-friction air bearing cylinders can be used to apply the desired abrading forces to the platen as it is held in 3-point abrading contact with the workpieces attached to rotary spindles.

The air pressure applied to the air cylinder is typically provide by a I/P (electrical current-to-pressure) pressure regulator that is activated by an abrading process controller. The actual force generated by the air cylinder can be sensed and verified by an electronic force sensor load cell that is attached to the piston end of the air cylinder. The force sensor allows feed-back type closed-loop control of the abrading pressure that is applied to the workpieces. Abrading pressures on the workpieces can be precisely changed throughout the lapping operation by the lapping process controller.

The spindles are attached to a dimensionally stable granite base. Spherical bearings allow the platen to freely float during the lapping operation. A right-angle gear box has a hollow drive shaft to provide vacuum to attach raised island abrasive disks to the platen. A set of two constant velocity universal joints attached to drive shafts allow the spherical motion of the rotating platen.

When the pivot balance is adjusted where the weight of the drive motor and hardware equals the weight of the platen and its hardware, then the pivot balance frame has a "tared" or "zero" balance condition. To accomplish this, a counterbalance weight can be moved along the pivot balance frame. Also, weighted mechanical screw devices can be easily adjusted to provide a true balance condition. Use of frictionless air bearings at the rotational axis of the pivot frame allows this precision balancing to take place.

FIG. 1 is a cross section view of a pivot-balance floating-platen lapper machine. The pivot-balance floating-platen lapping machine 25 provides these desirable features. The lapper machine 25 components such as the platen drive motor 28 and a counterweight 32 are used to counterbalance the weight of the abrasive platen assembly 11 where the pivot frame 24 is balanced about the pivot frame 24 pivot center 27.

The pivot frame 24 has a rotation axis centered at the pivot frame pivot center 27 where the platen assembly 11 is attached at one end of the pivot frame 24 from the pivot center 27 and the platen motor 28 and a counterbalance weight 32 are attached to the pivot frame 24 at the opposed end of the pivot frame 24 from the pivot center 27. The pivot frame 24 has low friction rotary pivot bearings 26 at the pivot center 27 where the pivot bearings 26 can be frictionless air bearings or low friction roller bearings. The platen drive motor 28 is attached to the pivot frame 24 in a position where the weight of the platen drive motor 28 nominally or partially counterbalances the weight of the abrasive platen assembly 11. A movable and weight-adjustable counterweight 32 is attached to the pivot frame 24 in a position where the weight of the counterweight 32 partially counterbalances the weight of the abrasive platen assembly 11. The weight of the counterweight 32 is used together with the weight of the platen motor 28 to effectively counterbalance the weight of the abrasive platen assembly 11 that is also attached to the pivot frame 24. When the pivot frame 24 is counterbalanced, the pivot frame 24 pivots freely about the pivot center 27. The platen drive motor 28 rotates a drive shaft 23 that is coupled to the gear box 22 to rotate the gear box 22 hollow drive shaft 17.

The whole pivot frame 24 can be raised or lowered from a machine base 42 by a elevation frame 38 lift device 40 that can be an electric motor driven screw jack lift device or a hydraulic lift device. The elevation frame 38 lift device 40 is attached to a linear slide 36 that is attached to the machine base 42 and also is attached to the elevation lift frame 38 where the elevation lift frame 38 lift device 40 can have a position sensor (not shown) that can be used to precisely control the vertical position of the elevation frame 38. Zero-friction air bearing cylinders 34 can be used to apply the desired abrading forces to the platen 9 as it is held in 3-point abrading contact with the workpieces 6 attached to rotary spindles 2 having rotary spindle-tops 4. One end of one or more air bearing cylinders 34 can be attached to the pivot frame 24 at different positions to apply forces to the pivot frame 24 where these applied forces provide an abrading force to the platen 9. The support end of the air bearing cylinders can be attached to the elevation frame 38.

Raised Elevation and Pivot Frames

The frame of the pivot-balance lapper is attached to a pair of linear slides where the frame can be raised with the use of a pair of electric jacks such as linear actuators. These actuators can provide closed-loop precision control of the position of the pivot frame and are well suited for long term use in a harsh abrading environment. When the pivot frame and floating platen are raised, workpieces can be changed and the abrasive disks that are attached to the platen can be easily changed. The platen is allowed to float with the use of a spherical-action platen shaft bearing.

Single or multiple friction-free air bearing air cylinders can be used to precisely control the abrading forces that are applied to the workpieces by the platen. These air cylinders are located at one end of the beam-balance pivot frame and the platen is located at the opposed end of the beam-balance pivot frame. Use of air bearings on the pivot frame pivot axis shaft eliminates any bearing friction. Cylindrical air bearings that are used on the pivot axis are available from New Way Air Bearing Company, Aston, Pa.

Any force that is applied by the air cylinders is directly transmitted across the length of the pivot frame to the platen because of the lack of pivot bearing friction. Other bearings such as needle bearings, roller bearings or fluid lubricated journal bearings can be used but all of these have more rotational friction than the air bearings. Air bearing cylinders such as the AirPel® cylinders from Airpot Corporation of Norwalk, Conn. can be selected where the cylinder diameter can provide the desired range of abrading forces.

Once the frictionless pivot frame is balanced, any force applied by the abrading force cylinders on one end of the pivot frame is directly transmitted to the platen abrasive surface that is located at the other end of this balance-beam apparatus. To provide a wide range of abrading forces, multiple air cylinders of different diameter sizes can be used in parallel with each other. Because the range of air pressure supplied to the cylinders has a typical limited range of from 0 to 100 psia with limited allowable incremental pressure control changes, it is difficult to provide the extra-precise abrading force load changes required for high speed flat lapping. Use of small-diameter cylinders provide very finely adjusted abrading forces because these small cylinders have nominal force capabilities.

The exact forces that are generated by the air cylinders can be very accurately determined with load cell force sensors. The output of these load cells can be used by feedback controller devices to dynamically adjust the abrading forces on the platen abrasive throughout the lapping procedure. This abrading force control system can even be programmed to automatically change the applied-force cylinder forces to compensate for the very small weight loss experienced by an abrasive disk during a specific lapping operation. Also, the weight variation of "new" abrasive disks that are attached to a platen to provide different sized abrasive particles can be predetermined. Then the abrading force control system can be used to compensate for this abrasive disk weight change from the previous abrasive disk and provide the exact desired abrading force on the platen abrasive.

The abrading force feedback controller provides an electrical current input to an air pressure regulator referred to as an I/P (current to pressure) controller. The abrading force controller has the capability to change the pressures that are independently supplied to each of the parallel abrading force air cylinders. The actual force produced by each independently controlled air cylinder is determined by a respected force sensor load cell to close the feedback loop.

Figure 2:
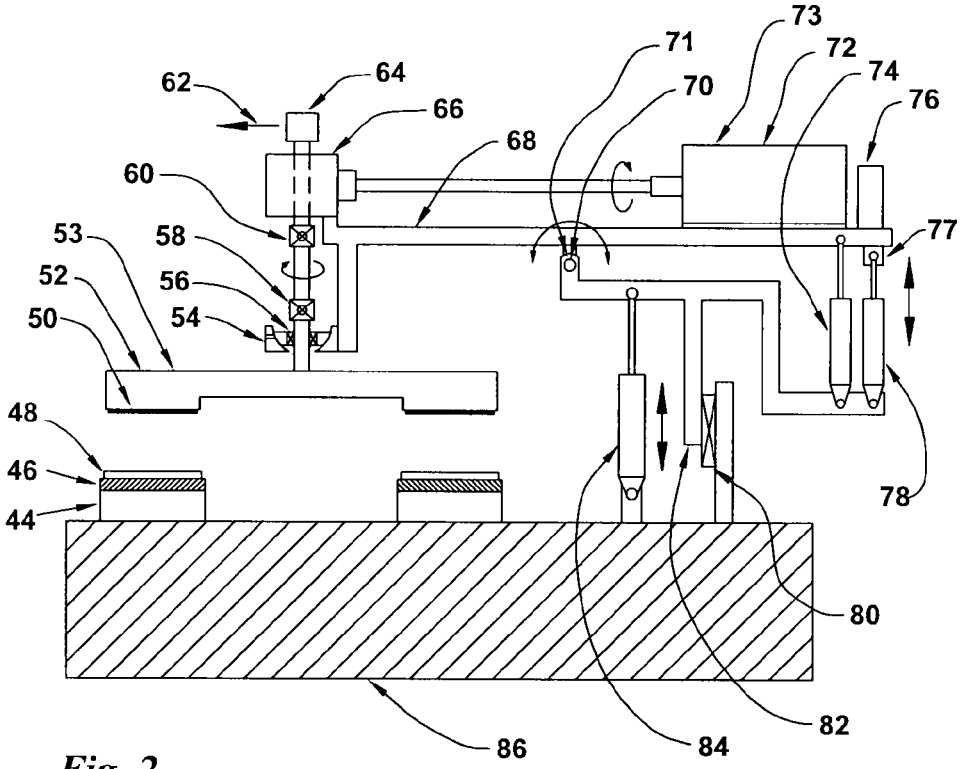
FIG. 2 is a cross section view of a raised pivot-balance floating-platen lapper machine.

FIG. 2 is a cross section view of a raised pivot-balance floating-platen lapper machine. Here, the pivot frame is raised up to allow workpieces and abrasive disks to be changed. The pivot-balance floating-platen lapping machine 73 provides these desirable features. The lapper machine 73 components such as the platen drive motor 72 and a counterweight 76 are used to counterbalance the weight of the abrasive platen assembly 53 where the pivot frame 68 is balanced about the pivot frame 68 pivot center 71.

The pivot frame 68 has a rotation axis centered at the pivot frame pivot center 71 where the platen assembly 53 is attached at one end of the pivot frame 68 from the pivot center 71 and the platen motor 72 and a counterbalance weight 76 are attached to the pivot frame 68 at the opposed end of the pivot frame 68 from the pivot center 71. The pivot frame 68 has low friction rotary pivot bearings 70 at the pivot center 71 where the pivot bearings 70 can be frictionless air bearings or low friction roller bearings. The platen drive motor 72 is attached to the pivot frame 68 in a position where the weight of the platen drive motor 72 nominally or partially counterbalances the weight of the abrasive platen assembly 53. A movable and weight-adjustable counterweight 76 is attached to the pivot frame 68 in a position where the weight of the counterweight 76 partially counterbalances the weight of the abrasive platen assembly 53. The weight of the counterweight 76 is used together with the weight of the platen motor 72 to effectively counterbalance the weight of the abrasive platen assembly 53 that is also attached to the pivot frame 68. When the pivot frame 68 is counterbalanced, the pivot frame 68 pivots freely about the pivot center 71. The platen drive motor 72 rotates a drive shaft 23 that is coupled to the gear box 66 to rotate the gear box 66 hollow drive shaft.

The whole pivot frame 68 can be raised or lowered from a machine base 86 by a elevation frame 82 lift device 84 that can be an electric motor driven screw jack lift device or a hydraulic lift device. The elevation frame 82 lift device 84 can have a position sensor that can be used to precisely control the vertical position of the elevation frame 82. Zero-friction air bearing cylinders 78 can be used to apply the desired abrading forces to the platen 52 as it is held in 3-point abrading contact with the workpieces 48 attached to rotary spindles 44 having rotary spindle-tops 46. One end of one or more air bearing cylinders 78 can be attached to the pivot frame 68 at different positions to apply forces to the pivot frame 68 where these applied forces provide an abrading force to the platen 52. The support end of the air bearing cylinders 78 can also be attached to the elevation frame 82. The floating platen 52 has a spherical rotation and a cylindrical that is provided by the spherical-action platen support bearing 56 that supports the weight of the floating platen 52 where the spherical-action platen support bearing 56 is supported by the pivot frame 68.

The air pressure applied to the air cylinder 78 is typically provide by an I/P (electrical current-to-pressure) pressure regulator (not shown) that is activated by an abrading process controller (not shown). The actual force generated by the air cylinder 78 can be sensed and verified by an electronic force sensor load cell 77 that is attached to the cylinder rod end of the air cylinder 78. The force sensor 77 allows feed-back type closed-loop control of the abrading pressure that is applied to the workpieces 48. Abrading pressures on the workpieces 48 can be precisely changed throughout the lapping operation by the lapping process controller.

The spindles 44 are attached to a dimensionally stable granite or epoxy-granite base 86. A spherical-action bearing 56 allows the platen 52 to freely float with a spherical action motion during the lapping operation. A right-angle gear box 66 has a hollow drive shaft to provide vacuum to attach raised island abrasive disks 50 to the platen 52. Vacuum 62 is applied to a rotary union 64 that allows rotation of the gear box 66 drive hollow shaft to route vacuum to the platen 52 through tubing or other passageway devices (not shown) where abrasive disks 50 can be attached to the platen 52 by vacuum. The spherical bearing 56 can be a roller bearing or an air bearing having an air passage 54 that allows pressurized air to be applied to create an air bearing effect or vacuum to be applied to lock the spherical bearing 56 rotor and housing components together. One or more conventional universal joints or plate-type universal joints or constant velocity universal joints or a set of two constant velocity universal joints 58, 60 attached to the drive shaft 15 allow the spherical rotation and cylindrical rotation motion of the rotating platen 52.

The pivot frame 68 can be rotated to desired positions and locked at the desired rotation position by use of a pivot frame locking device 74 that is attached to the pivot frame 68 and to the pivot frame 68 elevation frame 82. The pivot frame 68 can be raised or lowered to selected elevation positions by the electric motor screw jack 84 or by a hydraulic jack 84 that is attached to the machine base 86 and to the pivot frame 68 elevation frame 82 where the pivot frame 68 elevation frame 82 is supported by a translatable slide device 80 that is attached to the machine base 86.

Raised and Tilted Pivot Frame

When the pivot frame is raised by the electric actuator or by hydraulic cylinders, the floating platen can also be tilted by rotation of the pivot frame about the pivot frame rotation axis. Once the pivot frame is tilted, the frame can be locked in that tilted position with the use of a frame position hydraulic locking device. This hydraulic locking device allows hydraulic fluid to pass from one chamber of a linear piston-type cylinder to another chamber through by-pass tubing. By shutting a by-pass valve, hydraulic fluid can not pass from one chamber to another and the cylinder shaft is locked in position. During a lapping operation, the hydraulic locking device is deactivated to allow friction-free rotational motion of the pivot frame.

Figure 3:
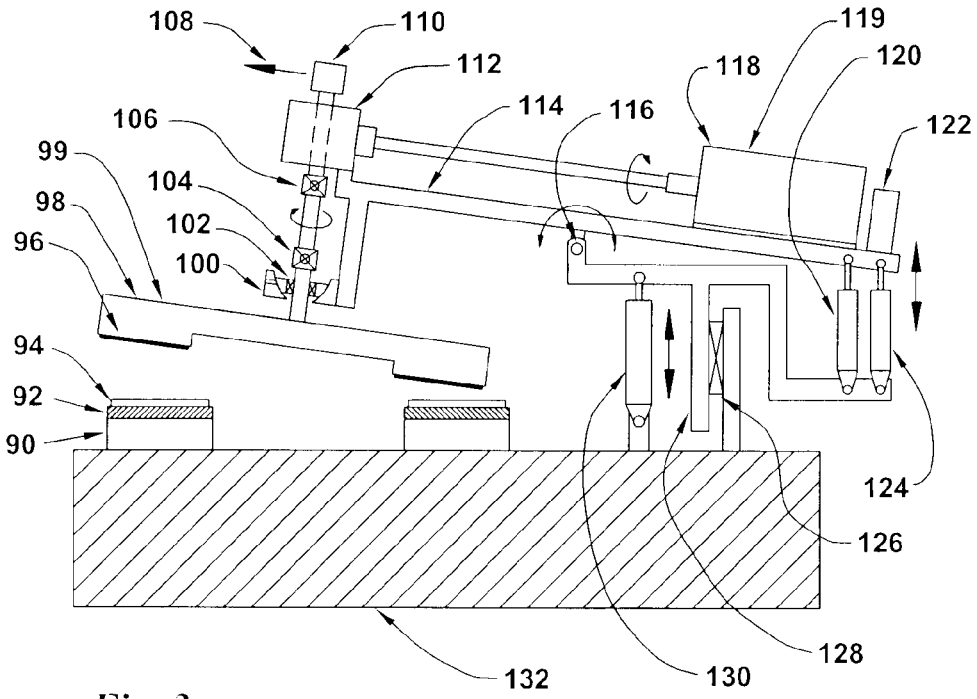
FIG. 3 is a cross section view of a raised and tilted pivot-balance lapper machine.

FIG. 3 is a cross section view of a raised and tilted pivot-balance floating-platen lapper machine. Here, the pivot frame is raised and rotated and the floating-platen is tilted away from a horizontal position. The pivot-balance floating-platen lapping machine 118 provides these desirable features. The lapper machine 118 components such as the platen drive motor 119 and a counterweight 122 are used to counterbalance the weight of the abrasive platen assembly 99 where the pivot frame 114 is balanced about the pivot frame 114 pivot center 116.

The pivot frame 114 has a rotation axis centered at the pivot frame pivot center 116 where the platen assembly 99 is attached at one end of the pivot frame 114 from the pivot center 116 and the platen motor 119 and a counterbalance weight 122 are attached to the pivot frame 114 at the opposed end of the pivot frame 114 from the pivot center 116. The pivot frame 114 has low friction rotary pivot bearings at the pivot center 116 where the pivot bearings can be frictionless air bearings or low friction roller bearings. The platen drive motor 119 is attached to the pivot frame 114 in a position where the weight of the platen drive motor 119 nominally or partially counterbalances the weight of the abrasive platen assembly 99. A movable and weight-adjustable counterweight 122 is attached to the pivot frame 114 in a position where the weight of the counterweight 122 partially counterbalances the weight of the abrasive platen assembly 99. The weight of the counterweight 122 is used together with the weight of the platen motor 119 to effectively counterbalance the weight of the abrasive platen assembly 99 that is also attached to the pivot frame 114. When the pivot frame 114 is counterbalanced, the pivot frame 114 pivots freely about the pivot center 116. The platen drive motor 119 rotates a drive shaft 23 that is coupled to the gear box 112 to rotate the gear box 112 hollow drive shaft.

The whole pivot frame 114 can be raised or lowered from a machine base 132 by a elevation frame 128 lift device 130 that can be an electric motor driven screw jack lift device or a hydraulic lift device. The elevation frame 128 lift device 130 can have a position sensor that can be used to precisely control the vertical position of the elevation frame 128. Zero-friction air bearing cylinders 124 can be used to apply the desired abrading forces to the platen 98 as it is held in 3-point abrading contact with the workpieces 94 attached to rotary spindles 90 having rotary spindle-tops 92. One end of one or more air bearing cylinders 124 can be attached to the pivot frame 114 at different positions to apply forces to the pivot frame 114 where these applied forces provide an abrading force to the platen 98. The support end of the air bearing cylinders 124 can also be attached to the elevation frame 128. The floating platen 98 has a spherical rotation and a cylindrical rotation that is provided by the spherical-action platen support bearing 102 that supports the weight of the floating platen 98 where the spherical-action platen support bearing 102 is supported by the pivot frame 114.

The air pressure applied to the air cylinder 124 is typically provide by an I/P (electrical current-to-pressure) pressure regulator (not shown) that is activated by an abrading process controller (not shown). The actual force generated by the air cylinder 124 can be sensed and verified by an electronic force sensor load cell that is attached to the cylinder rod end of the air cylinder 124. The force sensor allows feed-back type closed-loop control of the abrading pressure that is applied to the workpieces 94. Abrading pressures on the workpieces 94 can be precisely changed throughout the lapping operation by the lapping process controller.

The spindles 90 are attached to a dimensionally stable granite or epoxy-granite base 132. A spherical-action bearing 102 allows the platen 98 to freely float with a spherical action motion during the lapping operation. A right-angle gear box 112 has a hollow drive shaft to provide vacuum to attach raised island abrasive disks 96 to the platen 98. Vacuum 108 is applied to a rotary union 110 that allows rotation of the gear box 112 drive hollow shaft to route vacuum to the platen 98 through tubing or other passageway devices (not shown) where abrasive disks 96 can be attached to the platen 98 by vacuum. The spherical bearing 102 can be a roller bearing or an air bearing having an air passage 100 that allows pressurized air to be applied to create an air bearing effect or vacuum to be applied to lock the spherical bearing 102 rotor and housing components together. One or more conventional universal joints or plate-type universal joints or constant velocity universal joints or a set of two constant velocity universal joints 104, 106 attached to the drive shaft 15 allow the spherical motion of the rotating platen 98.

The pivot frame 114 can be rotated to desired positions and locked at the desired rotation position by use of a pivot frame locking device 120 that is attached to the pivot frame 114 and to the pivot frame 114 elevation frame 128. The pivot frame 114 can be raised or lowered to selected elevation positions by the electric motor screw jack 130 or by a hydraulic jack 130 that is attached to the machine base 132 and to the pivot frame 114 elevation frame 128 where the pivot frame 114 elevation frame 128 is supported by a translatable slide device 126 that is attached to the machine base 132.

Pivot-Balance Platen Spherical Rotation

When the pivot frame is raised by the pair of electric actuators (or by hydraulic cylinders) and tilted, the floating platen can also be rotated back into a horizontal position because of the use of a spherical-action platen shaft bearing. The drive shafts that are used to rotate the platen are connected with constant velocity universal joints to the platen drive shaft and to the gear box drive shaft. These universal joints allow the floating platen to have a spherical rotation while rotational power is supplied by the drive shafts to rotate the platen. The constant velocity universal joints are sealed and are well suited for use in a harsh abrading environment. If desired, the platen can be rotated at very low speeds while the pivot frame is tilted and the platen is tilted back where the abrading surface is nominally horizontal.

Figure 4:
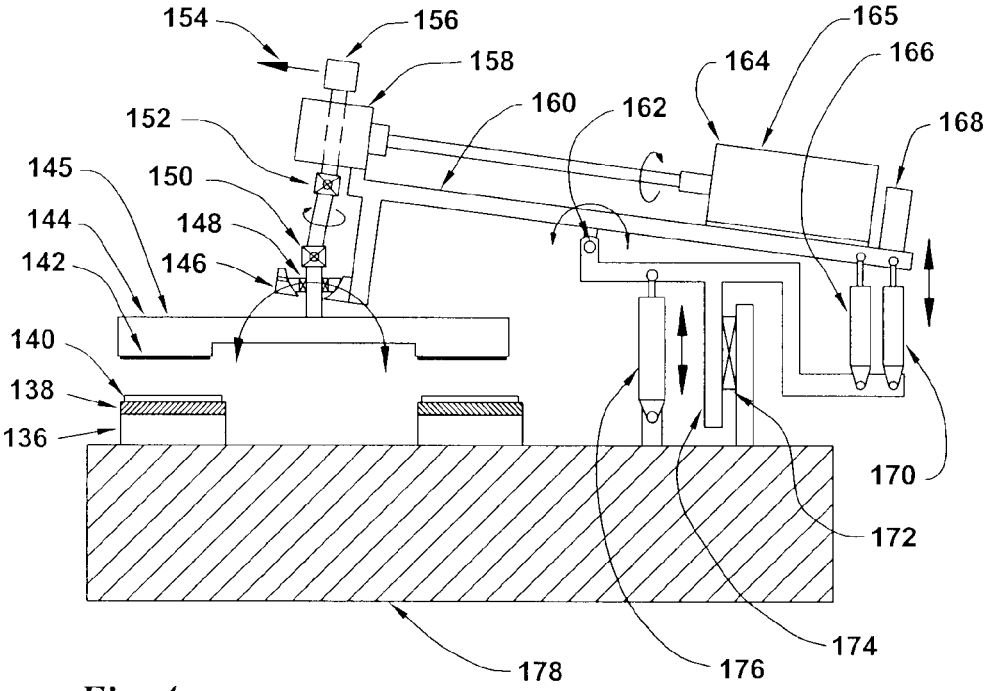
FIG. 4 is a cross section view of a raised pivot-balance lapper with a horizontal platen.

FIG. 4 is a cross section view of a raised pivot-balance floating-platen lapper machine with a horizontal platen. Here, the pivot frame is raised and rotated and the floating-platen is rotated back to a nominally horizontal position. The pivot-balance floating-platen lapping machine 164 provides these desirable features. The lapper machine 164 components such as the platen drive motor 165 and a counterweight 168 are used to counterbalance the weight of the abrasive platen assembly 145 where the pivot frame 160 is balanced about the pivot frame 160 pivot center 162.

The pivot frame 160 has a rotation axis centered at the pivot frame pivot center 162 where the platen assembly 145 is attached at one end of the pivot frame 160 from the pivot center 162 and the platen motor 165 and a counterbalance weight 168 are attached to the pivot frame 160 at the opposed end of the pivot frame 160 from the pivot center 162. The pivot frame 160 has low friction rotary pivot bearings at the pivot center 162 where the pivot bearings can be frictionless air bearings or low friction roller bearings. The platen drive motor 165 is attached to the pivot frame 160 in a position where the weight of the platen drive motor 165 nominally or partially counterbalances the weight of the abrasive platen assembly 145. A movable and weight-adjustable counterweight 168 is attached to the pivot frame 160 in a position where the weight of the counterweight 168 partially counterbalances the weight of the abrasive platen assembly 145. The weight of the counterweight 168 is used together with the weight of the platen motor 165 to effectively counterbalance the weight of the abrasive platen assembly 145 that is also attached to the pivot frame 160. When the pivot frame 160 is counterbalanced, the pivot frame 160 pivots freely about the pivot center 162. The platen drive motor 165 rotates a drive shaft 23 that is coupled to the gear box 158 to rotate the gear box 158 hollow drive shaft.

The whole pivot frame 160 can be raised or lowered from a machine base 178 by a elevation frame 174 lift device 176 that can be an electric motor driven screw jack lift device or a hydraulic lift device. The elevation frame 174 lift device 176 can have a position sensor that can be used to precisely control the vertical position of the elevation frame 174. Zero-friction air bearing cylinders 170 can be used to apply the desired abrading forces to the platen 144 as it is held in 3-point abrading contact with the workpieces 140 attached to rotary spindles 136 having rotary spindle-tops 138. One end of one or more air bearing cylinders 170 can be attached to the pivot frame 160 at different positions to apply forces to the pivot frame 160 where these applied forces provide an abrading force to the platen 144. The support end of the air bearing cylinders 170 can also be attached to the elevation frame 174. The floating platen 144 has a spherical rotation and a cylindrical rotation that is provided by the spherical-action platen support bearing 148 that supports the weight of the floating platen 144 where the spherical-action platen support bearing 148 is supported by the pivot frame 160.

The air pressure applied to the air cylinder 170 is typically provide by an I/P (electrical current-to-pressure) pressure regulator (not shown) that is activated by an abrading process controller (not shown). The actual force generated by the air cylinder 170 can be sensed and verified by an electronic force sensor load cell that is attached to the cylinder rod end of the air cylinder 170. The force sensor allows feed-back type closed-loop control of the abrading pressure that is applied to the workpieces 140. Abrading pressures on the workpieces 140 can be precisely changed throughout the lapping operation by the lapping process controller.

The spindles 136 are attached to a dimensionally stable granite or epoxy-granite base 178. A spherical-action bearing 148 allows the platen 144 to freely float with a spherical action motion during the lapping operation. A right-angle gear box 158 has a hollow drive shaft to provide vacuum to attach raised island abrasive disks 142 to the platen 144. Vacuum 154 is applied to a rotary union 110 that allows rotation of the gear box 158 drive hollow shaft to route vacuum to the platen 144 through tubing or other passageway devices (not shown) where abrasive disks 142 can be attached to the platen 144 by vacuum. The spherical bearing 148 can be a spherical roller bearing or an air bearing having an air passage 146 that allows pressurized air to be applied to create an air bearing effect or vacuum to be applied to lock the spherical bearing 148 rotor and housing components together. One or more conventional universal joints or plate-type universal joints or constant velocity universal joints or a set of two constant velocity universal joints 150, 152 attached to the drive shaft 15 allow the spherical rotation motion and the cylindrical rotation motion of the rotating platen 144 that rotates the abrasive disk 142 when the abrasive disk 142 is in abrading contact with workpieces 140.

The pivot frame 160 can be rotated to desired positions and locked at the desired rotation position by use of a pivot frame locking device 166 that is attached to the pivot frame 160 and to the pivot frame 160 elevation frame 174. The pivot frame 160 can be raised or lowered to selected elevation positions by the electric motor screw jack 176 or by a hydraulic jack 176 that is attached to the machine base 178 and to the pivot frame 160 elevation frame 174 where the pivot frame 160 elevation frame 174 is supported by a translatable slide device 172 that is attached to the machine base 178.

Pivot-Balance Lapper Frame

A top view of the pivot-balance lapping machine shows how this lightweight framework and platen assembly has widespread support members that provide unusual stiffness to the abrading system. The two primary supports of the pivot frame are the two linear slides that have a very wide stance by being positioned at the outboard sides of the rigid granite base. The two precision-type heavy-duty sealed pivot frame linear slides have roller bearings that provide great structural rigidity for the abrasive platen as the platen rotates during the lapping operation.

Very low friction pivot bearings are used on the pivot shaft to minimize the pivot shaft friction as the pivot frame rotates. Because this pivot shaft friction is so low, the exact abrading force that is generated by the pivot abrading force air cylinder is transmitted to the abrading platen during the lapping operation. Cylindrical air bearings can provide zero-friction rotation of the pivot frame support shaft even when the pivot frame and platen system is quite heavy.

Figure 5:
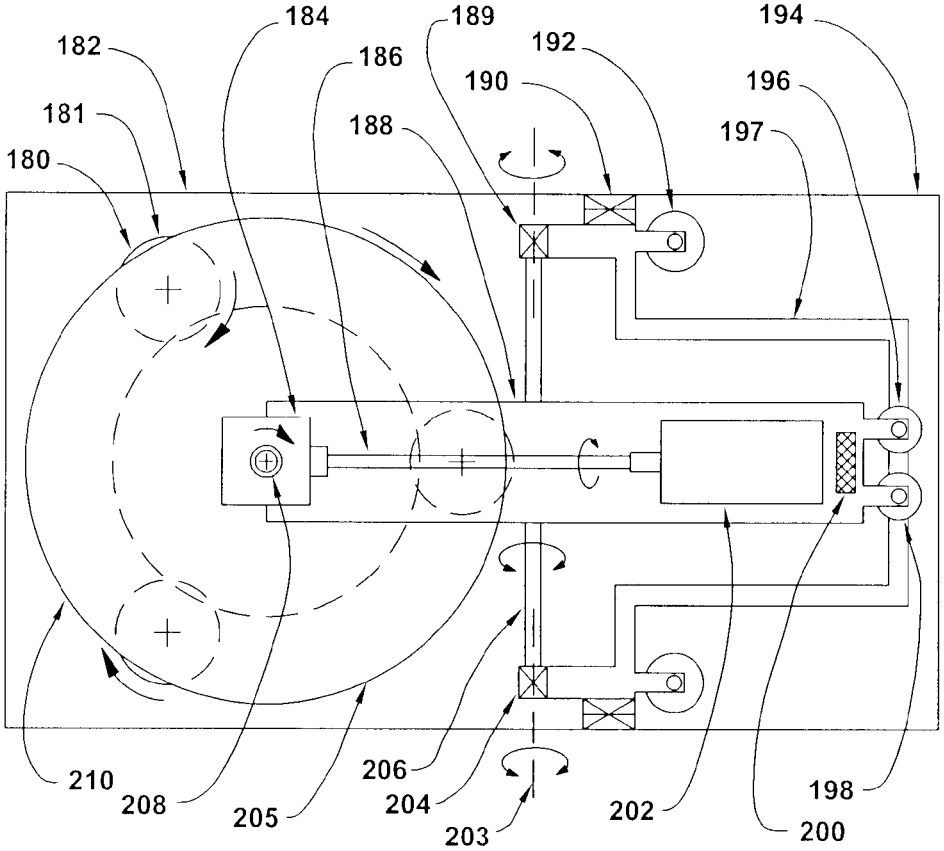
FIG. 5 is a top view of a pivot-balance floating-platen lapper machine.

FIG. 5 is a top view of a pivot-balance floating-platen lapper machine. The pivot-balance floating-platen lapping machine 182 components include the platen drive motor 202 and a counterweight 200 are that are used to counterbalance the weight of the abrasive platen assembly 205 where the pivot frame 188 is balanced about the pivot frame 188 pivot center 189 rotation axis 203.

The pivot frame 188 has a rotation axis 203 centered at the pivot frame pivot center 189 where the platen assembly 205 is attached at one end of the pivot frame 188 from the pivot axis 203 and the platen motor 202 and a counterbalance weight 200 are attached to the pivot frame 188 at the opposed end of the pivot frame 188 from the pivot axis 203. The pivot frame 188 has low friction rotary pivot bearings 204 at the pivot center 189 where the pivot bearings 204 can be frictionless air bearings or low friction roller bearings. The radial stiffness of these pivot frame 188 air bears 204 are typically much stiffer than equivalent roller bearings 204. The platen drive motor 202 is attached to the pivot frame 188 in a position where the weight of the platen drive motor 202 nominally or partially counterbalances the weight of the abrasive platen assembly 205. A movable and weight-adjustable counterweight 200 is attached to the pivot frame 188 in a position where the weight of the counterweight 200 partially counterbalances the weight of the abrasive platen assembly 205. The weight of the counterweight 200 is used together with the weight of the platen motor 202 to effectively counterbalance the weight of the abrasive platen assembly 205 that is also attached to the pivot frame 188. When the pivot frame 188 is counterbalanced, the pivot frame 188 pivots freely about the pivot axis 203. The platen drive motor 202 rotates a drive shaft 186 that is coupled to the gearbox 184 to rotate the gearbox 184 hollow abrading platen 210 rotary drive shaft 208.

The whole pivot frame 188 can be raised or lowered from a machine base 194 by a elevation frame 197 lift device 192 that can be an electric motor driven screw jack lift device or a hydraulic lift device. The elevation frame 197 lift device 192 is attached to a linear slide 190 that is attached to the machine base 194 and also is attached to the elevation lift frame 197 where the elevation lift frame 197 lift device 192 can have a position sensor (not shown) that can be used to precisely control the vertical position of the elevation lift frame 197.

The elevation frame 197 can be raised with the use of an elevation frame 197 lift devices 192 such as a pair of electric jacks such as a linear actuator produced by Exlar Corporation, Minneapolis, Minn. These linear actuators can provide closed-loop precision control of the position of the elevation frame 197 and are well suited for long term use in a harsh abrading environment. When the elevation frame 197 and the pivot frame 188 and the abrasive platen assembly 205 and the floating platen 210 are raised, workpieces can be changed and the abrasive disks (not shown) that are attached to the platen can be easily changed. Here the floating platen 210 is allowed to have a spherical motion floatation and cylindrical rotation with the use of a spherical-action platen shaft bearing (not shown that rotates the abrasive disk 268 when the abrasive disk is in abrading contact with workpieces (not shown).

Zero-friction air bearing cylinders 196 can be used to apply the desired abrading forces to the platen 210 as it is held in 3-point abrading contact with the workpieces 180 attached to rotary spindles 181 having rotary spindle-tops. One end of one or more air bearing cylinders 196 can be attached to the pivot frame 188 at different positions to apply forces to the pivot frame 188 where these applied forces provide an abrading force to the platen 210. The support end of the air bearing cylinders can be attached to the elevation frame 197.

The top view of the pivot-balance lapping machine 182 shows how this lightweight framework and platen assembly has widespread support members that provide unusual stiffness to the abrading system. The two primary supports of the pivot frame are the two linear slides 190 that have a very wide stance by being positioned at the outboard sides of the rigid granite, epoxy-granite, cast iron or steel machine base 194. The two precision-type heavy-duty sealed pivot frame machine tool type linear slides 190 have roller bearings that provide great structural rigidity for the lapping machine 182 and particularly for the abrasive platen 210 when the platen 210 is rotated during the lapping operation.

Very low friction pivot bearings 204 are used on the pivot shaft 206 to minimize the pivot shaft 206 friction as the pivot frame 188 rotates. Because this pivot shaft 206 friction is so low, the abrading force that is generated by the pivot abrading force air cylinder 196 is transmitted without friction-distortion to the abrading platen 210 during the lapping operation. Cylindrical air bearings 204 can provide zero-friction rotation of the pivot frame 188 support shaft 206 even when the pivot frame 188 and platen assembly 205 is quite heavy.

The pivot-balance floating-platen lapping machine 182 is an elegantly simple abrading machine that provides extraordinary precision control of abrading forces for this abrasive high speed flat lapping system. All of its components are all robust and are well suited for operation in a harsh abrading atmosphere with minimal maintenance.

Platen Spherical Bearing

Vacuum is required to attach the flexible abrasive disk to the flat abrading surface of the rotary platen. Here, a right-angle gear box having a hollow shaft is used to drive the platen. Constant velocity universal joints are connected to a stub shaft that connects to the platen drive shaft. A flexible tubing is used to route the vacuum line around the two universal joints to provide a continuous vacuum connection from a rotary union attached to the gear box hollow shaft to the platen. The platen drive motor shaft engages the gear box input shaft on one side of the gear box and the gearbox output shaft is positioned at right angles to the input drive shaft. The platen spherical bearing allows the platen to float freely while the platen assembly weight is fully supported by the spherical bearing and the pivot frame assembly.

Figure 6:
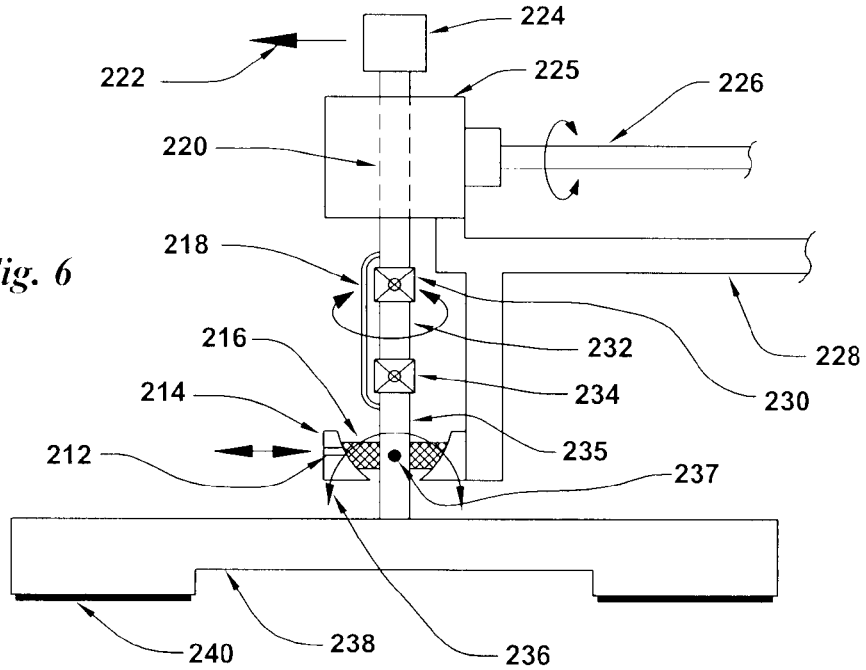
FIG. 6 is a cross section view of a pivot-balance lapper machine with universal joints.

FIG. 6 is a cross section view of a pivot-balance floating-platen lapper machine with flexible vacuum tubing and universal joints. Vacuum is required to attach the flexible abrasive disk 240 to the flat abrading surface of the rotary platen 238. Here, a right-angle gearbox 225 having a hollow shaft 220 is used to drive the platen 238. Constant velocity universal joints 230, 234 are connected to a stub shaft 232 that connects the gearbox 225 having a hollow shaft 220 to the platen 238 drive shaft 235. A flexible hollow tubing 218 is used to route the vacuum around the two universal joints 230, 234 to provide a continuous vacuum 222 connection from a rotary union 224 attached to the gear box 225 hollow shaft 220 to the platen 238. The horizontal platen 238 drive motor shaft 226 is coupled to the gearbox 225 input shaft on one side of the gearbox 225 and the vertical hollow gearbox 225 output shaft 220 is positioned at right angles to the input drive shaft. The platen 238 spherical bearing rotor 216 that is supported by the platen 238 spherical bearing housing 214 allows the platen 238 to float freely with spherical rotation 236 and where the platen 302 has a spherical rotation about the platen 238 spherical bearing rotor 216 and the platen 238 spherical bearing housing 214 center of rotation 237.

The platen 238 assembly weight is fully supported by the platen 238 spherical bearing rotor 216 that is supported by the platen 238 spherical bearing housing 214 that is attached to the pivot frame 228. The platen 238 assembly weight is fully supported by the platen 238 spherical bearing rotor 216 that is supported by the platen 238 spherical bearing housing 214 where both the platen 238 spherical bearing rotor 216 and the platen 238 spherical bearing housing 214 have spherical surfaces that have the same spherical radii to assure that the platen 238 spherical bearing rotor 216 and the platen 238 spherical bearing housing 214 have mutual contact spherical-matching contact with each other.

The platen 238 spherical bearing housing 214 can have a fluid passageway 212 where a pressurized liquid fluid or a pressurized gas can be routed to the spherical joint between the spherical surfaces of the platen 238 spherical bearing rotor 216 and the platen 238 spherical bearing housing 214 to form a spherical action air bearing. Also, vacuum can be applied to the platen 238 spherical bearing housing 214 fluid passageway 212 to be routed to the spherical joint between the matching spherical surfaces of the platen 238 spherical bearing rotor 216 and the platen 238 spherical bearing housing 214 to lock the platen 238 spherical bearing rotor 216 to the platen 238 spherical bearing housing 214.

Also, the platen 238 spherical bearing rotor 216 and the platen 238 spherical bearing housing 214 are constructed where the platen 238 spherical bearing rotor 216 is restrained in all directions, including horizontal and vertical, by the platen 238 spherical bearing housing 214.

Platen Universal Joints

Vacuum is required to attach the flexible abrasive disk to the flat abrading surface of the rotary platen. Here, a right-angle gear box having a hollow shaft is used to drive the platen. Constant velocity universal joints are connected to a stub shaft that connects to the platen drive shaft. These universal joints allow the stub shaft between the gear box and the platen shaft to move through a spherical angle even when the platen is rotated to provide abrading action on the workpieces. The constant velocity universal joints are sealed and are well suited for use in a harsh abrading environment.

Figure 7:
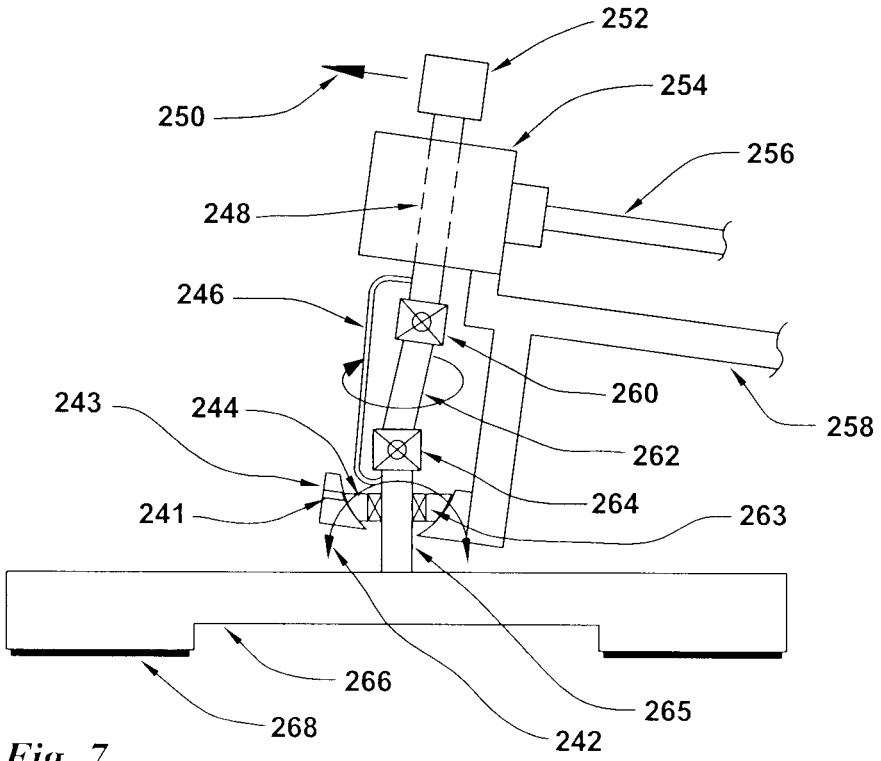
FIG. 7 is a cross section view of a rotated pivot-balance floating-platen lapper machine.

FIG. 7 is a cross section view of a rotated pivot-balance floating-platen lapper machine with flexible vacuum tubing and universal joints. Vacuum is required to attach the flexible abrasive disk 268 to the flat abrading surface of the rotary platen 266. Here, a right-angle gearbox 254 having a hollow shaft 248 is used to drive the platen 266. Constant velocity or conventional universal joints 260, 264 are connected to a stub shaft 262 that connects the gearbox 254 having a hollow shaft 248 to the platen 266 drive shaft 265. A flexible hollow tubing 246 is used to route the vacuum around the two universal joints 260, 264 to provide a continuous vacuum 250 connection from a rotary union 252 attached to the gearbox 254 hollow shaft 248 to the platen 266. The horizontal platen 266 drive motor shaft 256 is coupled to the gearbox 254 input shaft on one side of the gearbox 254 and the vertical hollow gearbox 254 output shaft 248 is positioned at right angles to the input drive shaft. The platen 266 spherical bearing rotor 244 that is supported by the platen 266 spherical bearing housing 243 allows the platen 266 to float freely with spherical rotation 242 and also allow the platen 266 to have cylindrical rotation that rotates the abrasive disk 268 when the abrasive disk 268 is in abrading contact with workpieces (not shown).

The platen 266 assembly weight is fully supported by the platen 266 spherical bearing rotor 244 that is supported by the platen 266 spherical bearing housing 243 that is attached to the pivot frame 258. The platen 266 assembly weight is fully supported by the platen 266 spherical bearing rotor 244 that is supported by the platen 266 spherical bearing housing 243 where both the platen 266 spherical bearing rotor 244 and the platen 266 spherical bearing housing 243 have spherical surfaces that have the same spherical radii to assure that the platen 266 spherical bearing rotor 244 and the platen 266 spherical bearing housing 243 have mutual contact spherical-matching contact with each other.

The platen 266 spherical bearing housing 243 can have a fluid passageway 241 where a pressurized liquid fluid or a pressurized gas can be routed to the spherical joint between the spherical surfaces of the platen 266 spherical bearing rotor 244 and the platen 266 spherical bearing housing 243 to form a spherical action air bearing. Also, vacuum can be applied to the platen 266 spherical bearing housing 243 fluid passageway 241 to be routed to the spherical joint between the matching spherical surfaces of the platen 266 spherical bearing rotor 244 and the platen 266 spherical bearing housing 243 to lock the platen 266 spherical bearing rotor 244 to the platen 266 spherical bearing housing 243. The platen 266 spherical bearing housing 243 has a roller bearing 263 which supports the platen 266 rotary drive shaft 265 that allows the platen 266 to have cylindrical rotation while the platen 266 spherical bearing rotor 244 and the platen 266 spherical bearing housing 243 allow the platen 266 to have spherical rotation.

Also, the platen 266 spherical bearing rotor 244 and the platen 266 spherical bearing housing 243 are constructed where the platen 266 spherical bearing rotor 244 is restrained in all directions, including horizontal and vertical, by the platen 266 spherical bearing housing 243.

Platen Spherical Device Air Bearing

When a pivot frame is raised by the electric actuator or by hydraulic cylinders, the floating platen can be tilted because of the use of a spherical-action platen shaft bearing. To fixture the tilted platen in a selected position, a spherical air bearing can be used as the platen shaft spherical bearing. Here, pressurized air can be supplied to the spherical air bearing to provide friction-free spherical rotation of the platen. The spherical air bearing rotation device can allow cylindrical rotation of the platen and/or allow the spherical rotation of the platen about the spherical rotation device center of rotation. When it is desired to lock the platen in a selected tilted position, vacuum can be supplied to the same spherical air bearing. The vacuum draws the spherical bearing platen shaft rotor into direct contact with the spherical air bearing housing that is attached to the platen pivot frame. The platen becomes locked to the pivot frame in the selected position by the vacuum applied to the spherical air bearing.

Figure 8:
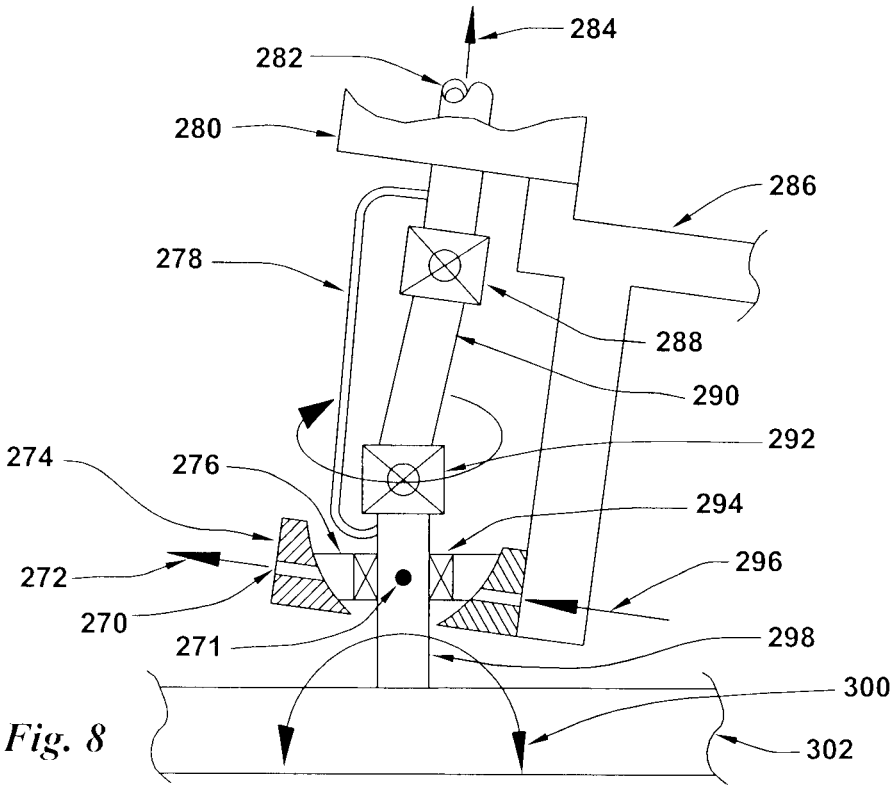
FIG. 8 is a cross section view of a pivot-locked pivot-balance floating-platen lapper.

FIG. 8 is a cross section view of a rotated pivot-balance floating-platen lapper machine having flexible vacuum tubing and universal joints where the platen can be locked in a spherical rotation position. Vacuum is required to attach a flexible abrasive disk (not shown) to the flat abrading surface of the rotary platen 302. Here, a right-angle gearbox 280 having a hollow shaft 774 is used to drive the platen 302. Constant velocity or conventional universal joints 288, 292 are connected to a stub shaft 290 that connects the gearbox 280 having a hollow shaft 774 to the platen 302 drive shaft 298. A flexible hollow tubing 278 is used to route the vacuum around the two universal joints 288, 292 to provide a continuous vacuum 284 connection from a rotary union (not shown) attached to the gearbox 280 hollow shaft 774 to the platen 302. The horizontal platen 302 drive motor shaft (not shown) is coupled to the gearbox 280 input shaft on one side of the gearbox 280 and the vertical hollow gearbox 280 output shaft 282 is positioned at right angles to the input drive shaft. The platen 302 spherical bearing rotor 276 that is supported by the platen 302 spherical bearing housing 274 allows the platen 302 to float freely with spherical rotation 300 and also allow the platen 302 to have cylindrical rotation that rotates the abrasive disk when the abrasive disk is in abrading contact with workpieces (not shown).

The platen 302 assembly weight is fully supported by the platen 302 spherical bearing rotor 276 that is supported by the platen 302 spherical bearing housing 274 that is attached to the pivot frame 286. The platen 302 assembly weight is fully supported by the platen 302 spherical bearing rotor 276 that is supported by the platen 302 spherical bearing housing 274 where both the platen 302 spherical bearing rotor 276 and the platen 302 spherical bearing housing 274 have spherical surfaces that have the same spherical radii to assure that the platen 302 spherical bearing rotor 276 and the platen 302 spherical bearing housing 274 have mutual contact spherical-matching contact with each other.

The platen 302 spherical bearing housing 274 can have a fluid passageway 270 where a pressurized liquid fluid 296 or a pressurized gas 296 can be routed through the passageway 270 to the spherical joint between the spherical surfaces of the platen 302 spherical bearing rotor 276 and the platen 302 spherical bearing housing 274 to form a spherical action air bearing. Also, vacuum 272 can be applied to the platen 302 spherical bearing housing 274 fluid passageway 270 to be routed to the spherical joint between the matching spherical surfaces of the platen 302 spherical bearing rotor 276 and the platen 302 spherical bearing housing 274 to lock the platen 302 spherical bearing rotor 276 to the platen 302 spherical bearing housing 274. The platen 302 spherical bearing housing 274 has a roller bearing 294 which supports the platen 302 rotary drive shaft 298 that allows the platen 302 to have cylindrical rotation while the platen 302 spherical bearing rotor 276 and the platen 302 spherical bearing housing 274 allow the platen 302 to have spherical rotation about the platen 302 spherical bearing rotor 276 and the platen 302 spherical bearing housing 274 center of rotation 271.

Also, the platen 302 spherical bearing rotor 276 and the platen 302 spherical bearing housing 274 are constructed where the platen 302 spherical bearing rotor 276 is restrained in all directions, including horizontal and vertical, by the platen 302 spherical bearing housing 274.

Platen Spherical Rotation Lock

To fixture a tilted platen in a selected position, a spherical roller bearing and a spherical rotor brake pad system can be used together. Both the spherical roller bearing and the spherical brake rotor share the same spherical center of rotation. The brake pad surface also has the same spherical surface curvature as the spherical roller bearing and the spherical brake rotor. During a typical lapping operation, the brake pad is withdrawn from contacting the brake rotor and the platen is allowed to float freely with spherical motion When it is desired to lock the platen in a selected tilted position, the brake pad is forced by an electric solenoid against the surface of the spherical brake rotor to hold the platen in the selected position. The brake pad is attached to a shaft that extends out from the electric solenoid device where the axis of the solenoid brake shaft intersects the spherical center of rotation of the spherical platen bearing. Because the brake pad shaft axis intersects the spherical center of rotation, the brake pad does not impart any tilting torque on the freely floating platen. This results in the platen being fixtured at the desired tilted location when the solenoid is activated.

Figure 9:
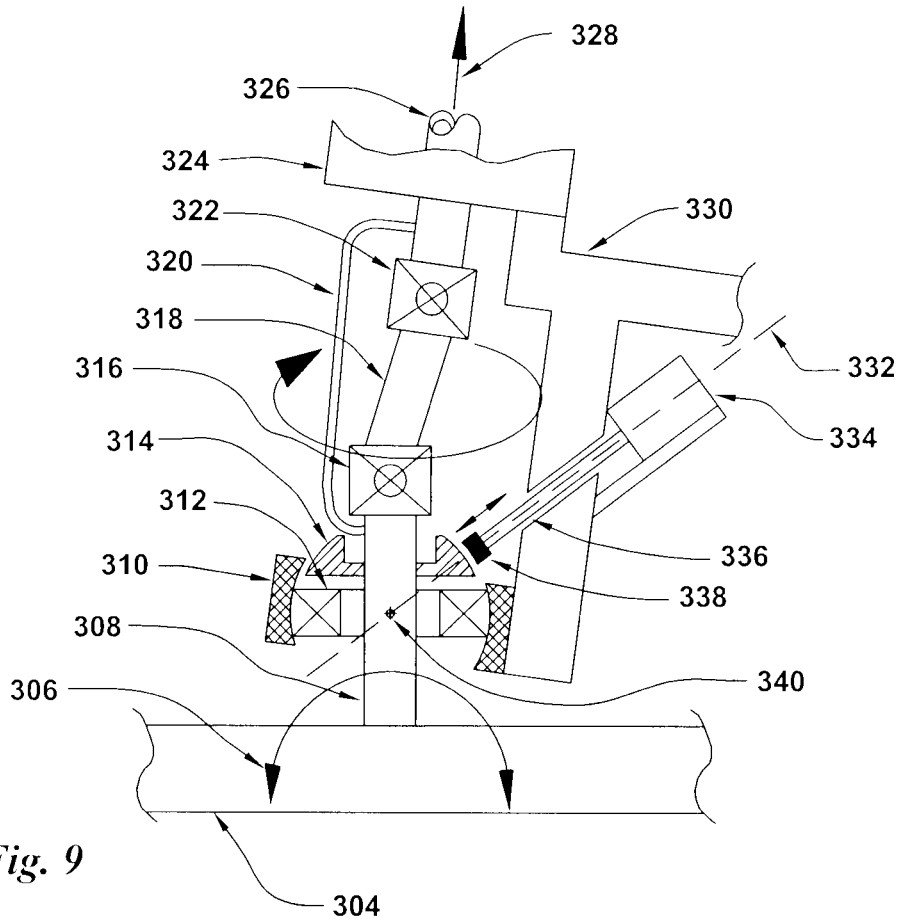
FIG. 9 is a cross section view of a brake-locked rotated pivot frame lapper machine.

FIG. 9 is a cross section view of a rotated pivot frame with a horizontal platen using a brake pad spherical action lock where the platen can be locked in a spherical rotation position. Vacuum is required to attach a flexible abrasive disk (not shown) to the flat abrading surface of the rotary platen 304. Here, a right-angle gearbox 324 having a hollow shaft 326 is used to drive the platen 304. Constant velocity or conventional universal joints 322, 316 are connected to a stub shaft 318 that connects the gearbox 324 having a hollow shaft 326 to the platen 304 drive shaft 308. A flexible hollow tubing 320 is used to route the vacuum around the two universal joints 322, 316 to provide a continuous vacuum 328 connection from a rotary union (not shown) attached to the gearbox 324 hollow shaft 326 to the platen 304. The horizontal platen 304 drive motor shaft (not shown) is coupled to the gearbox 324 input shaft on one side of the gearbox 324 and the vertical hollow gearbox 324 output shaft 326 is positioned at right angles to the input drive shaft. The platen 304 spherical bearing rotor 312 that is supported by the platen 304 spherical bearing housing 310 allows the platen 304 to float freely with spherical rotation 306 and also allow the platen 304 to have cylindrical rotation that rotates the abrasive disk (not shown) when the abrasive disk is in abrading contact with workpieces (not shown).

The platen 304 assembly weight is fully supported by the platen 304 spherical bearing rotor 312 that is supported by the platen 304 spherical bearing housing 310 that is attached to the pivot frame 330. The platen 304 assembly weight is fully supported by the platen 304 spherical bearing rotor 312 that is supported by the platen 304 spherical bearing housing 310 where both the platen 304 spherical bearing rotor 312 and the platen 304 spherical bearing housing 310 have spherical surfaces that have the same spherical radii to assure that the platen 304 spherical bearing rotor 312 and the platen 304 spherical bearing housing 310 have mutual contact spherical-matching contact with each other.

The platen 304 spherical bearing housing 310 can have a fluid passageway (not shown) where a pressurized liquid fluid or a pressurized gas can be routed through the passageway to the spherical joint between the spherical surfaces of the platen 304 spherical bearing rotor 312 and the platen 304 spherical bearing housing 310 to form a spherical action air bearing. Or the spherical bearing rotor 312 and the platen 304 spherical bearing housing 310 can be mechanical roller bearings. Here, the platen 304 spherical bearing housing 310 can have has a roller bearing 312 which supports the platen 304 rotary drive shaft 308 that allows the platen 304 to have cylindrical rotation while the platen 304 spherical bearing rotor 312 and the platen 304 spherical bearing housing 310 allow the platen 304 to have spherical rotation.

Also, the platen 304 spherical bearing rotor 312 and the platen 304 spherical bearing housing 310 are constructed where the platen 304 spherical bearing rotor 312 is restrained in all directions, including horizontal and vertical, by the platen 304 spherical bearing housing 310.

A mechanical brake rotor 314 is attached to the platen 304 drive shaft 308 where the mechanical brake rotor 314 has a spherical surface that has a spherical center of rotation 340 that is coincident with and shared in common with the spherical center of rotation 340 of the platen 304 spherical centers of rotation of both the spherical bearing rotor 312 and the platen 304 spherical bearing housing 310.

A spherical surfaced brake pad 338 is attached to a brake activation force device 334 brake pad shaft 336 that can be an air cylinder, spring-return air cylinder, a solenoid or a piezoelectric brake activation force device 334 where the axis 332 of the brake activation force device 334 brake pad shaft 336 is aligned to pass through the mechanical brake rotor 314 spherical surface spherical center of rotation 340. When the brake pad 338 is forced against the mechanical brake rotor 314 by the brake activation force device 334 to lock the platen 304 in a selected spherical rotation position, the brake pad 338 does not apply a torque to the mechanical brake rotor 314, which could tilt the platen 304, because the axis of the brake activation force device 334 brake pad shaft 336 is aligned to pass through the mechanical brake rotor 314 spherical surface spherical center of rotation 340.

Air Cylinder Platen Spherical Lock

Another technique that can be used to fixture a floating platen is to use a brake pad attached to a spring-return air cylinder. Here, a spherical roller bearing and a spherical rotor brake pad system can be used together. Both the spherical roller bearing and the spherical brake rotor share the same spherical center of rotation. The brake pad surface also has the same spherical surface curvature as the spherical roller bearing and the spherical brake rotor. During a typical lapping operation, the brake pad is withdrawn from contacting the brake rotor and the platen is allowed to float freely with spherical motion.

The spherical-surfaced brake pad is attached to a spring-return air cylinder where it is necessary to apply air pressure to disengage the brake pad. During a typical lapping operation, the brake pad is withdrawn from contacting the brake rotor and the platen is allowed to float freely with spherical motion. When it is desired to lock the platen in a selected tilted position, the air pressure is interrupted and the brake pad is forced by the air cylinder return spring against the surface of the spherical brake rotor to hold the platen in the selected position.

The brake pad is attached to a shaft that extends out from the air cylinder where the axis of the solenoid brake shaft intersects the spherical center of rotation of the spherical platen bearing. Because the brake pad shaft axis intersects the spherical center of rotation, the brake pad does not impart any tilting torque on the freely floating platen. This results in the platen being fixtured at the desired tilted location when the solenoid is activated.

Figure 10:
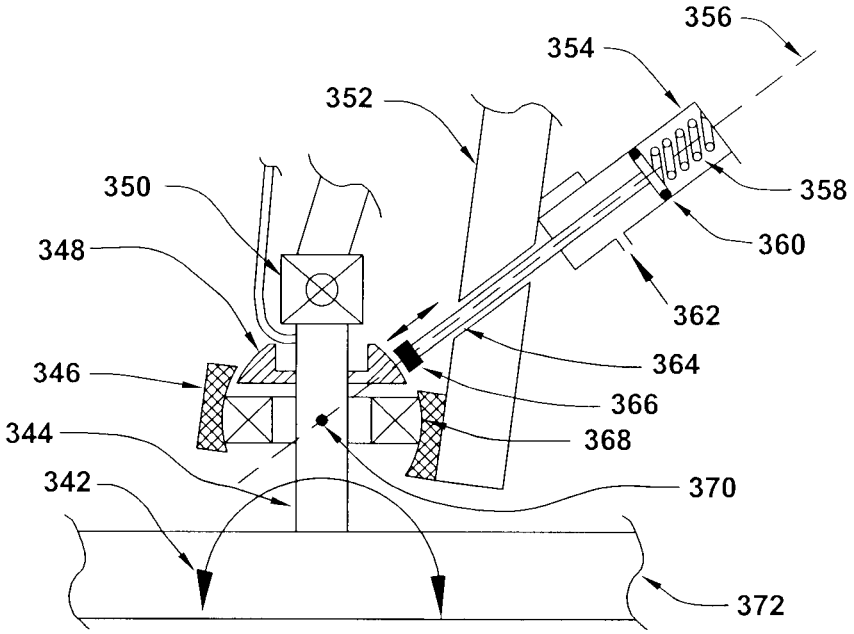
FIG. 10 is a cross section view of a air cylinder driven pivot frame brake lock.

FIG. 10 is a cross section view of a rotated pivot frame with a horizontal platen using a spring-return brake pad spherical action lock where the platen can be locked in a spherical rotation position. Constant velocity or conventional universal joints 350 are connected to a stub shaft that connects the gearbox (not shown) having a hollow shaft not shown) to the platen 372 drive shaft 344. The platen 372 spherical bearing rotor 368 that is supported by the platen 372 spherical bearing housing 346 allows the platen 372 to float freely with spherical rotation 342 and also allow the platen 372 to have cylindrical rotation that rotates the abrasive disk (not shown) when the abrasive disk is in abrading contact with workpieces (not shown).

The platen 372 assembly weight is fully supported by the platen 372 spherical bearing rotor 368 that is supported by the platen 372 spherical bearing housing 346 that is attached to the pivot frame 352. The platen 372 assembly weight is fully supported by the platen 372 spherical bearing rotor 368 that is supported by the platen 372 spherical bearing housing 346 where both the platen 372 spherical bearing rotor 368 and the platen 372 spherical bearing housing 346 have spherical surfaces that have the same spherical radii to assure that the platen 372 spherical bearing rotor 368 and the platen 372 spherical bearing housing 346 have mutual contact spherical-matching contact with each other.

The spherical bearing rotor 368 and the platen 372 spherical bearing housing 346 can be mechanical roller bearings. Here, the platen 372 spherical bearing housing 346 can have has a roller bearing 368 which supports the platen 372 rotary drive shaft 344 that allows the platen 372 to have cylindrical rotation while the platen 372 spherical bearing rotor 368 and the platen 372 spherical bearing housing 346 allow the platen 372 to have spherical rotation.

Also, the platen 372 spherical bearing rotor 368 and the platen 372 spherical bearing housing 346 are constructed where the platen 372 spherical bearing rotor 368 is restrained in all directions, including horizontal and vertical, by the platen 372 spherical bearing housing 346.

A mechanical brake rotor 348 is attached to the platen 372 drive shaft 344 where the mechanical brake rotor 348 has a spherical surface that has a spherical center of rotation 370 that is coincident with and shared in common with the spherical center of rotation 370 of the platen 372 spherical centers of rotation of both the spherical bearing rotor 368 and the platen 372 spherical bearing housing 346.

A spherical surfaced brake pad 366 is attached to a brake activation force device 354 brake pad shaft 364 that can be a spring-return air cylinder force device 354 where the axis 356 of the brake activation force device 354 brake pad shaft 364 is aligned to pass through the mechanical brake rotor 348 spherical surface spherical center of rotation 370. When the brake pad 366 is forced against the mechanical brake rotor 348 by the brake activation force device 354 to lock the platen 372 in a selected spherical rotation position, the brake pad 366 does not apply a torque to the mechanical brake rotor 348, which could tilt the platen 372, because the axis of the brake activation force device 354 brake pad shaft 364 is aligned to pass through the mechanical brake rotor 348 spherical surface spherical center of rotation 370.

The spring-return air cylinder force device 354 has a return spring 358 that pushes against an air cylinder piston 360 to provide forced contact of the brake pad 366 with the mechanical brake rotor 348 to prevent free spherical motion of the platen 372. When pressurized air 362 is used to act against the air cylinder piston 360 return spring 358, this action prevents return spring induced contact of the brake pad 366 with the mechanical brake rotor 348 to allow free spherical rotation motion of the platen 372. Spherical rotation motion of the platen 372 is prevented when there is not sufficient air pressure of the pressurized air 362 to push the cylinder piston 360 against the return spring 358 to prevent contact of the of the brake pad 366 with the mechanical brake rotor 348.

Platen Center of Gravity Offset

Figure 11:
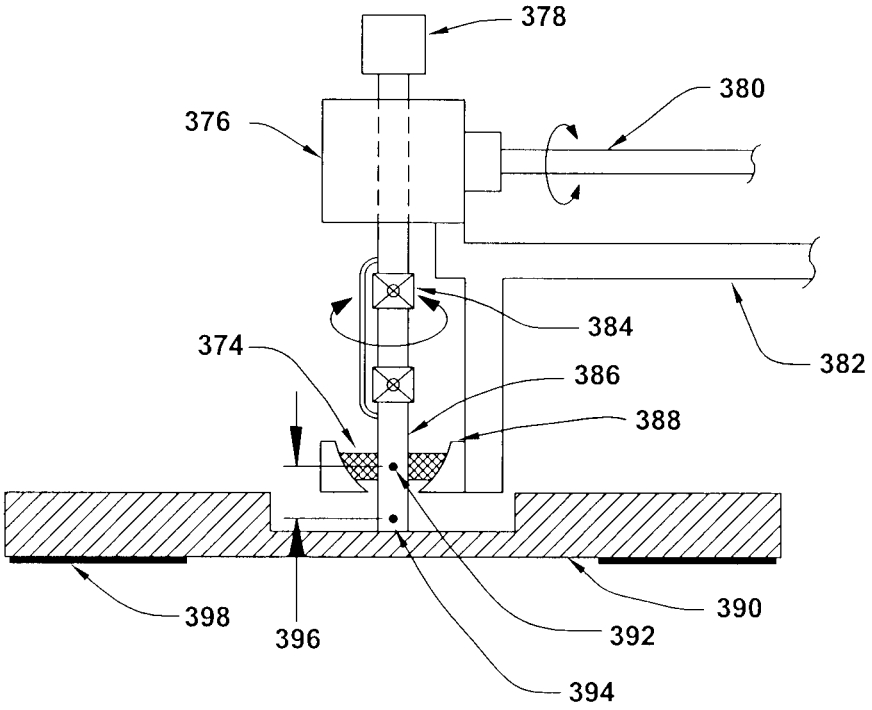
FIG. 11 is a cross section view of an off-set center of gravity of a rotating abrading platen.

FIG. 11 is a cross section view of a pivot-balance floating-platen lapper machine where the center of gravity of the rotating platen is off-set from the center of spherical rotation of the platen spherical rotation device. The abrading platen 390 has an attached flexible abrasive disk 398 where the abrading platen 390 has a mass center 394 that has an off-set distance 396 that is less than 3 inches (7.6 cm) or preferred to be less than 2 inches (5 cm) and more preferred to be less than 1 inch (2.5 cm) and most preferred to be less than 0.5 inches (1.3 cm) and most highly preferred to be less than 0.25 inches (0.64 cm) from the center of spherical rotation of the platen spherical rotation device 392.

The platen 390 has a platen rotation drive shaft 386 that is rotationally driven by a gearbox 376 with an universal joint 384. Vacuum is supplied to the platen 390 by a rotary union 378 and the gearbox 376 is attached to and supported by a pivot frame 382 where a platen drive motor (not shown) rotates a gearbox 376 input drive shaft 380. The platen spherical rotation bearing rotor 374 is supported by a platen spherical rotation bearing housing 388 that is supported by the pivot frame 382.

Brake Pad Platen Center of Gravity Offset

Figure 12:
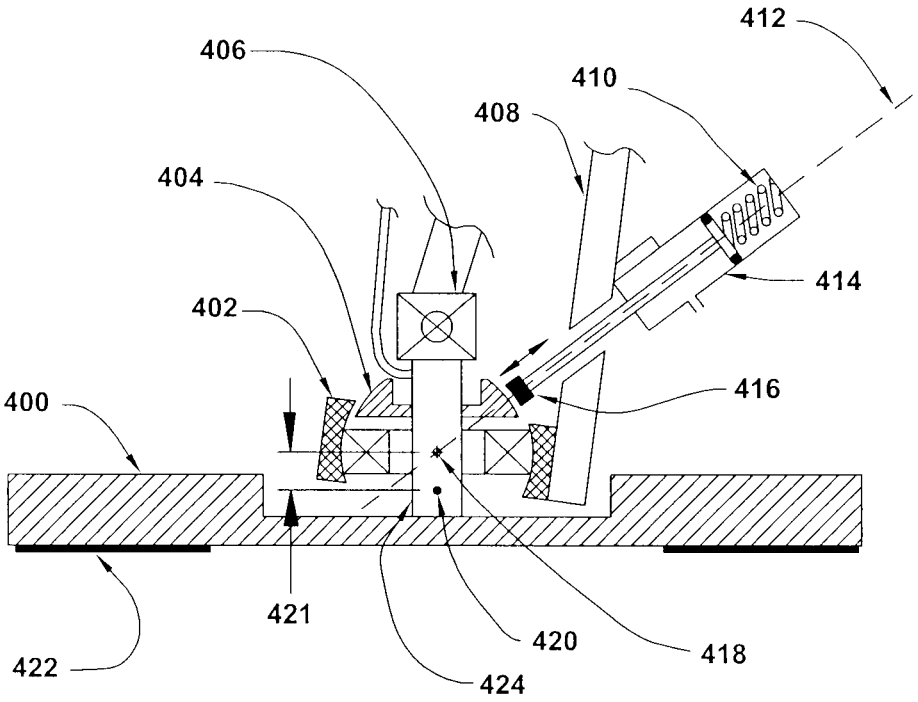
FIG. 12 is a cross section view of a floating-platen with a mechanical spherical brake.

FIG. 12 is a cross section view of a pivot-balance floating-platen lapper machine having a mechanical friction spherical brake where the center of gravity of the rotating platen is off-set from the center of spherical rotation of the platen spherical rotation device. The abrading platen 400 has an attached flexible abrasive disk 422 where the abrading platen 400 has a mass center 420 that has an off-set distance 421 that is less than 3 inches (7.6 cm) or preferred to be less than 2 inches (5 cm) and more preferred to be less than 1 inch (2.5 cm) and most preferred to be less than 0.5 inches (1.3 cm) and most highly preferred to be less than 0.25 inches (0.64 cm) from the center of spherical rotation 392 of the platen spherical rotation device 402.

The platen 400 has a platen rotation drive shaft 424 that is rotationally driven by a gearbox (not shown) with an universal joint 406. The platen spherical rotation bearing 402 is supported by the pivot frame 408. The pivot frame 408 also supports a return-spring air cylinder drive device 414 that has a return spring 410 that forces a spherical-surfaced brake pad 416 against a spherical-surfaced rotor 404 that is attached to the platen 400 drive shaft 424 where the brake pad 416 translated linearly along a axis 412 that intersects the center of spherical rotation 392 of the platen spherical rotation device 402.

Platen Reinforcing Support Ribs

To provide extra rigidity to the platen annular body, platen support ribs can be attached to the platen where the ribs extend to the annular center of the platen. Here, abrading forces that are applied by the pivot frame that supports the rotatable platen are transferred to the hub that surrounds the platen drive shaft. Portions of the applied abrading forces are then transferred to the center of the platen annular body by the very stiff platen support ribs. Without the platen support ribs, the applied abrading forces are transferred through the thickness of the platen body. The platen support ribs minimize the out-of-plane distortion of the platen annular abrading surface.

It is critical that the applied abrading forces do not distort the platen annular body where the flatness variation of the platen abrading surface exceeds 0.0001 inches (3 microns) to successfully accomplish flat lapping of workpieces. The abrading forces are applied through the pivot frame that holds the stationary part of the spherical roller bearing. These abrading forces are typically just a fraction of the weight of the platen assembly. However, if the abrading forces do exceed the weight of the platen these abrading forces are transferred through the spherical roller bearing device.

Internal platen support ribs can be attached to the platen where these radial ribs extend from the drive shaft hub to the annular center of the platen. These ribs typically are equal in number to the external platen stiffening ribs and are attached to the platen at the same tangential locations as the internal platen stiffening ribs. Here, the adhesively attached platen support ribs and the respective radial platen stiffening ribs form continuous beam structures that are exceedingly stiff. Collectively, these radial rib structures, which are evenly distributed around the annular platen, can transfer large abrading forces without distorting the precision-flat platen abrading surface.

Here, abrading forces that are applied by the pivot frame that supports the rotatable platen are transferred to the hub that surrounds the platen drive shaft. Portions of the applied abrading forces are then transferred to the center of the platen annular body by the very stiff platen support ribs. Without the platen support ribs, the applied abrading forces are transferred only through the thickness of the platen body. Use of non-rib platen annular bodies that have very thick cross-sections can also provide a radial stiffness equal to a platen having the external platen support ribs.

Figure 13:
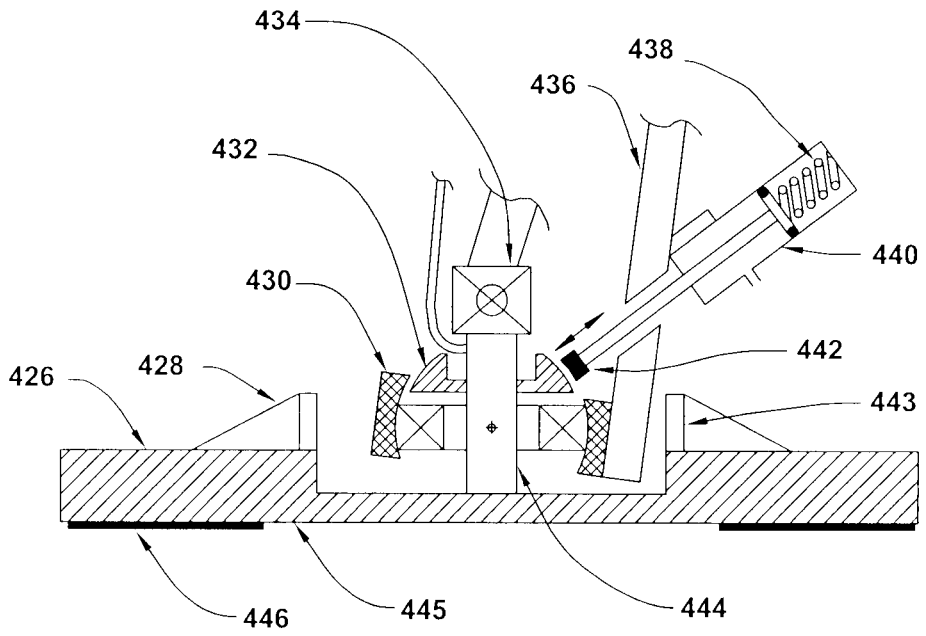
FIG. 13 is a cross section view of a floating-platen having structural support ribs.

FIG. 13 is a cross section view of a floating-platen having structural support ribs. The abrading platen 426 has an attached flexible abrasive disk 446 that is attached with vacuum to the flat annular surface 445 of the platen 426. The platen 426 has a platen rotation drive shaft 444 that is rotationally driven by a gearbox (not shown) with an universal joint 434. The platen spherical rotation bearing 430 is supported by the pivot frame 436. The pivot frame 436 also supports a return-spring air cylinder drive device 440 that has a return spring 438 that forces a spherical-surfaced brake pad 442 against a spherical-surfaced rotor 432 that is attached to the platen 426 drive shaft 444.

The platen 426 has reinforcing radial ribs 428 that extend out radially from an annular platen 426 hub 443 where the reinforcing radial ribs 428 are positioned around the circumference of the platen 426. Abrading forces are applied by the platen spherical rotation bearing 430 and are transferred to the platen 426 annular hub 443 where the abrading forces are then transferred to the center of the platen 426 annular abrading area 445 by the reinforcing radial ribs 428. Use of the reinforcing radial ribs 428 minimizes the distortion of the platen 426 body by the abrading forces where the precision-flat annular bottom abrading surface 445 of the platen 426 remains precisely flat. The precision-flat annular bottom abrading surface 445 of the platen 426 remains flat so that the abrasive surface of the abrasive disk 446 is held in flat-surfaced abrading contact with workpieces (not shown).

Platen Surface Wear Resistant Coating

To provide a wear resistant coating on the abrasive disk side of the platen, a cast aluminum annular bottom plate can be provided with a "hard coat" anodized surface. A 0.003 inches (76 micron) thick coating can be formed on the platen surface. This aluminum oxide coating is extremely hard and wear resistant. Many precision products such as air bearing spindles are fabricated from aluminum and where components are anodized to create a hard surface that can be ground to provide precisely-flat surfaces.

A distinct advantage is that the anodized coating is an integral part of the dimensionally stable cast aluminum platen components. Because the anodized coating is so thin compared to the platen annular bottom plate, the anodized coating does not distort the platen precision-flat abrading surface when the platen is subjected to temperature changes. In addition, sapphire (aluminum oxide) hollow orifice inserts can be positioned in the platen annular bottom plate to provide wear resistant vacuum port holes. These orifice inserts act as vacuum passageways to tangential grooves cut in the platen abrading surface that allow abrasive disks to be attached to the platen.

Another method of providing the platen abrading surface with a wear resistant coating is to attach aluminum oxide beads to the platen surface with a structural adhesive. These equal-sized aluminum oxide beads are very hard and wear resistant. They can be applied to platens constructed from a wide variety of materials including aluminum and cast iron. Aluminum platens are desirable because they are lightweight, are structurally stiff, and provide low mass inertia that minimize the torsional platen drive forces that accelerate and decelerate the high speed rotation of the platens. The beads can be solid aluminum oxide and they can be vitrified aluminum oxide if desired. Beads can also be filled with other abrasive particles such as diamond or CBN. The bead adhesive can also be filled with abrasive particles such as aluminum oxide or diamond to increase its resistance to abrading. After the beads are attached to the platen, the coated-bead common exposed surface is ground precisely flat. Worn beads are easy to remove from the platen surfaces and can be replaced by coating-on a new layer of beads.

A distinct advantage is that the bead coating is that it becomes an integral part of the dimensionally stable cast aluminum platen components. Because the individual beads are so small, as compared to the platen annular bottom plate, the distributed bead coating does not distort the platen precision-flat abrading surface when the platen is subjected to temperature changes.

In addition, sapphire (aluminum oxide) hollow orifice inserts can be positioned in the platen annular bottom plate to provide wear resistant vacuum port holes. These orifice inserts act as vacuum passageways to tangential grooves cut in the platen abrading surface that allow abrasive disks to be attached to the platen. Abrasive debris that is captured by the abrasive disk vacuum attachment system can abrade and enlarge the individual platen vacuum port holes. Use of the extremely hard sapphire inserts having a hardness of 9 mhos (where diamond has a hardness of 10 mhos) provides assurance that the wear of the vacuum port holes is minimized.

The tangential grooves cut in the platen abrading surface to act as vacuum passageways for the vacuum attachment of the flexible abrasive disks intersect the vacuum port holes that extend into the platen surface to intersect radial and tangential vacuum passageways that are located internal to the platen body. The typical size of the hard aluminum oxide beads that are coated on a platen surface can range from less than 0.005 inches (0.127 mm) to more than 0.010 inches (0.254 mm). The surface of a platen can be re-ground repetitively before the beads have to be replaced. The flatness of the ground surface of the bead coated platen surface typically has a variation of less than 0.0001 inches (3 microns). Both the upper and lower surfaces of the platen can be coated with beads and ground flat.

The tangential vacuum grooves in the bead coated surface have a depth that is less than the diameter of the beads, when the platen is first fabricated. The typical groove width can range from 0.002 inches (0.051 mm) to 0.060 inches (1.52 mm) or the groove width can be optimized as desired and the grooves can be ground into individual beads. Vacuum grooves can be re-ground when the platen abrading surface is re-ground.

Figure 14:
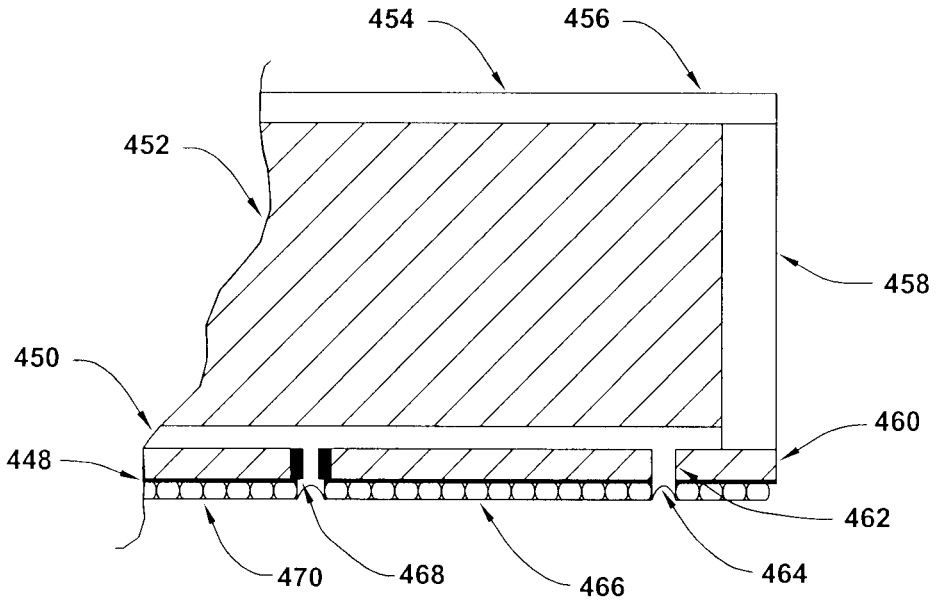
FIG. 14 is a cross section view of a platen having an external wear-resistant surface coating.

FIG. 14 is a cross section view of a floating-platen having an external wear-resistant surface coating. The abrading platen 454 has a top annular surface plate 456, an outer periphery annular wall 458 and an internal radial reinforcing rib 452. The internal radial reinforcing rib 452 has a vacuum passageway 450 that is cut into the bottom of the radial rib 452 where the vacuum passageway 450 extends along the length of the rib 452. The vacuum passageway 450 intersects platen 454 vacuum port holes 462 that extend to tangential vacuum grooves 464 and where the tangential vacuum grooves 464 extend around the circumference of the platen annular abrading surface 466. The vacuum port holes 462 can have sapphire or hardened through-hole inserts 468 that are constructed from aluminum oxide or hardened metals.

The platen 454 has a bottom annular plate 460 that is coated with a layer of adhesive 448 where spherical hard-material beads or particles 470 are bonded to the platen 454 bottom plate 460 by the adhesive 448. The hard material beads or particles 470 can be made from materials selected from the group of ceramics, aluminum oxide, diamond, cubic boron nitride (CBN) and metals. A size coating of adhesive or particle-filled adhesive can be applied to the exposed surface of the spherical hard-material beads or particles 470 to fill the gaps between individual spherical hard-material beads or particles 470. When the adhesive 448 is fully solidified, the exposed surface of the spherical hard-material beads or particles 470 can be ground to form a precision-flat platen 454 annular abrading surface 466.

Rigid Platen External Annular Support Rib

FIG. 14.1 is a cross section view of a floating-platen having an external annular support rib. Using external annular support ribs that are integrally attached to the top surface of the annular platen provides very substantial circumferential rigidity to the platen and provides uniform distribution of the applied abrading forces across the radial width of the annular abrading platen. Also, the associated plated rotary platen drive hub is also very stiff structurally. Multiple platen attachment devices that are simple to use are evenly distributed around the circumference of the platen. This particular platen attachment structure design provides a maximum of structural stiffness with a minimum of structure weight and rotational mass inertia. This allows the transmission of large torque forces that can quickly accelerate and decelerate the platens to and from their high rotational speeds. Providing quick platen speed-ups and platen braking times decreases the process time for high speed flat lapping of workpieces. In addition, a flexible bellows-type device (not shown) can be used to provide a seal for the platen 38*a* device where abrasive debris generated by the abrasive lapping process does not contaminate the components of platen 38*a* lapping device. This platen 38*a* system is well suited for use in a harsh abrading environment.

The annular abrading platen 38*a* has an attached flexible abrasive disk 36*a* that is attached with vacuum to the flat annular surface 35*a* of the annular platen 38*a*. The annular platen 38*a* has a platen rotation drive shaft 30*a* that is rotationally driven by a gearbox (not shown) using an universal joint 20*a*. The annular platen 38*a* also has a platen circular drive base plate 32*a* that is attached to the platen rotation drive shaft 30*a*. The annular platen 38*a* platen circular base plate 32*a* is also attached to a platen rotational drive annular hub 29*a* that is attached to an annular platen support plate 14*a* that is attached to an annular platen 38*a* annular reinforcing rib 10*a* by use of fastener-devices 12*a*.

The annular platen 38*a* annular reinforcing rib 10*a* provides substantial circumferential rigidity to the annular platen 38*a* which provides assurance that the abrading forces that are applied by the platen drive shaft 30*a* are uniformly distributed around the circumference of the annular platen 38*a*. Also, the annular platen 38*a* annular reinforcing rib 10*a* has a triangular cross-section shape that is positioned in the radial center of the annular platen 38*a* to provide that the applied abrading forces are uniformly distributed across the radial width of the annular platen 38*a*. The annular platen 38*a* annular platen support structure 10*a* is attached to the top flat surface of the annular platen 38*a* where the annular platen support structure 10*a* extends around the circumference of the platen 38*a*. A platen 38*a* cover plate 34*a* provides flat-surfaced support for the central area of the flexible abrasive disks 36*a* that are attached to the platen 38*a*.

The platen spherical rotation bearing 16*a* is supported by the pivot frame 22*a*. The pivot frame 22*a* also supports a return-spring air cylinder drive device 26*a* that has a return spring 24*a* that forces a spherical-surfaced brake pad 28*a* against a spherical-surfaced rotor 18*a* that is attached to the platen 38*a* drive shaft 30*a*.

Abrading forces are applied by the platen spherical rotation bearing 16*a* and are transferred to the platen 38*a* annular hub 29*a* where the abrading forces are then transferred to the center of the platen 38*a* annular abrading area 35*a* by the annular reinforcing rib 10*a*. Use of the annular reinforcing rib 10*a* minimizes the distortion of the platen 38*a* body by the abrading forces where the precision-flat annular bottom abrading surface 35*a* of the platen 38*a* remains precisely flat. The precision-flat annular bottom abrading surface 35*a* of the platen 38*a* remains flat so that the abrasive surface of the abrasive disk 36*a* is held in flat-surfaced abrading contact with workpieces (not shown).

FIG. 14.2 is a top view of a floating-platen having an external annular support rib. A rotary platen 42*a* is driven in a rotational direction by a drive shaft 48*a* that is attached to a platen 42*a* platen circular base plate 46*a*. The platen circular base plate 46*a* is also attached to a platen rotational drive annular hub (not shown) that is attached to an annular platen support plate 40*a*. The annular platen support plate 40*a* is attached to an annular platen 42*a* annular reinforcing rib 50*a* by use of fastener-devices 44*a*.

Air Bearing Pivot Frame Cylinder

It is important that the air cylinder that applies abrading forces to the platen is friction free to avoid creating unwanted friction force effects that generate errors in the selected abrading forces. One technique to do this is to use a friction-free air bearing air cylinder. Here, an air bearing cylinder has shaft air bearings to eliminate any friction drag on the cylinder shaft as it moves. Also, in this device, the pressurized air that is supplied to the cylinder shaft air bearing located within the body of the air cylinder has an air barrier. This is done to minimize the entrance of pressurized air bearing air into the air cylinder chamber located at the free end of the cylinder shaft contained within the cylinder.

Air pressure applied to this lower chamber sets the force that is generated by the air cylinder. The upper end of the air bearing cylinder is vented to allow free passage of the upper air bearing exit air to the ambient. The force produced by the air bearing cylinder increases with a size increase of the cylinder. A pleated flexible cover can be attached to the shaft end of the cylinder to prevent contamination of the external end shaft air bearing. These air bearing cylinders are very robust, durable and well suited for harsh abrading environments.

The exact forces that are generated by the air cylinders can be very accurately determined with load cell force sensors. The output of these load cells can be used by feedback controller devices to dynamically adjust the abrading forces on the platen abrasive throughout the lapping procedure. This abrading force control system can even be programmed to automatically change the applied-force cylinder forces to compensate for the very small weight loss experienced by an abrasive disk during a specific lapping operation. Also, the weight variation of "new" abrasive disks that are attached to a platen to provide different sized abrasive particles can be predetermined. Then the abrading force control system can be used to compensate for this abrasive disk weight change from the previous abrasive disk and provide the exact desired abrading force on the platen abrasive.

The abrading force feedback controller provides an electrical current input to an air pressure regulator referred to as an I/P (current to pressure) controller. The abrading force controller has the capability to change the pressures that are independently supplied to each of the parallel abrading force air cylinders. The actual force produced by each independently controlled air cylinder is determined by a respected force sensor load cell to close the feedback loop.

Figure 15:
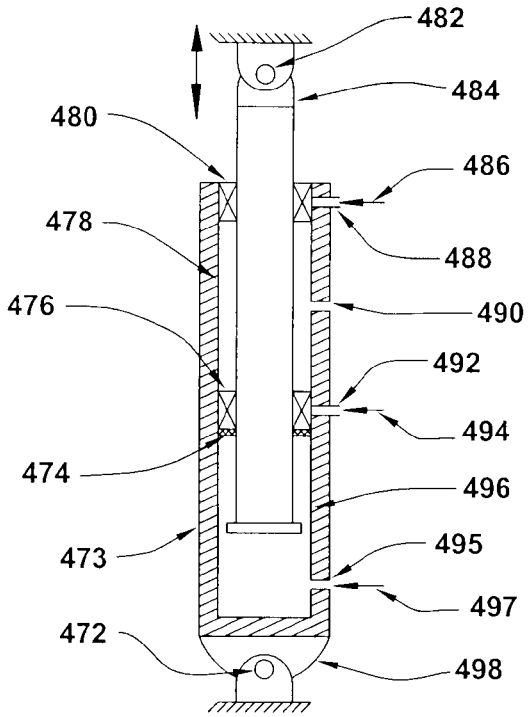
FIG. 15 is a cross section view of an air bearing air cylinder.

FIG. 15 is a cross section view of an air bearing air cylinder. The air bearing air cylinder 473 provides frictionless linear motion of a cylinder rod 484 that has a pivot pin 482 connection to an apparatus. The cylinder rod 484 is guided by frictionless air bearings 480 and 476 where exhaust air from the air bearing 476 is blocked by an air bearing seal 474 that minimizes the amount of pressurized air 494 that is applied to the air bearing 473 port 492 to supply air to the air bearing 476 from leaking into the lower cylinder 473 internal chamber 496. Excess pressurized air 486 that is applied at the cylinder 473 port hole 488 supplies pressurized air 486 to the rod air bearing 480 where some of the air 486 leaks into the cylinder 473 rod end internal chamber 478. Excess pressurized air 486 can be exhausted from the cylinder 473 rod end internal chamber 478 through the cylinder 473 vent hole 490. Controlled pressure air 497 is supplied to the cylinder 473 port 495 where this pressurized air 497 originates the cylinder 473 force that is applied to the cylinder rod 484 and the cylinder 473 force ii proportional to the cross section area of the cylinder rod 484. The mounting end 498 of the cylinder 473 has a pivot pin 472. These air bearing air cylinders 473 are very robust and are well suited for use in a harsh abrading environment.

Hydraulic Locking Cylinder

When the pivot frame is raised by the electric actuator or by hydraulic cylinders, the floating platen can also be tilted by rotation of the pivot frame about the pivot frame rotation axis. Once the pivot frame is tilted, the frame can be locked in that tilted position with the use of a frame position hydraulic locking device. This hydraulic locking device allows hydraulic fluid to pass from one chamber of a linear piston-type cylinder to another chamber through by-pass tubing. By shutting a by-pass valve, hydraulic fluid can not pass from one chamber to another and the cylinder shaft is locked in position. During a lapping operation, the hydraulic locking device is deactivated to allow friction-free rotational motion of the pivot frame.

A manually adjusted metering valve can also be located in the hydraulic by-pass line to restrict the flow of the hydraulic fluid in the by-pass line. Restriction of the by-pass hydraulic fluid provides hydraulic damping which attenuates any vibration that is induced in the lapping machine system by platen abrading action. Here, positional excursions from the vibrations move the cylinder piston with periodic oscillations which oscillates hydraulic fluid in the by-pass tubing. As the oscillating fluid travels past the restrictor valve, this fluid is sheared and creates fluid forces that oppose the induced mechanical vibrations. If desired, the platen can be rotated at very low speeds while the frame is tilted.

Figure 16:
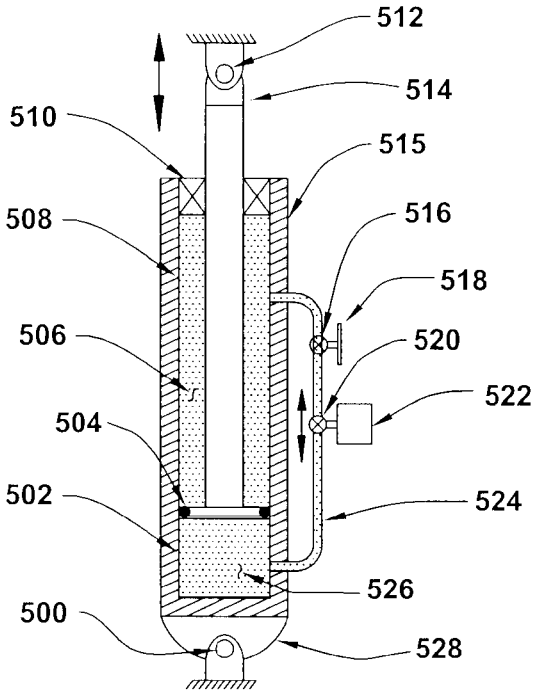
FIG. 16 is a cross section view of hydraulic cylinder pivot frame locking device.

FIG. 16 is a cross section view of hydraulic cylinder pivot frame locking and vibration damping device. The hydraulic cylinder 515 provides linear motion of a cylinder rod 514 that has a pivot pin 512 connection to an apparatus and a cylinder 515 cylinder mounting end 528 that has a pivot pin 500 connection to a mounting apparatus. The cylinder rod 514 is guided by a rod end bearing 510 and a moving rod piston 504 that is sealed against the inside cylindrical surface of the hydraulic cylinder 515. The cylinder 515 has a cylinder rod 514 end internal hydraulic chamber 508 and also has a mounting end 528 internal hydraulic chamber 502 and a by-pass tube 524. The by-pass tube 524 allows passage of non-air entrained hydraulic fluid that is present in the internal mounting end 528 internal hydraulic chamber 502 and the cylinder rod 514 end internal hydraulic chamber 508 and in the by-pass tube 524.

The by-pass tube 524 has a metering valve 516 that can be operated by a manual handle 518 or by an actuator screw device (not shown) to adjust a flow restrictor orifice that is an integral part of the restrictor metering valve 516. The by-pass tube 524 also has a shut-off valve 520 that can be operated manually or operated by a solenoid operator device 522 where flow of the incompressible hydraulic fluid in the by-pass tube 524 can be stopped. When this by-pass tube 524 hydraulic flow is stopped, the hydraulic cylinder 515 piston 504 is stopped and motion of the cylinder rod 514 is stopped because hydraulic fluid can not flow between the internal mounting end 528 internal hydraulic chamber 502 and the cylinder rod 514 end internal hydraulic chamber 508. Stopping the motion of the cylinder rod 514 prevents the pivot frame (not shown) that is attached to the cylinder rod 514 from rotating.

The pivot frame hydraulic cylinder can also be used to limit the rotational speed of the pivot frame and to attenuate vibrations of the pivot frame by controlling the flow of the hydraulic fluid that flows between the internal mounting end 528 internal hydraulic chamber 502 and the cylinder rod 514 end internal hydraulic chamber 508 as the moving cylinder rod 514 is translated relative to the external surface of the hydraulic cylinder body 515. Here, when the hydraulic metering valve 516 hydraulic flow orifice is adjusted to be partially closed, a hydraulic damping force is generated by restricting the flow of the hydraulic fluid as it passes between the cylinder rod 514 end internal hydraulic chamber 508 and the cylinder mounting base mounting end 528 end internal hydraulic chamber 502 as the moving cylinder rod 514 and the cylinder piston 504 that is attached to the cylinder rod 514 is translated relative to the external surface of the cylinder 515.

When the respective hydraulic damping force is applied to the cylinder piston 504 in a direction that opposes the movement direction of the cylinder rod 514 that is moved by the rotation motion of the pivot frame wherein the rotation motion of the pivot frame is slowed by the respective hydraulic damping force. Also, rotation oscillations of the pivot frame are resisted by hydraulic damping forces that are applied to the cylinder piston 504 in directions that oppose the oscillating movement of the cylinder rod 514 that is moved by the oscillating rotation motion of the pivot frame. Further, the rotation motion of the pivot frame is slowed by the respective hydraulic damping forces. Metering the flow of the hydraulic fluid in the by-pass tube 524 effectively attenuates vibrations and reduces oscillations of the pivot frame.

Fixed-Spindles Floating-Platen

Figure 17:
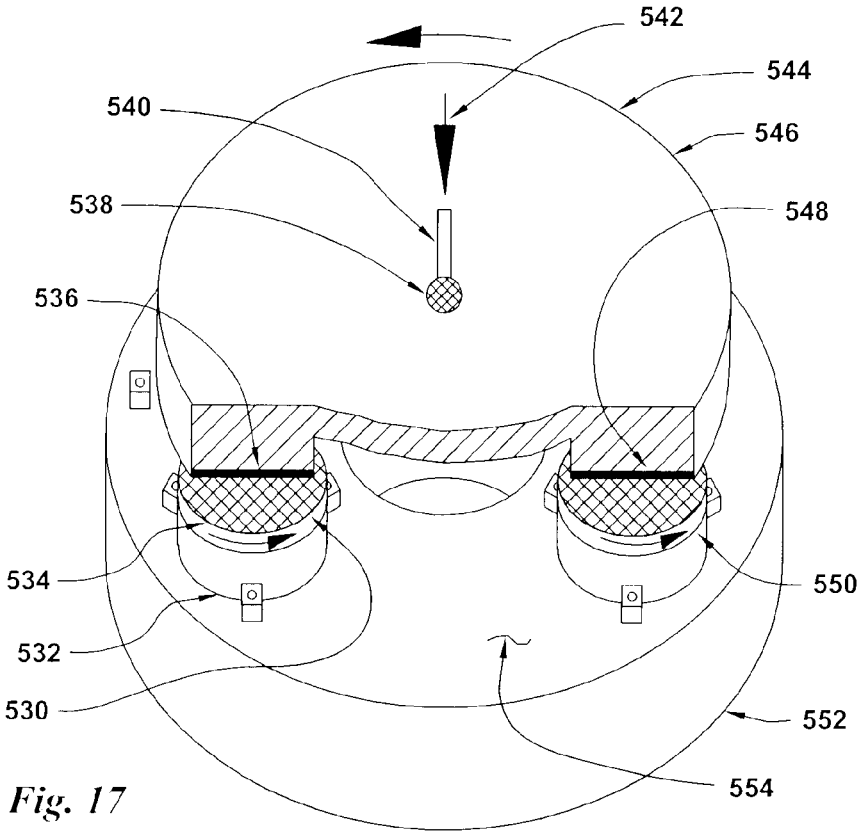
FIG. 17 is an isometric view of a floating platen abrading system with three spindles.

FIG. 17 is an isometric view of an abrading system 45 having three-point fixed-position rotating workpiece spindles supporting a floating rotating abrasive platen. Three evenly-spaced rotatable spindles 532 (one not shown) having rotating tops 550 that have attached workpieces 534 support a floating abrasive platen 544. The platen 544 has a vacuum, or other, abrasive disk attachment device (not shown) that is used to attach an annular abrasive disk 548 to the precision-flat platen 544 abrasive-disk mounting surface 536. The abrasive disk 548 is in flat abrasive surface contact with all three of the workpieces 534. The rotating floating platen 544 is driven through a spherical-action universal-joint type of device 538 having a platen drive shaft 540 to which is applied an abrasive contact force 542 to control the abrading pressure applied to the workpieces 534. The workpiece rotary spindles 532 are mounted on a granite, or other material, base 552 that has a flat surface 554. The three workpiece spindles 532 have spindle top surfaces that are co-planar. The workpiece spindles 532 can be interchanged or a new workpiece spindle 532 can be changed with an existing spindle 532 where the flat top surfaces of the spindles 532 are co-planar. Here, the equal-thickness workpieces 534 are in the same plane and are abraded uniformly across each individual workpiece 534 surface by the platen 544 precision-flat planar abrasive disk 548 abrading surface. The planar abrading surface 536 of the floating platen 544 is approximately co-planar with the flat surface 554 of the granite base 552.

The spindle 532 rotating surfaces spindle tops 550 can driven by different techniques comprising spindle 532 internal spindle shafts (not shown), external spindle 532 flexible drive belts (not shown) and spindle 532 internal drive motors (not shown). The individual spindle 532 spindle tops 550 can be driven independently in both rotation directions and at a wide range of rotation speeds including very high speeds of 10,000 surface feet per minute (3,048 meters per minute). Typically the spindles 532 are air bearing spindles that are very stiff to maintain high rigidity against abrading forces and they have very low friction and can operate at very high rotational speeds. Suitable roller bearing spindles can also be used in place of air bearing spindles.

Abrasive disks (not shown) can be attached to the spindle 532 spindle tops 550 to abrade the platen 544 annular flat surface 536 by rotating the spindle tops 550 while the platen 544 flat surface 536 is positioned in abrading contact with the spindle abrasive disks that are rotated in selected directions and at selected rotational speeds when the platen 544 is rotated at selected speeds and selected rotation direction when applying a controlled abrading force 542. The top surfaces 530 of the individual three-point spindle 532 rotating spindle tops 550 can be also be abraded by the platen 544 planar abrasive disk 548 by placing the platen 544 and the abrasive disk 548 in flat conformal contact with the top surfaces 530 of the workpiece spindles 532 as both the platen 544 and the spindle tops 550 are rotated in selected directions when an abrading pressure force 542 is applied. The top surfaces 530 of the spindles 532 abraded by the platen 544 results in all of the spindle 532 top surfaces 530 being in a common plane.

The granite base 552 is known to provide a time-stable precision-flat surface 554 to which the precision-flat three-point spindles 532 can be mounted. One unique capability provided by this abrading system 546 is that the primary datum-reference can be the fixed-position granite base 552 flat surface 554. Here, spindles 532 can all have the precisely equal heights where they are mounted on a precision-flat surface 554 of a granite base 552 where the flat surfaces 530 of the spindle tops 550 are co-planar with each other.

When the abrading system is initially assembled it can provide extremely flat abrading workpiece 534 spindle 532 top 550 mounting surfaces and extremely flat platen 544 abrading surfaces 536. The extreme flatness accuracy of the abrading system 546 provides the capability of abrading ultra-thin and large-diameter and high-value workpieces 534, such as semiconductor wafers, at very high abrading speeds with a fully automated workpiece 534 robotic device (not shown).

In addition, the system 546 can provide unprecedented system 546 component flatness and workpiece abrading accuracy by using the system 546 components to "abrasively dress" other of these same-machine system 546 critical components such as the spindle tops 550 and the platen 544 planar-surface 536. These spindle top 550 and the platen 544 annular planar surface 536 component dressing actions can be alternatively repeated on each other to progressively bring the system 546 critical components comprising the spindle tops 550 and the platen 544 planar-surface 536 into a higher state of operational flatness perfection than existed when the system 546 was initially assembled. This system 546 self-dressing process is simple, easy to do and can be done as often as desired to reestablish the precision flatness of the system 546 component or to improve their flatness for specific abrading operations.

This single-sided abrading system 546 self-enhancement surface-flattening process is unique among conventional floating-platen abrasive systems. Other abrading systems use floating platens but these systems are typically double-sided abrading systems. These other systems comprise slurry lapping and micro-grinding (flat-honing) systems that have rigid bearing-supported rotated lower abrasive coated platens. They also have equal-thickness flat-surfaced workpieces in flat contact with the annular abrasive surfaces of the lower platens. The floating upper platen annular abrasive surface is in abrading contact with these multiple workpieces where these multiple workpieces support the upper floating platen as it is rotated. The result is that the floating platens of these other floating platen systems are supported by a single-item moving-reference device, the rotating lower platen.

Large diameter rotating lower platens that are typically used for double-sided slurry lapping and micro-grinding (flat-honing) often have substantial abrasive-surface out-of-plane variations. These undesired abrading surface variations are due to many causes comprising: relatively compliant (non-stiff) platen support bearings that transmit or magnify bearing dimension variations to the outboard tangential abrading surfaces of the lower platen abrasive surface; radial and tangential out-of-plane variations in the large platen surface; time-dependent platen material creep distortions; abrading machine operating-temperature variations that result in expansion or shrinkage distortion of the lower platen surface; and the constant wear-down of the lower platen abrading surface by abrading contact with the workpieces that are in moving abrading contact with the lower platen abrasive surface. The single-sided abrading system 546 is completely different than the double-sided system (not-shown).

The floating platen 544 system 546 performance is based on supporting a floating abrasive platen 544 on the top surfaces 530 of three-point spaced fixed-position rotary workpiece spindles 532 that are mounted on a stable machine base 552 flat surface 554 where the top surfaces 530 of the spindles 532 are precisely located in a common plane. The top surfaces 530 of the spindles 532 can be approximately or substantially co-planar with the precision-flat surface 554 of a rigid fixed-position granite, or other material, base 552 or the top surfaces 530 of the spindles 532 can be precisely co-planar with the precision-flat surface 554 of a rigid fixed-position granite, or other material, base 552. The three-point support is required to provide a stable support for the floating platen 544 as rigid components, in general, only contact each other at three points. As an option, additional spindles 532 can be added to the system 546 by attaching them to the granite base 552 at locations between the original three spindles 532.

Figure 18:
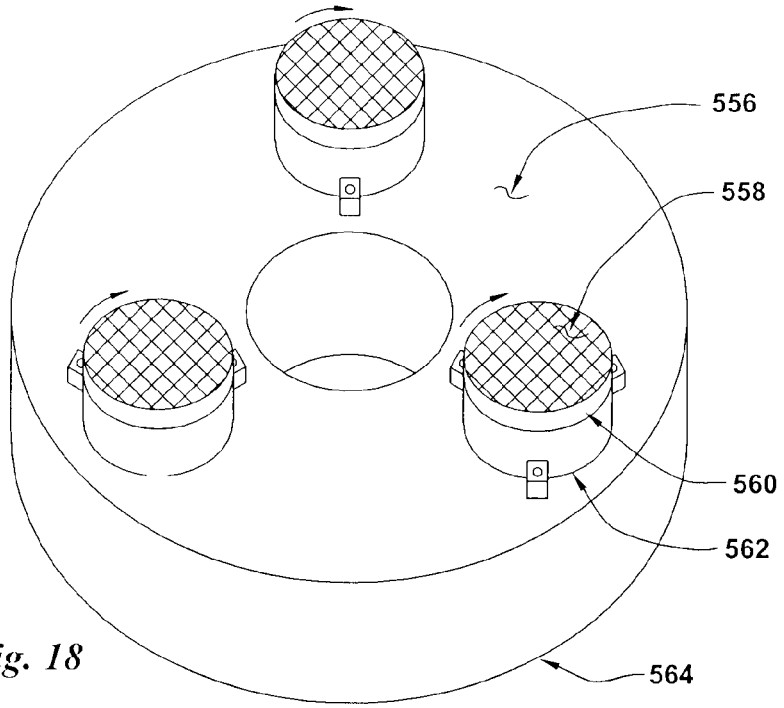
FIG. 18 is an isometric view of three fixed-position spindles mounted on a granite base.

This three-point workpiece spindle abrading system 546 can also be used for abrasive slurry lapping (not shown), for micro-grinding (flat-honing) (not shown) and also for chemical mechanical planarization (CMP) (not shown) abrading to provide ultra-flat abraded workpieces 534. FIG. 18 is an isometric view of three-point fixed-position spindles mounted on a granite base. A granite base 564 has a precision-flat top surface 556 that supports three attached workpiece spindles 562 that have rotatable driven tops 560 where flat-surfaced workpieces 558 are attached to the flat-surfaced spindle tops 560.

Figure 19:
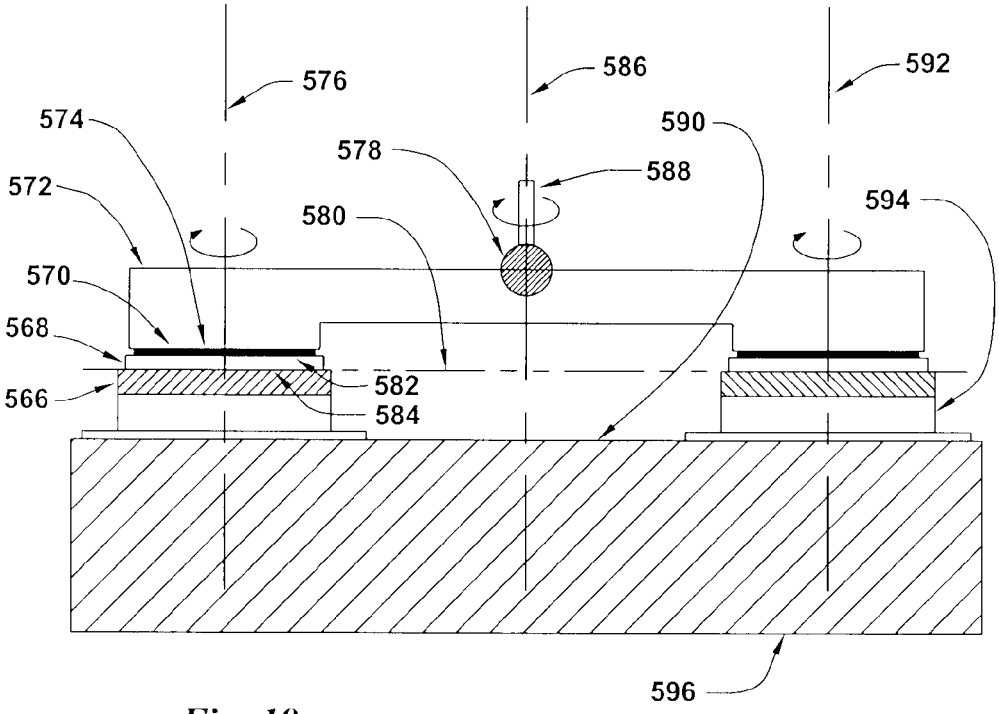
FIG. 19 is an isometric view of three-point workpiece spindles mounted on a granite base.

FIG. 19 is a cross section view of three-point fixed-position spindles supporting a rotating floating abrasive platen. A floating circular platen 572 has a spherical-action rotating drive mechanism 578 having a drive shaft 588 where the platen 572 rotates about an axis 586. Three workpiece spindles 594 (one not shown) having rotatable spindle tops 566 that have flat top surfaces 584 are mounted to the top precision-flat surface 590 of a machine base 596 that is constructed from granite, metal or composite or other materials. The flat top surfaces of the spindle tops 566 are all in a common plane 580 where the spindle plane 580 is precisely co-planar with the top flat surface 590 of the machine base 596. Equal-thickness flat-surfaced workpieces 568 are attached to the spindle top 566 flat surfaces 584 by a vacuum, or other, disk attachment device where the top surfaces of the three workpieces 568 are mutually contacted by the abrading surface 582 of an annular abrasive disk 570 that is attached to the platen 572. The platen 572 disk attachment surface 574 is precisely flat and the precision-thickness abrasive disk 570 annular abrasive surface 582 is precisely co-planar with the platen 572 disk attachment surface 574. The annular abrasive surface 582 is precisely co-planar with the flat top surfaces of each of the three independent spindle top 566 flat surfaces 584 and also, co-planar with the spindle plane 580. The floating platen 572 is supported by the three equally-spaced spindles 594 where the flat disk attachment surface 574 of the platen 572 is co-planar with the top surface 590 of the machine base 596. The three equally-spaced spindles 594 of the three-point set of spindles 594 provide stable support to the floating platen 572. The spherical platen 572 drive mechanism 578 restrains the platen 572 in a circular platen 572 radial direction. The spindle tops 566 are driven (not shown) in either clockwise or counterclockwise directions with rotation axes 576 and 592 while the rotating platen 572 is also driven. Typically, the spindle tops 566 are driven in the same rotation direction as the platen 572. The workpiece spindle 594 tops 566 can be rotationally driven by motors (not shown) that are an integral part of the spindles 594 or the tops 566 can be driven by internal spindle shafts (not shown) that extend through the bottom mounting surface of the spindles 594 and into or through the granite machine base 596 or the spindles 594 can be driven by external drive belts (not shown).

Figure 20:
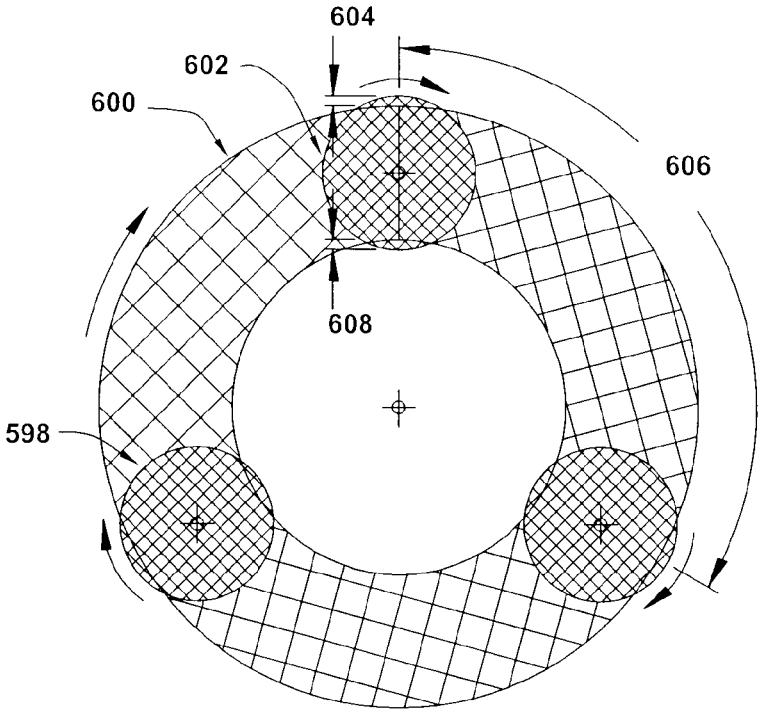
FIG. 20 is a top view of three-point fixed-spindles supporting a floating abrasive platen.

FIG. 20 is a top view of three-point fixed-spindles supporting a floating abrasive platen. Workpieces 602 are attached to three rotatable spindles 598 where the workpieces 602 are in abrading contact with an annular band of abrasive 600 where the workpieces 602 overhang the outer periphery of the abrasive 600 by a distance 604 and overhang the inner periphery of the abrasive 600 by a distance 69*f*. Each of the three spindles 598 are shown separated by an angle 606 of approximately 120 degrees to provide three-point support of the rotating platen (not shown) having an annular band of abrasive 600.

Figure 21:
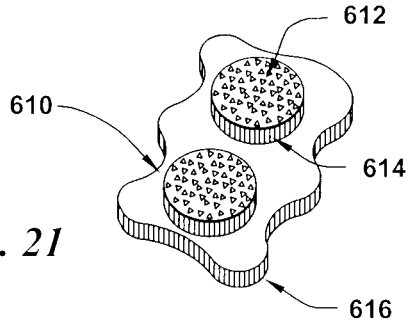
FIG. 21 is an isometric view of fixed-abrasive coated raised islands on an abrasive disk.
Figure 22:
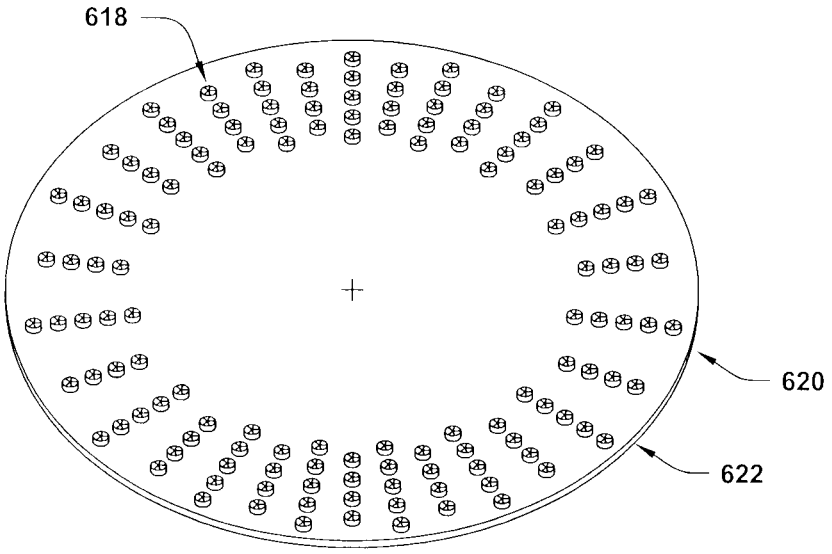
FIG. 22 is an isometric view of a flexible fixed-abrasive coated raised island abrasive disk.

FIG. 21 is an isometric view of fixed-abrasive coated raised islands on an abrasive disk. Abrasive particle 612 coated raised islands 614 are attached to an abrasive disk 610 backing 616. FIG. 22 is an isometric view of a flexible fixed-abrasive coated raised island abrasive disk. Abrasive particle coated raised islands 618 are attached to an abrasive disk 622 backing 620.

Figure 23:
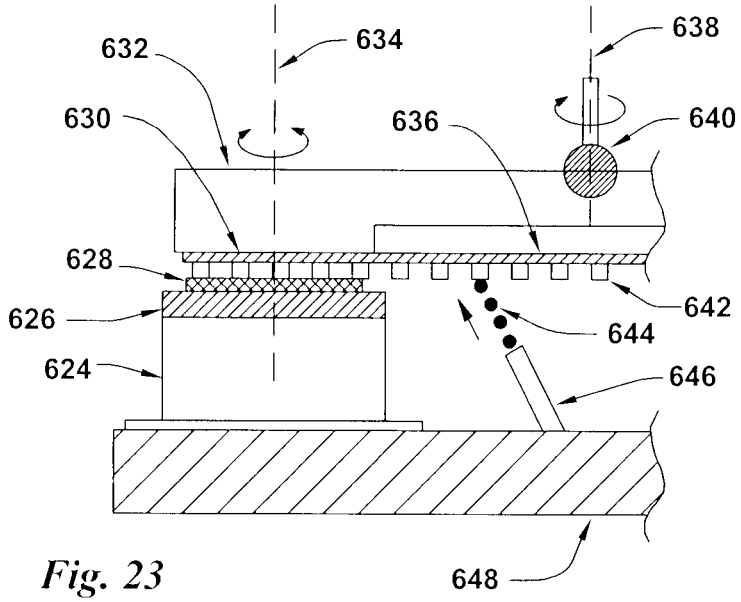
FIG. 23 is a cross section view of raised island structures on a disk with water coolant.

FIG. 23 is a cross section view of raised island structures on a disk that is used with water coolant to abrade a workpiece that is attached to a fixed-position rotary spindle. A disk 474 having attached raised island structures 642 is attached to the flat-surfaced abrading-surface 630 of a rotary platen 632 that has a spherical-action spherical device 640 that allows the platen 632 to float while the platen 632 is rotated about a platen 632 rotation axis 638. A flat-surfaced workpiece 628 is attached to the flat surface of a rotary spindle 624 rotatable spindle-top 626. The spindle 624 is attached to an abrading machine base 648 and the spindle-top 626 rotates about a spindle axis 634. A liquid jet device 646 is attached to the machine base 648 and has a liquid stream of liquid droplets 644 where the liquid 644 comprises water, a slurry liquid that contains abrasive particles, including ceria, and chemicals including abrasive action enhancing chemicals and abrading agents including those used in chemical mechanical planarization (CMP) abrading processes.

Figure 24:
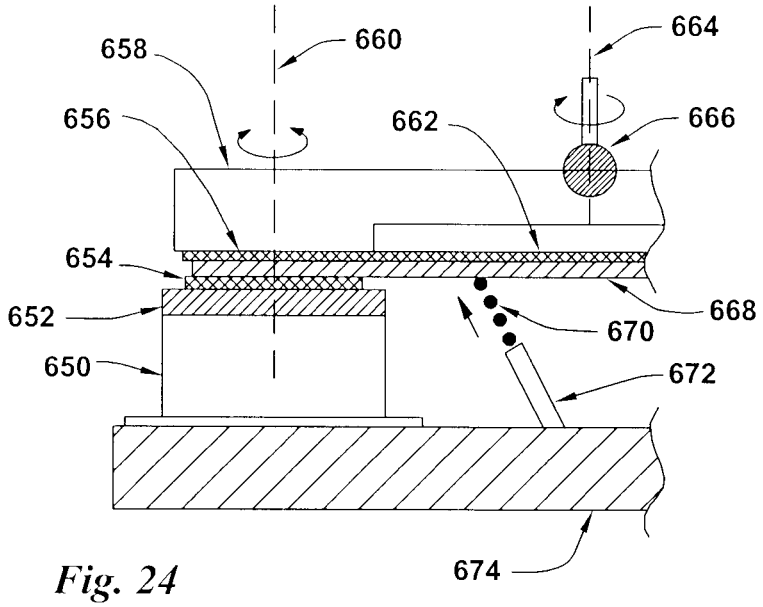
FIG. 24 is a cross section view of a porous pad on a disk that is used with an abrasive-slurry

FIG. 24 is a cross section view of a porous pad on a disk that is used with an abrasive-slurry to abrade a workpiece that is attached to a fixed-position rotary spindle. A disk 662 having an attached porous pad 668 is attached to the flat-surfaced abrading-surface 656 of a rotary platen 658 that has a spherical-action spherical device 666 that allows the platen 658 to float while the platen 658 is rotated about a platen 658 rotation axis 664. A flat-surfaced workpiece 654 is attached to the flat surface of a rotary spindle 650 rotatable spindle-top 652. The spindle 650 is attached to an abrading machine base 512 and the spindle-top 652 rotates about a spindle axis 660. A liquid jet device 672 is attached to the machine base 512 and has a liquid stream of liquid droplets 670 where the liquid 670 comprises water, a slurry liquid that contains abrasive particles, including ceria, and chemicals including abrasive action enhancing chemicals and abrading agents including those used in chemical mechanical planarization (CMP) abrading processes.

Figure 25:
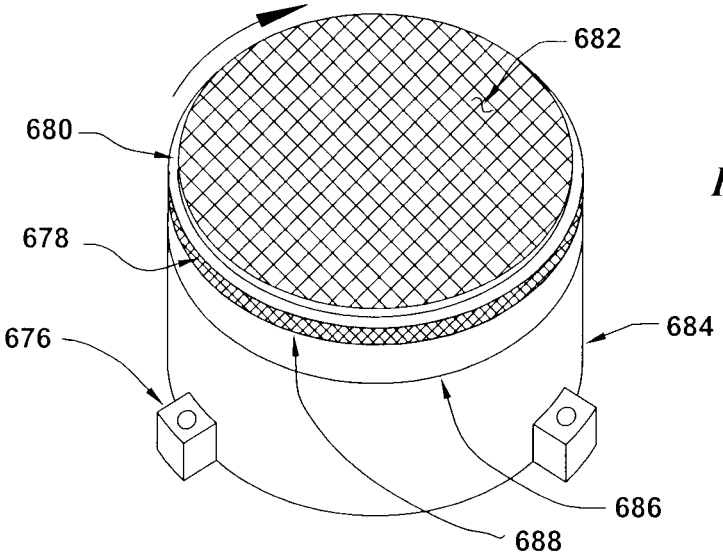
FIG. 25 is an isometric view of a workpiece spindle having three-point mounting legs.
Figure 26:
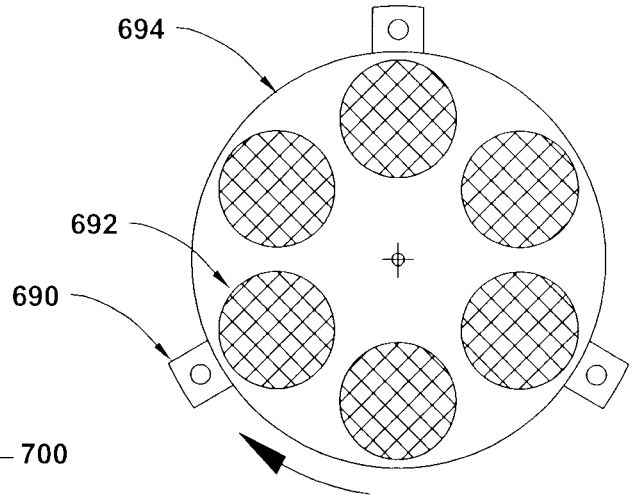
FIG. 26 is a top view of a workpiece spindle having multiple circular workpieces.
Figure 27:
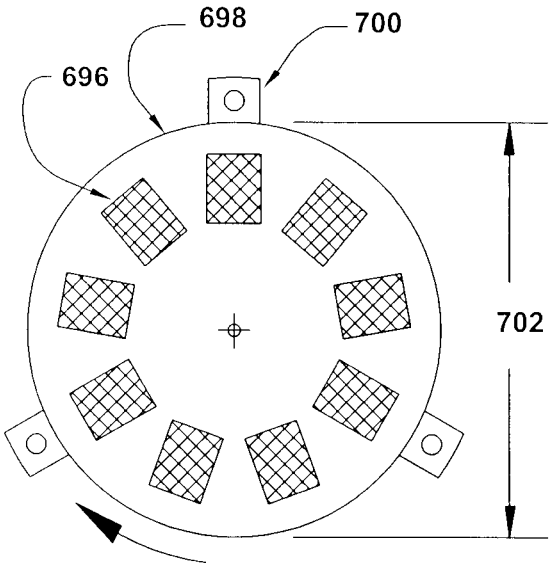
FIG. 27 is a top view of a workpiece spindle having multiple rectangular workpieces.
Figure 28:
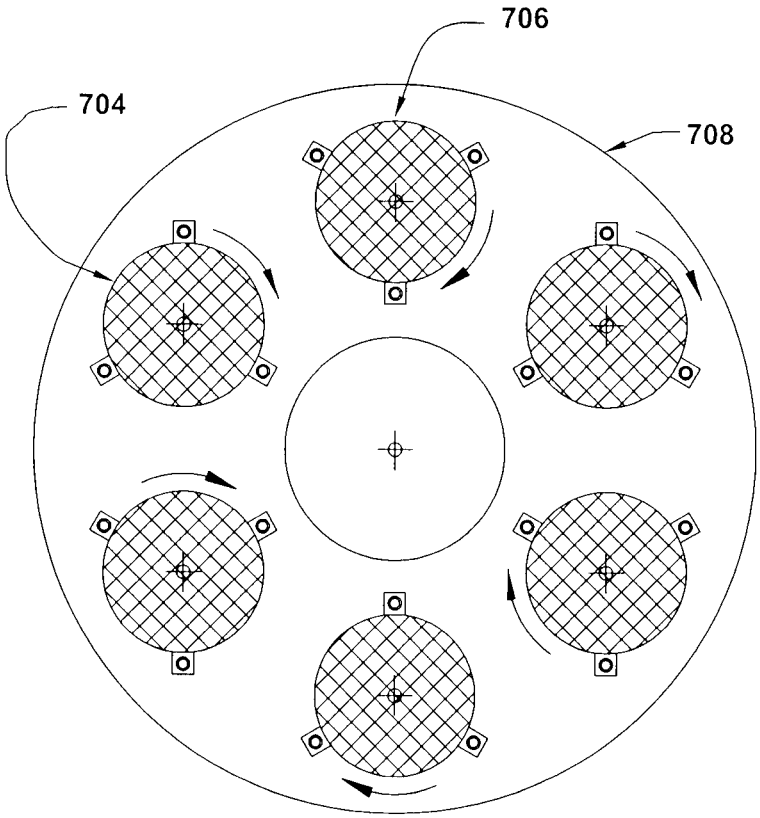
FIG. 28 is a top view of multiple fixed-spindles that support a floating abrasive platen.

FIG. 25 is an isometric view of a workpiece spindle having three-point mounting legs. The workpiece rotary spindle 684 has a rotary top 686 that has a precision-flat surface 688 to which is attached a precision-flat vacuum chuck device 678 that has co-planar opposed flat surfaces. A flat-surfaced workpiece 680 has an exposed flat surface 682 that is abraded by an abrasive coated platen (not shown). The workpiece spindle 684 is three-point supported by spindle legs 676. The workpiece 680 shown here has a diameter of almost 12 inches (300 mm) and is supported by a spindle 684 having a 12 inch (300 mm) diameter and a rotary top 686 top flat surface 688 that has a diameter of 12 inches (300 mm). FIG. 26 is a top view of a workpiece spindle having multiple circular workpieces. A workpiece rotary spindle 694 having three-point support legs 690 where the spindle 694 supports small circular flat-surfaced workpieces 692 that are abraded by an abrasive coated platen (not shown). FIG. 27 is a top view of a workpiece spindle having multiple rectangular workpieces. A workpiece rotary spindle 698 having three-point support legs 700 where the spindle 698 supports small circular flat-surfaced workpieces 696 that are abraded by an abrasive coated platen (not shown). The spindle 698 has a spindle diameter 702. FIG. 28 is a top view of multiple fixed-spindles that support a floating abrasive platen. A flat-surfaced granite base 708 supports multiple fixed-position air bearing spindles 704 that have rotating flat-surfaced tops 706. The multiple spindles 704 support a floating abrasive platen (not shown) flat abrading surface on the multiple spindle top 706 flat surfaces that are all co-planar.

Figure 29:
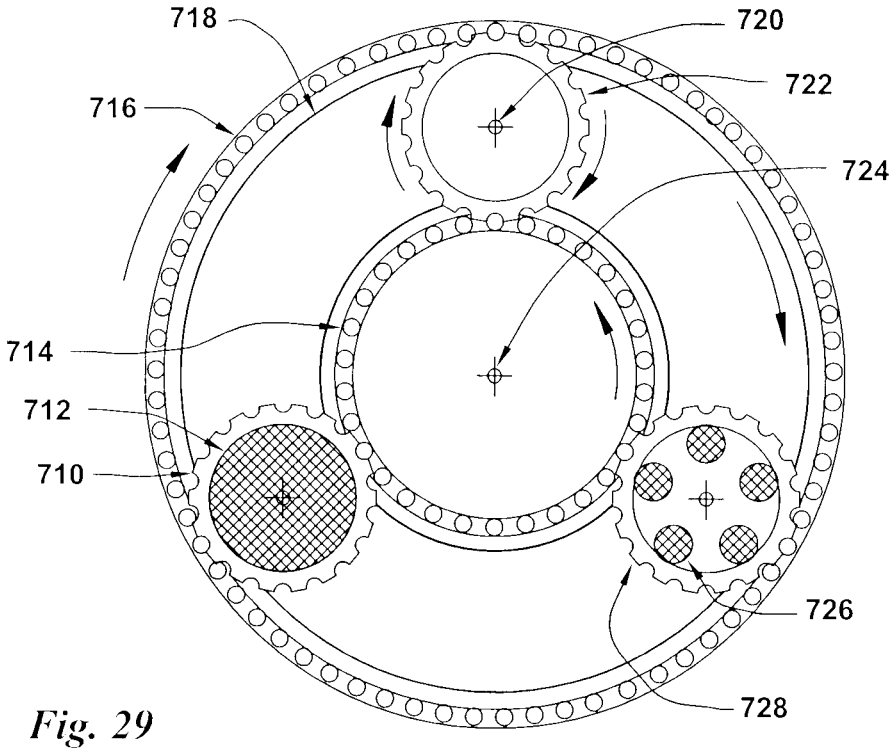
Fig. 29 Prior Art
FIG. 29 is a top view of prior art pin-gear driven planetary workholders and workpieces.

FIG. 29 is a top view of prior art pin-gear driven planetary workholders and workpieces on an abrasive platen. A rotating annular abrasive coated platen 718 and three planetary workholder disks, 722, 728 and 710 that are driven by a platen 718 outer periphery pin-gear 716 and a platen 718 inner periphery pin-gear 714 are shown. Typically the outer periphery pin-gear 716 and the inner periphery pin-gear 714 are driven in opposite directions where the three planetary workholder disks 722, 728 and 710 rotate about a workholder rotation axis 720 but maintain a stationary position relative to the platen 718 rotation axis 724 or they slowly rotate about the platen 718 rotation axis 724 as the platen 718 rotates about the platen rotation axis 724. The outer pin-gears 716 and the inner pin-gears 714 rotate independently in either rotation direction and at different rotation speeds to provide different rotation speeds of the workholder disks 722, 728 and 710 about the workholder rotation axes 720 and also to provide different rotation directions and speeds of the workholders disks 722, 728 and 710 about the platen 718 rotation axis 724. A single individual large-diameter flat-surfaced workpiece 712 is positioned inside the rotating workholder 710 and multiple small-diameter flat-surfaced workpieces 726 are positioned inside the rotating workholder 728. The workholder 722 does not contain a workpiece.

Figure 30:
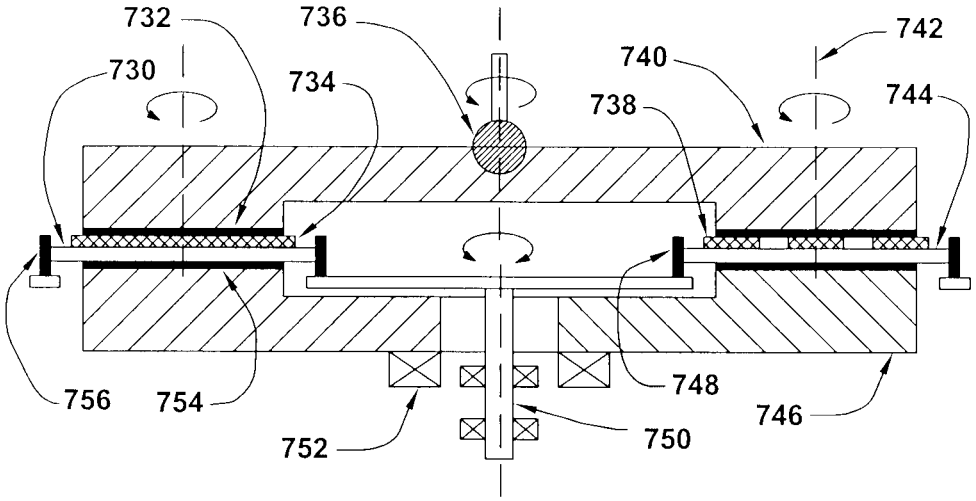
Fig. 30 Prior Art
FIG. 30 is a cross section view of prior art planetary workholders and workpieces.

FIG. 30 is a cross section view of prior art planetary workholders, workpieces and a double-sided abrasive platen. The abrading surface 732 of a rotating upper floating platen 740 and the abrading surface 754 of a rotating lower rigid platen 746 are in abrading contact with flat-surfaced workpieces 734 and 738. A planetary workholder 730 contains a single large-sized workpiece 734 and the planetary workholder 744 contains multiple small-sized workpieces 738. The planetary flat-surfaced workholder disks 730 and 744 rotate about a workholder axis 742 and the workholder disks 730 and 744 are driven by outer periphery pin-gears 756 and inner periphery pin-gears 748. The inner periphery pin-gears 748 are mounted on a rotary drive spindle that has a spindle shaft 750. The rigid-mounted lower platen 746 is supported by platen bearings 752. The floating upper spindle 740 is driven by a spherical rotation device 736 that allows the platen 740 to be conformably supported by the equal-thickness workpieces 734 and 738 that are supported by the lower rigid platen 746.

Figure 31:
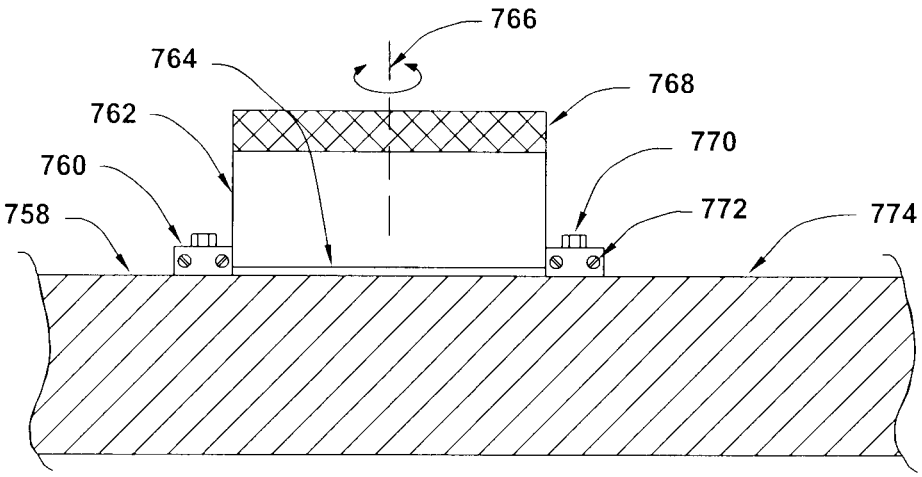
FIG. 31 is a cross section view of adjustable legs on a workpiece spindle.

FIG. 31 is a cross section view of adjustable legs on a workpiece spindle. A rotary workpiece spindle 762 is attached to a granite base 774 by fasteners 770 that are used to bolt the spindle legs 760 to the granite base 774. The spindle 762 has three equally spaced spindle legs 760 that are attached to the bottom portion of the spindle 762 where there is a space gap 764 between the bottom of the spindle and the flat surface 758 of the granite base 774. The spindle 762 has a rotary spindle top 768 that rotates about a spindle axis 766 and the three spindle legs are height-adjusted to align the spindle axis 766 precisely perpendicular with the top surface 758 of the granite base 774. To adjust the height of the spindle leg 760, transverse bolts 772 are tightened to squeeze-adjust the spindle leg 760 where the spindle leg 760 distorts along the spindle axis 766 thereby raising the portion of the spindle 762 located adjacent to the transverse bolts 772 squeeze-adjusted spindle leg 760. After the three spindle legs 760 are adjusted to provide the desired height of the top flat surface of the spindle top 768 and provide the perpendicular alignment of the spindle axis 766 perpendicular with the top surface 758 of the granite base 774, the spindle hold-down attachment bolts 770 are torque-controlled tightened to attach the spindle 762 to the granite base 774.

The hold-down bolts 770 can be loosened and the spindle 762 removed and the spindle 762 then brought back to the same spindle 762 location and position on the granite base 774 for re-mounting on the granite base 774 without affecting the height of the spindle top 768 or perpendicular alignment of the spindle axis 766 because the controlled compressive force applied by the hold-down bolts 770 does not substantially affect the desired size-height distortion of the spindle legs 760 along the spindle rotation axis 766. The height adjustments provided by this adjustable spindle leg 760 can be extremely small, as little as 1 or 2 micrometers, which is adequate for precision alignment adjustments required for air bearing spindles 762 that are typically used for the fixed-spindle floating-platen abrasive system (not shown). Also, these spindle leg 760 height adjustments are dimensionally stable over long periods of time because the squeeze forces produced by the transverse bolts 772 do not stress the spindle leg 760 material past its elastic limit. Here, the spindle leg 760 acts as a compression-spring where the spindle leg 760 height can be reversibly changed by changing the force applied by the transverse bolts 772 which is changed by changing the tightening-torque that is applied to these threaded transverse bolts 772.

Figure 32:
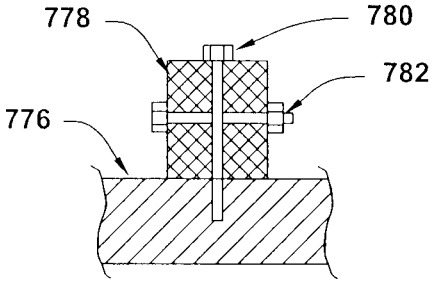
FIG. 32 is a cross section view of an adjustable spindle leg.

FIG. 32 is a cross section view of an adjustable spindle leg. A spindle leg 778 has transverse tightening bolts 782 that compress the spindle leg 778 along the axis of the transverse bolts 290. Spindle (not shown) hold-down bolts 780 are threaded to engage threads (not shown) in the granite base 776 but the compressive action applied on the spindle leg 778 by the hold-down bolts 780 along the axis of the hold-down bolt 780 is carefully controlled in concert with the compressive action of the transverse bolts 782 to provide the desired distortion of the spindle leg 778 along the axis of the hold-down bolts 780.

Figure 33:
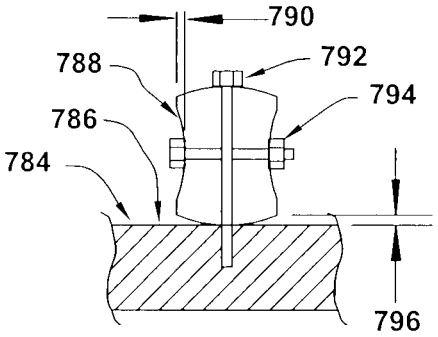
FIG. 33 is a cross section view of a compressed adjustable spindle leg.

FIG. 33 is a cross section view of a compressed adjustable spindle leg. A spindle leg 788 has transverse tightening bolts 794 that compress the spindle leg 788 along the axis of the transverse bolts 794 by a distortion amount 790. Spindle (not shown) hold-down bolts 792 are threaded to engage threads (not shown) in the granite base 784 but the compressive action applied on the spindle leg 788 by the hold-down bolts 792 along the axis of the hold-down bolt 792 is carefully controlled in relationship with the compressive action of the transverse bolts 794 on the spindle leg 788 to provide the desired distortion 796 of the spindle leg 788 along the axis of the hold-down bolts 792. The transverse bolts 794 create a transverse squeezing distortion 790 that is present on the spindle leg 788 and this transverse distortion 790 produces the desired height distortion 796 of the spindle leg 788. When the spindle leg 788 is distorted by the amount 796, the spindle is raised away from the surface 786 of the granite base 784 by this distance amount 796.

Figure 34:
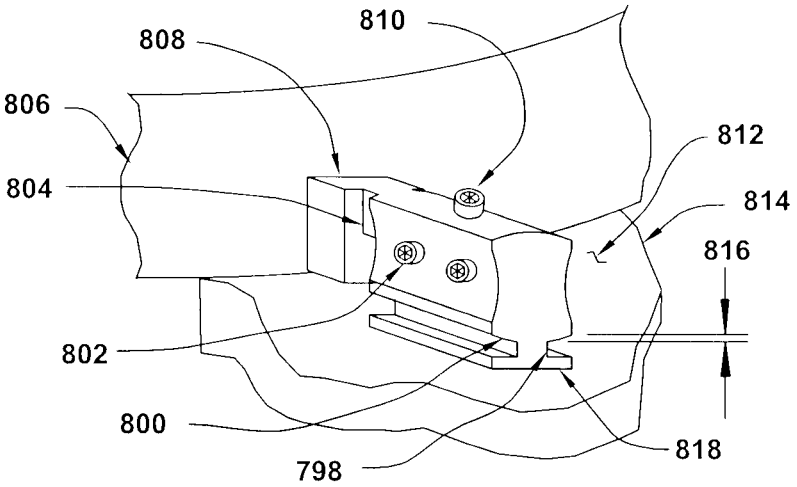
FIG. 34 is an isometric view of a compressed adjustable spindle leg.

FIG. 34 is an isometric view of a compressed adjustable spindle leg. A spindle leg 808 has transverse tightening bolts 802 that compress the spindle leg 800 along the axis of the transverse bolts 802. The spindle 806 has attached spindle legs 808 that have spindle hold-down bolts 810 that are threaded to engage threads (not shown) in the granite base 814. The compressive action applied on the spindle leg 808 by the hold-down bolts 810 along the axis of the hold-down bolt 810 is carefully controlled in concert with the compressive action of the transverse bolts 802 to provide the desired distortion 816 of the spindle leg 808 along the axis of the hold-down bolts 810. The transverse bolts 802 create a transverse squeezing distortion that is present on the spindle leg 808 and this transverse distortion produces the desired height distortion 816 of the spindle leg 808. When the spindle leg 808 is distorted by the amount 816, the spindle 806 is raised away from the surface 812 of the granite base 814 by this distance amount 816. A spindle leg 808 integral flat-base 818 having a distortion-isolation wall 798 provides flat-contact of the spindle leg 808 with the flat surface 812 of the granite base 814. The distortion-curvature 800 of the spindle leg 808 is shown where the spindle leg 808 leg-base 818 remains flat where it contacts the granite base 814 flat surface 812. A narrow but stiff bridge section 804 that is an integral portion of the spindle leg 808 isolates the spindle leg 808 distortion 816 from the body of the spindle 806.

Internal Motor Driven Spindle

Figure 35:
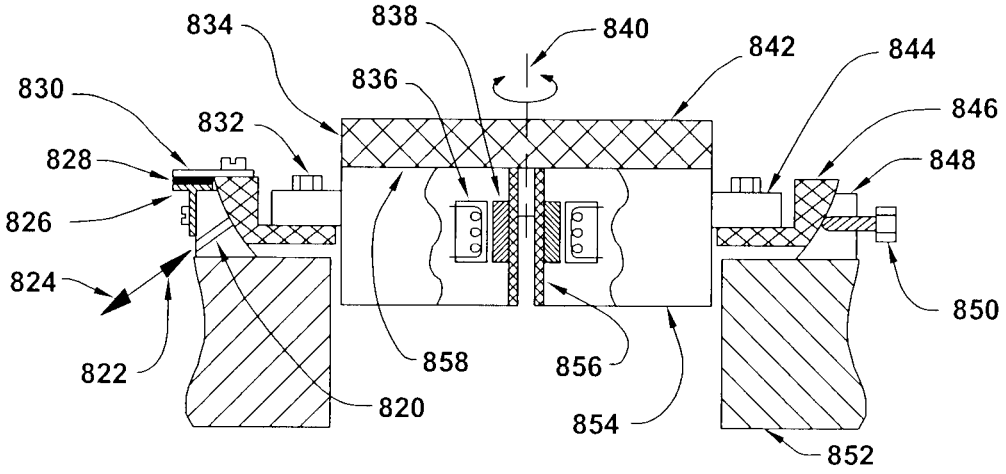
FIG. 35 is a cross section view of a recessed workpiece spindle driven by an internal motor.

FIG. 35 is a cross section view of a recessed workpiece spindle driven by an internal motor. A rotary workpiece air bearing spindle 854 is mounted on a machine base 852 with spindle legs 844 that are attached to the spindle 854 body. The spindle 854 has a flat-surfaced spindle-top 834 that rotates about a spindle axis 840 where the spindle-top 834 has a flat top surface 842. The spindle-top 834 has a hollow spindle shaft 856 that is driven by an internal motor armature 838 that is driven by an electrical motor winding 836. The spindle 854 is recessed into the machine base 852 because the spindle 854 support legs 844 are attached to the spindle 854 body near the top of the spindle 854. The spindle 854 is attached to a spherical rotor 846 with fasteners 832 where the rotor 846 is mounted in a spherical base 848 that is attached to the machine base 852. After co-planar alignment of spindle-tops 834 with other spindle-tops 834 (not shown), the spherical rotor 846 is locked to the spherical base 848 with fasteners 850. This spindle 854 spherical mount system comprising the rotor 846 and base 848, allows inexpensive, but dimensionally stable, machine bases having non-precision flat top surfaces to be used to mount the spindles 854 where the spindle-tops 834 can be precisely aligned to be co-planar with each other.

Here, the separation-line 858 between the spindle-top 834 and the spindle 854 body is a close distance from the spindle 854 mounting surface of the machine base 852. Because the separation distance is short, heat from the motor electrical winding 836 that tends to thermally expand the length of the spindle 854 is minimized and the there is little thermally-induced vertical movement of the spindle-top 834 due to the motor heat. Also, the pressurized air that is supplied to the air bearing spindle 854 expands as it travels through the spindle 854 which lowers the temperature of the spindle air. This cool spindle air exits the spindle body at the separation line 858 where it cools the spindle 854 internally and at the interface between the spindle-top 834 and the spindle 854 which reduces the thermal-expansion effects from the heat generated by the electrical internal motor windings 836. Thermal growth in the length of the spindles 854 tends to be equal for all three spindles 854 used in the fixed-spindle floating platen abrading systems (not shown). Any spindle 854 thermal distortion effects are uniform across all of the system spindles 854 and there is little affect on the abrading process because the floating abrasive platen simply contacts all of these same-expanded spindles 854 in a three-point contact stance. When the spindles 854 are mounted where the bottom of the spindle 854 extends below the surface of the machine base 852 the effect of the thermal growth of the spindles 854 along the spindle length is diminished.

The spindles 854 are attached to spherical rotors 846 that are mounted in a spherical base 848 where pressurized air or a liquid 822 can be applied through a fluid passageways 820 to allow the spherical rotor 846 to float without friction in the spherical base 848 when the spindle-tops 834 (others not shown) are aligned to be co-planar in a common plane after which vacuum 824 can be applied through fluid passageways 820 to lock the spherical rotor 846 to the spherical base 848 and fasteners 850 can be used to attach the spherical rotor 846 to the spherical base 848. The spherical rotor 846 and the spherical base 848 have a mutually common spherical diameter. Another technique of locking the spherical rotor 846 to the spherical base 848 after the spindle-tops 834 are aligned to be co-planar is to apply a liquid adhesive 828 in the gap between a removable bracket 830 that is attached to the spherical rotor 846 and a removable bracket 826 that is attached to the spherical base 848 where the liquid adhesive 828 becomes solidified and provides structural locking attachment of the spherical rotor 846 to the spherical base 848. For future co-planar realignment of the spindle-tops 834 to be co-planar, the brackets 830 and 826 that are adhesively bonded together can be removed by detaching them from the rotor 846 and the housing base 848 and other individual replacement brackets 830 and 826 can be attached to the rotor 846 and the housing base 848. Then, when the spindle-tops 834 are aligned to be co-planar an adhesive 828 is applied in the gap between a removable bracket 830 that is attached to the spherical rotor 846 and a removable bracket 826 that is attached to the spherical base 848 to bond the spherical rotor 846 to the spherical base 848.

The spindle-tops 834 can be aligned to be co-planar with the use of measurement instruments (not shown) or with the use of laser alignment devices (not shown). Also, a very simple technique that can be used for co-planar alignment of the spindle-tops 834 is to bring a precision-flat surface of a floating platen (not shown) annular abrading surface into flat surfaced contact with the spindle-tops 834 where pressurized air or a liquid 822 can be applied through a fluid passageways 820 to form a spherical-action fluid bearing that allows the spherical rotor 846 to float without friction in the spherical base 848. Here, the spindle-tops 834 are aligned to be co-planar in a common plane after which vacuum 824 can be applied through fluid passageways 820 to lock the spherical rotor 846 to the spherical base 848. If desired, pressurized air can be applied to the internal passageways (not shown) connected to the spindle-tops 834 flat surfaces during the procedure of co-planar alignment of the spindle-tops 834. This is done to reduce the friction between the spindle-tops 834 and the platen abrading surface which provides assurance that the spindle-tops 834 and the platen abrading surface are mutually in flat contact with each other. After co-planar alignment of the spindle-tops 834, vacuum can be applied to these spindle-tops 834 flat surfaces to temporarily bond the spindle-tops 834 to the platen before or while vacuum 824 is applied through fluid passageways 820 to lock the spherical rotor 846 to the spherical base 848. Then, when the spindle-tops 834 are aligned to be co-planar, an adhesive 828 is applied in the gap between a removable bracket 830 that is attached to the spherical rotor 846 and a removable bracket 826 that is attached to the spherical base 848 to rigidly bond the spherical rotor 846 to the spherical base 848.

This same technique of applying fluid pressure and vacuum to the fluid passageways 820 to form a spherical-action fluid bearing that allows the spherical rotor 846 to float without friction in the spherical base 848 can be used with the fasteners 850 to attach the spherical rotor 846 to the spherical base 848. Another alternative, but closely related, spindle-tops 834 co-planar alignment technique is to apply pressurized fluid and then vacuum to vacuum abrasive mounting holes in the platen abrading surface to perform the procedure of co-planar alignment of the spindle-tops. Those abrasive disk vacuum holes in the platen that are not in contact with the spindle-tops 834 are temporarily plugged using adhesive tape or by other means during the spindle-tops 834 co-planar alignment procedure.

Figure 36:
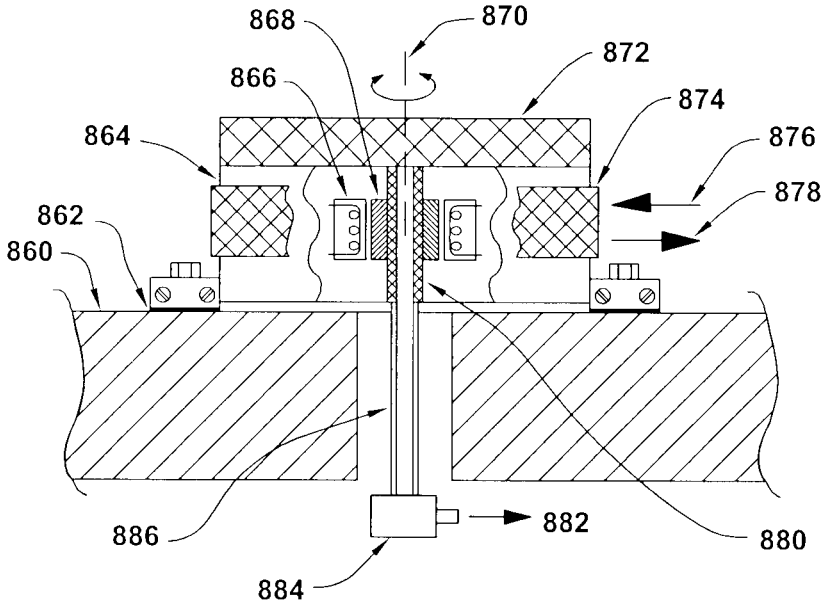
FIG. 36 is a cross section view of a workpiece spindle driven by a fluid cooled motor.

FIG. 36 is a cross section view of a workpiece spindle driven by a fluid cooled internal motor. A spindle 864 has a flat-surfaced rotary spindle-top 872 where the spindle-top 872 is rotated about a spindle axis 870. The spindle 864 is mounted on a machine base 860 by fasteners that attach spindle support legs 862 that are attached to the spindle 864 body to the machine base 860. The spindle-top 872 is driven by a hollow shaft 880 that is driven by a motor armature 868 that is driven by an internal motor winding 866. The spindle-top 872 hollow drive shaft 880 has an attached hollow shaft 886 that has an attached to a stationary rotary union 884 that is coupled to a vacuum source 882 that supplies vacuum to the spindle-top 872. A water or coolant jacket 874 is shown wrapped around the spindle 864 body where the water jacket 874 has temperature-controlled coolant water 876 that enters the water jacket 874 and exits the water jacket as exit water 878 where the water 876 cools the spindle 864 to remove the heat generated by the motor windings 866 to prevent thermal distortion of the spindle 864 and thermal displacement of the spindle-top 872.

Figure 37:
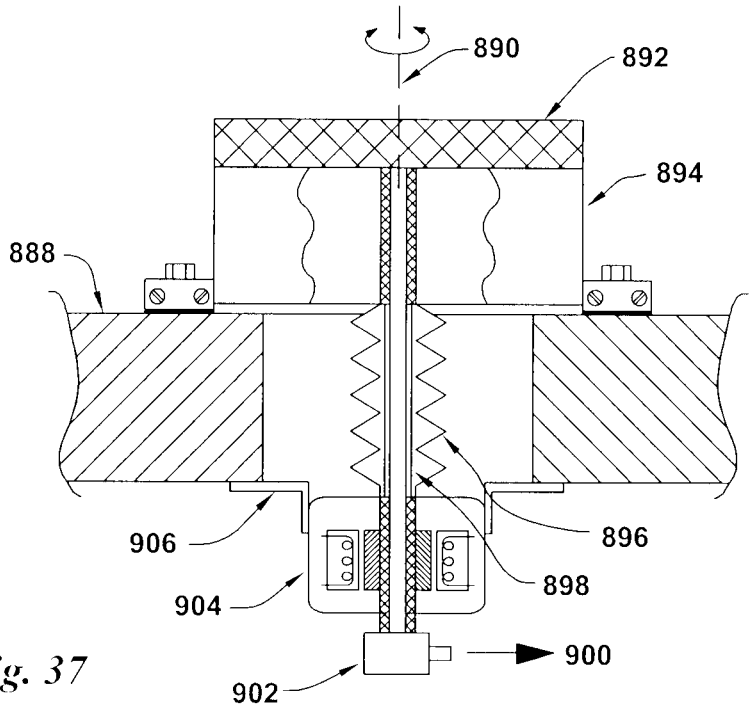
FIG. 37 is a cross section view of a workpiece spindle driven by an external motor.

FIG. 37 is a cross section view of a workpiece spindle driven by an external motor. A spindle 894 having a flat-surfaced spindle-top 892 that rotates about a spindle axis 890 is mounted to a machine base 888. An external motor 904 drives the spindle-top 892 with a bellows-type drive coupler 896 that allows slight misalignments between the motor 904 rotation axis and the spindle-top 892 axis of rotation 890. The bellows-type coupler 896 provides stiff torsional load capabilities for accelerating or decelerating the spindle-top 892. A rotary union device 902 supplies vacuum 900 to the spindle-top 892 through a flexible tube 898. The motor 904 is attached to the machine base 888 with motor brackets 906.

Figure 38:
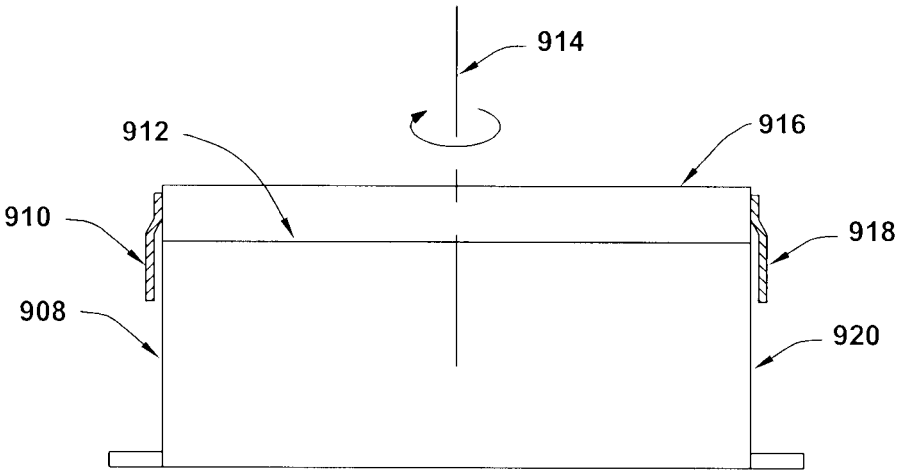
FIG. 38 is a cross section view of a workpiece spindle with a spindle top debris guard.

FIG. 38 is a cross section view of a workpiece spindle with a spindle top debris guard. A cylindrical workpiece spindle 908 has a rotary top 916 that rotates about a spindle axis 914 where the spindle top 916 has a circumferential separation line 912 that separates the spindle top 916 from the spindle 908 base 920. Where these spindles 908 are used in abrading atmospheres, water mist, abrading debris and very small sized abrasive particles are present in the atmosphere surrounding the spindle 908. To prevent entry of this debris, water moisture and abrasive particles in the spindle 908 separation line 912 area, a circumferential drip-shield 910 is provided where the drip shield 910 has a drip lip 918 that extends below the separation line 912. Unwanted debris material and water simply drips off the surface of the drip shield 910. Build-up of debris matter on the drip shield 910 is typically avoided because of the continued presence of abrasive coolant water that continually washes the surface of the drip shield 910. When the workpiece spindles 908 are used in abrading processes, often special chemical additives are added to the coolant water to enhance the abrading action on workpieces (not shown) in abrading procedures such as chemical mechanical planarization. Both the cylindrical spindle 908 cylindrical drip shields 910 and the spindles 908 are constructed from materials that are resistant to materials comprising water coolants, chemical additives, abrading debris and abrasive particles.

Automated Workpiece and Abrasive Disk Loader

Figure 39:
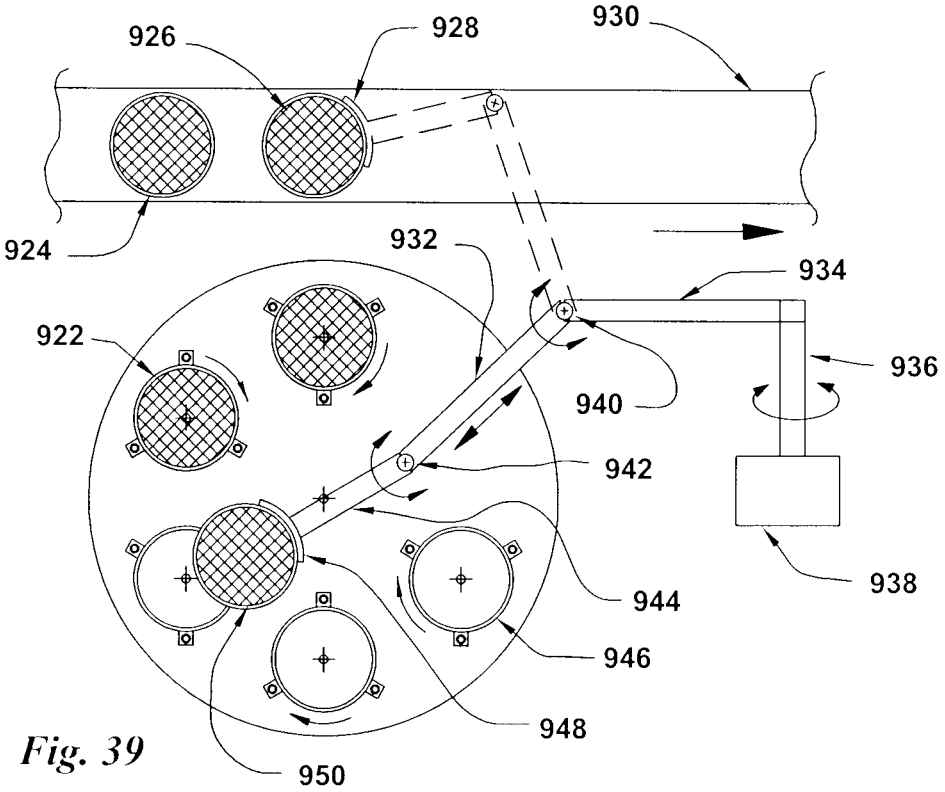
FIG. 39 is a top view of an automatic robotic workpiece loader for multiple spindles.

FIG. 39 is a top view of an automatic robotic workpiece loader for multiple spindles. An automated robotic device 938 has a rotatable shaft 936 that has an arm 934 to which is connected a pivot arm 932 that, in turn, supports another pivot arm 944. A pivot joint 942 joins pivot arms 944 and 932 and pivot joint 940 joins pivot arms 932 and 934. A workpiece carrier holder 948 attached to the pivot arm 944 holds a workpiece carrier 950 that contains a workpiece 922 where the robotic device 938 positions the workpiece 922 and carrier 950 on and concentric with the workpiece rotary spindle 946. Other workpieces 926 and carriers 924 are shown on a moving workpiece transfer belt 930 where they are picked up by the carrier holder 928. The workpieces 922 and 926 and workpiece carriers 950, 924 can also be temporarily stored in other devices comprising cassette storage devices (not shown). The workpieces 922, 926 and workpiece carriers 950, 924 can also be removed from the spindles 946 after the workpieces 950, 924 are abraded and the workpieces 922, 926 and workpiece carriers 950, 924 can then be placed in or on a moving belt (not shown) or a cassette device (not shown). The workpieces 922, 926 can also optionally be loaded directly on the spindles 946 without the use of the workpiece carriers 950, 924. Access for the robotic device 938 is provided in the open access area between two wide-spaced adjacent spindles 946.

Figure 40:
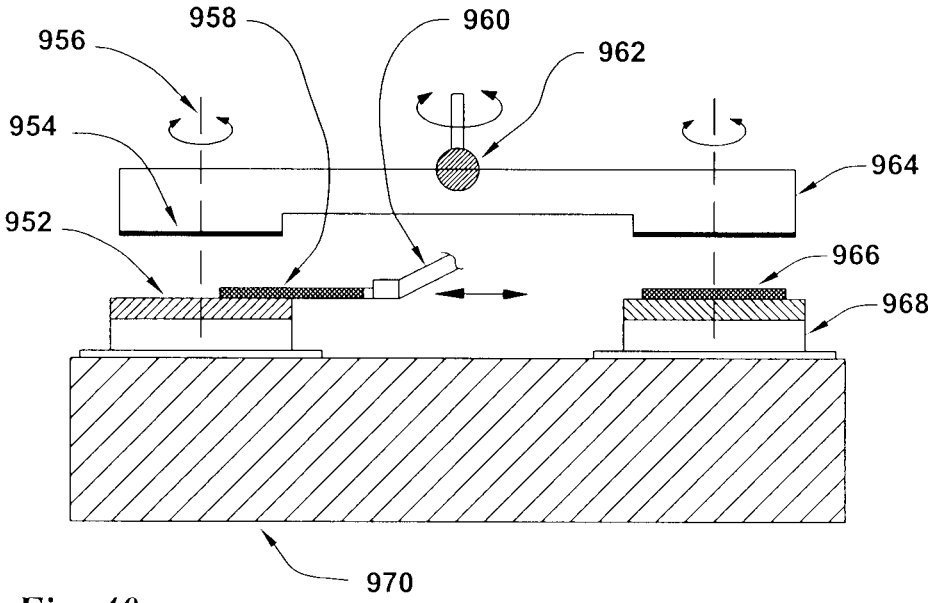
FIG. 40 is a side view of an automatic robotic workpiece loader for multiple spindles.

FIG. 40 is a side view of an automatic robotic workpiece loader for multiple spindles. An automated workpiece loader device 960 (partially shown) can be used to load workpieces 958, 966 onto spindles 968 that have spindle tops that have flat surfaces 952 and where the spindle tops rotate about the spindle axis 956. A floating platen 964 that is rotationally driven by a spherical-action device 962 has an annular abrasive surface 954 that contacts the equal-thickness workpieces 958 and 966 where the platen 964 is partially supported by abrading contact with the three independent three-point spindles 968 and the abrading pressure on the workpieces 958 and 966 is controlled by controlled force-loading of the spherical action device 962. The spindles 968 are supported by a granite machine base 970.

Figure 41:
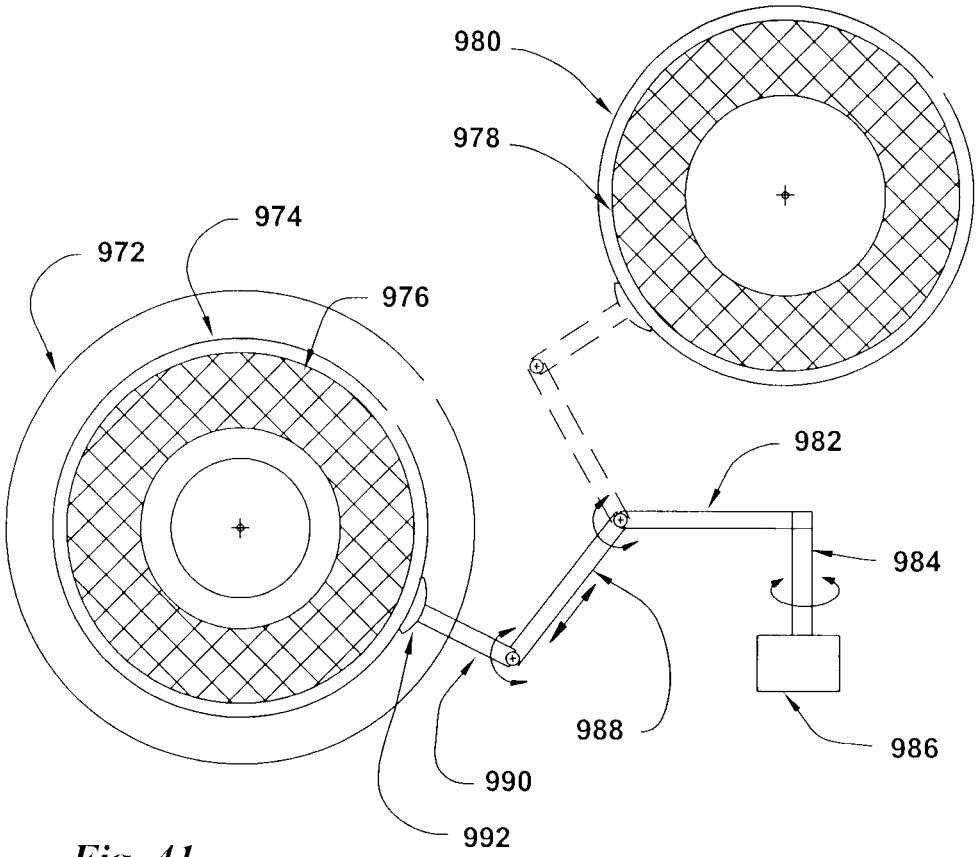
FIG. 41 is a top view of an automatic robotic abrasive disk loader for an upper platen.

FIG. 41 is a top view of an automatic robotic abrasive disk loader for an upper platen. An automated robotic device 986 has a rotatable shaft 984 that has an arm 982 to which is connected a pivot arm 988 that, in turn, supports another pivot arm 990. An abrasive disk carrier holder 992 attached to the pivot arm 990 holds an abrasive disk carrier 974 that contains an abrasive disk 976 where the robotic device 986 positions the abrasive disk 976 and disk carrier 974 on and concentric with the platen 972. Another abrasive disk 978 and abrasive disk carrier plate 980 are shown in a remote location where the abrasive disk 978 can also be temporarily stored in other devices comprising cassette storage devices (not shown). Guide or stop devices (not shown) can be used to aid concentric alignment of the abrasive disk 976 and the platen 972 and the robotic device can position the abrasive disk 976 in flat conformal contact with the flat-surfaced platen 972 after which, vacuum (not shown) is applied to attach the disk 976 to the platen 972 flat abrading surface (not shown). Then the pivot arms 990, 988 and 982 and the carrier holder 238 and the disk carrier 974 are translated back to a location away from the platen 972.

Figure 42:
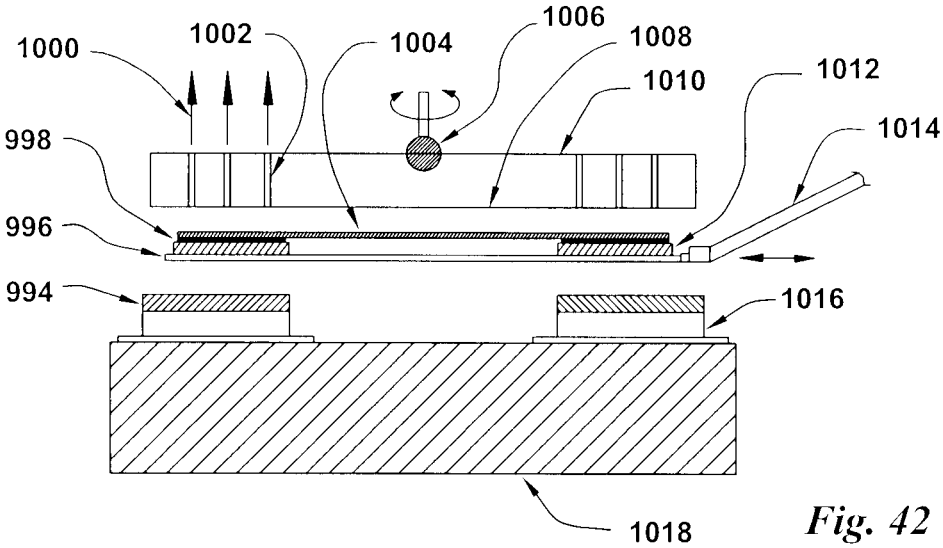
FIG. 42 is a side view of an automatic robotic abrasive disk loader for an upper platen.

FIG. 42 is a side view of an automatic robotic abrasive disk loader for an upper platen. An automated robotic device 1014 (partially shown) has a carrier holder plate 996 that has an attached resilient annular disk support pad 1012 that supports an abrasive disk 1004 that has an abrasive layer 998. The abrasive disk carrier holder 996 that contains an abrasive disk 1004 is moved where the robotic device 1014 positions the abrasive disk 1004 and disk carrier 996 on to and concentric with the platen 1010. The resilient layer pad 1012 on the carrier holder 996 allows the back-disk-mounting side of the abrasive disk 1004 to be in flat conformal contact with the platen 1010 abrading surface 1008 before the vacuum 1000 is activated. The platen has vacuum 1000 that is applied through vacuum port holes 1002 to attach the abrasive disk 1004 to the abrading surface 1008 of the platen 1010. The floating platen 1010 is driven rotationally by a spherical action device 1006 to allow the floating platen 1010 abrading surface 1008 to be in flat contact with equal-thickness flat-surface workpieces (not shown) that are attached with flat surface contact to the flat top rotating component 994 of three three-point spindles 1016 (one not shown) that are mounted on a granite base 1018. After the abrasive disk 1004 is attached to the platen 1010 the robotic device 1014 carrier holder 996 is withdraw from the platen 1010 area.

Co-Planar Aligned Workpiece Spindles

Figure 43:
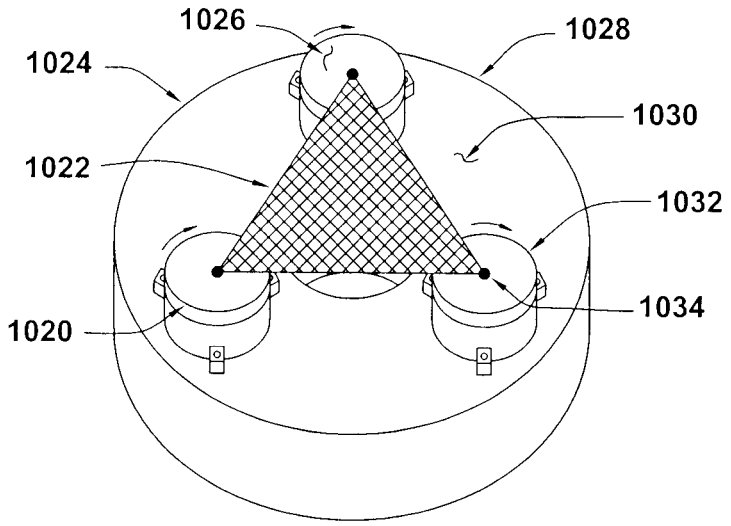
FIG. 43 is an isometric view of three-point co-planar aligned workpiece spindles.

FIG. 43 is an isometric view of three-point co-planar aligned workpiece spindles that have a spindle-common plane where the spindles are mounted on a granite machine base. Three spindles 1032 having rotary spindle-tops 1020 that have spindle-top 1020 rotational center points 1034 where all of the spindle-tops 1020 flat surfaces 1026 are co-planar as represented by a planar surface 1022. The spindles 1032 are mounted on a machine base 1024. The spindles 1032 are attached to the flat surface 1030 of a granite, or other base material, base 1028.

Figure 44:
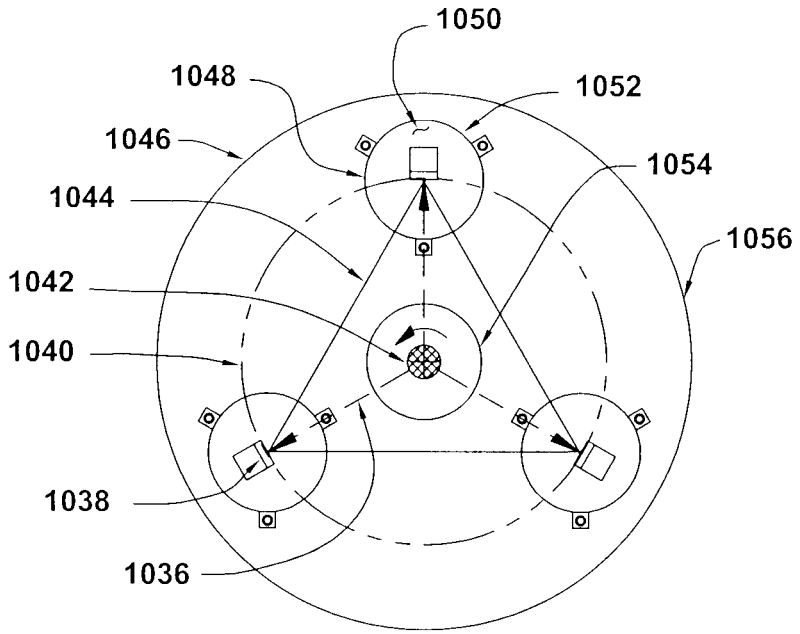
FIG. 44 is a top view of three-point center-position laser aligned rotary workpiece spindles.

FIG. 44 is a top view of three-point center-position laser aligned rotary workpiece spindles on a granite base. Three-point spindles 1052 are mounted on a machine base 1046 where a rotary laser device 1054 having a rotary laser head 1042 that sweeps a laser beam 1036 in a laser plane circle 1040. The rotary laser 1054 is mounted on the machine base 1046 at a central position between the three spindles 1052 to minimize the laser beam 1036 distance between the rotary laser head 1042 and the reflective laser minor targets 1038 that are mounted on the spindles 1052 spindle-top flat surfaces 1050. The spindles 1052 spindle-top 1048 surfaces 1050 are aligned to be co-planar with the use of the rotary-beam laser device 1054 to form a spindle-top 1048 alignment plane 1044

Three fixed-position rotary workpiece spindles 1052 that are mounted on a granite base are shown being aligned with a L-740 Ultra Precision Leveling Laser 1042 provided by Hamar Laser of Danbury, Conn. This laser device 1042 has a flatness alignment capability that is approximately three times better than the desired 0.0001 inch (2.5 micron) co-planar spindle-top alignment that is required for high speed flat lapping. Reflective laser minors 1038 are attached to the flat top surfaces 1050 of the spindle-tops 1048 to reflect a laser beam 1036 that is emitted by the rotating laser head 1042 back to a laser device 1054 sensor (not shown) The rotary laser device 1054 can be mounted at a central position between the three spindles 1052 to minimize the distance between the reflective minors 1038 and the rotating laser beam 1036 laser device 1054 laser head 1042 source. Each spindle 1052 is independently tilt-adjusted to attain this precision co-planar alignment of the spindle-tops 1048 flat surfaces 1050 prior to structurally attaching the spindles 1052 to the granite base 1056. The spindle-tops 1048 alignments are retained for long periods of time because of the dimensional stability of the granite base 1056. The spindles 1052 can be attached directly to the granite base 1056 or they can be attached to spindle 1052 spherical-action spindle mounts (not shown) after the spindle-tops 1048 are aligned to be co-planar to each other.

Figure 45:
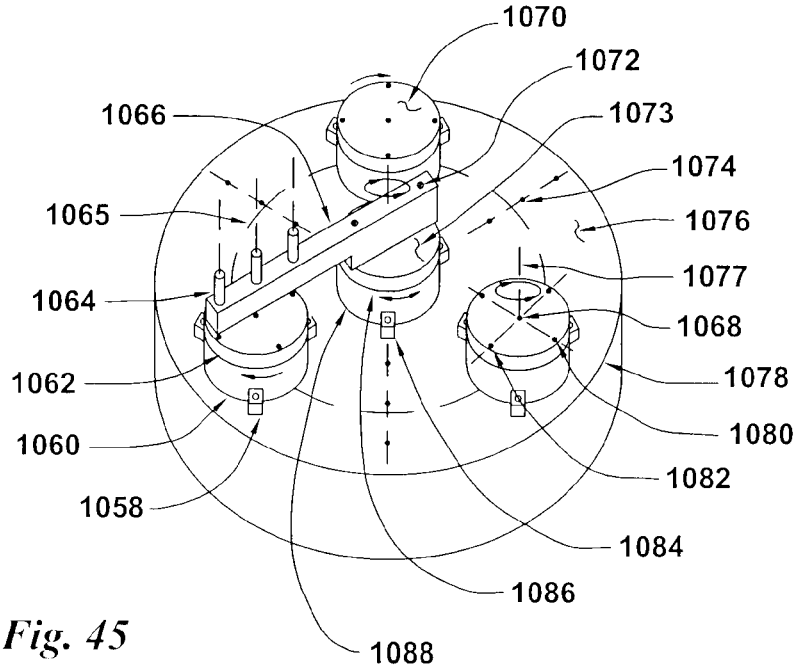
FIG. 45 is an isometric view of an air bearing spindle laser spindle alignment device.

FIG. 45 is an isometric view of an air bearing spindle mounted laser co-planar spindle top alignment device. An air bearing rotary alignment spindle 1088 is mounted on a granite lapper machine base 1078 having a flat surface 1076 where the rotary alignment spindle 1088 is positioned at the center of the machine base 1078. Rotary workpiece spindles 1060 having rotary spindle-tops 1062 are located at the outer periphery of the circular shaped machine base 1078 where these workpiece spindles 1060 are positioned with near-equal distances between them and they surround the alignment spindle 1088. A laser sensor arm 1066 is attached to the top flat surface 1073 of the rotary alignment spindle 1088 spindle-top 1086 where the rotary spindle-top 1086 of the alignment spindle 1088 can be rotated to selected positions.

Three laser distance sensors 1064 are shown attached to the laser sensor arm 1066 where the laser distance sensors 1064 can be used to measure the precise laser span distance between the laser sensor 1064 bottom laser sensor end (not shown) and targets 1068, 1080, 1082 located on the flat surfaces 1070 of the workpiece spindle-tops 1062. One or more of the three laser distance sensors 1064 can also be used to measure the precise laser span distances to select targets 1074 that are located on the flat surface 1076 of the machine base 1078. The select targets 1074 that are located on the flat surface 1076 of the machine base 1078 are typically aligned in a line that extends radially from the center of the machine base 1078 so that the laser span distances of all three select targets 1074 can be measured simultaneously by the distance measuring sensors 1064. The laser sensor arm 1066 that is attached to the top flat surface 1073 of the rotary alignment spindle 1088 spindle-top 1086 can be rotated to align the laser distance sensors 1064 with the selected measurement targets 1068, 1080, 1082 located on the surfaces 1070 of the workpiece spindle-tops 1062 and also to be aligned with targets 1074 that are located on the flat surface 1076 of the machine base 1078.

Commercial air bearing alignment spindles 1088 that are suitable for precision co-planar alignment of the workpiece spindles 1060 spindle-tops 1062 flat surfaces 1070 are available from Nelson Air Corp, Milford, N.H. Air bearing spindles are preferred for this co-planar alignment procedure but suitable rotary flat-surfaced alignment spindles 1088 having conventional roller bearings can also be used. These air bearing alignment spindles 1088 typically provide spindle top 1086 flat surface 1073 flatness accuracy of 5 millionths of an inch (0.13 microns) but can have spindle top 1086 flat surface 1073 flatness accuracies of only 2 millionths of an inch (0.05 microns). These alignment spindle 1088 flatness accuracies are more than adequate to co-planar align the workpiece spindles 1060 spindle-tops 1062 flat surfaces 1070 within the 0.0001 inches (3 microns) required for high speed flat lapping. In addition, the air bearing alignment spindles 1088 are also very stiff for resisting any torsion loads imposed by overhanging the laser sensor arm 1066 past the peripheral edge of the alignment spindles 1088 which prevents deflection of the sensor 1064 end of the laser sensor arm 1066 during all phases of the procedure for co-planar alignment of all the individual workpiece spindles 1060 spindle-tops 1062 flat surfaces 1070.

Typically three workpiece spindles 1060 are used for a lapper machine but more than three workpiece spindles 1060 can be attached to the machine base 1078 and be co-planar aligned using this alignment system. The preferred distance sensors 1064 are laser sensors but they can also be mechanical distance measurement sensors 1064 such as micrometers and also can be ultrasonic distance sensors 1064.

The procedure for co-planar alignment of the workpiece spindle's 1060 spindle-tops 1062 flat surfaces 1070 includes attaching the alignment spindle 1088 to the machine base 1078 flat surface 1076 and attaching the laser sensing arm 1066 having the distance sensors 1064 to the alignment spindle 1088 rotary spindle top 1086 flat surface 1073. Then the laser sensing arm 1066 is rotated to select target positions 1074 on the machine base 1078 and laser span distance measurements are made between the ends of the laser sensors 1064 and the select target positions 1074 on the machine base 1078 to adjust the heights of the rotary alignment spindle 1088 support legs 1084 where the top flat surface 1073 of the rotary spindle-top 1086 of the alignment spindle 1088 is aligned to be co-planar with the top flat surface 1076 of the granite, metal or epoxy-granite machine base 1078.

Each of the workpiece spindles 1060 spindle-tops 1062 flat surfaces 1070 are individually aligned to be co-planar aligned with the top flat surface 1073 of the rotary spindle-top 1086 of the alignment spindle 1088 by adjusting the height of the workpiece spindle 1060 support legs 1058. The co-planar alignment of the workpiece spindles 1060 spindle-tops 1062 flat surfaces 1070 is done by making distance measurements from the ends of the laser sensors 1064 to selected targets 1068, 1080, 1082 on the flat surfaces 1070 of the workpiece spindles 1060 spindle-tops 1062. The laser sensing arm 1066 is rotated to align the laser sensors 1064 with the selected targets 1068, 1080, 1082 on the flat surfaces 1070 of the workpiece spindles 1060 spindle-tops 1062 by manually rotating the rotary spindle-top 1086 of the alignment spindle 1088. When all of the individual workpiece spindles 1060 spindle-tops 1062 flat surfaces 1076 are individually aligned to be co-planar aligned with the with the top flat surface 1073 of the rotary spindle-top 1086 of the alignment spindle 1088, the alignment spindle 1088 is removed from the machine base 1078. This co-planar alignment of the workpiece spindle's 1060 spindle-tops 1062 flat surfaces 1070 can be done periodically to re-establish or verify the accuracy of the workpiece spindles 1060 co-planar alignment. The workpiece spindles 1060 spindle tops 1062 rotate about a spindle tops 1062 target point 1068 that is located at the geometric centers of the spindle-tops 1062.

The three workpiece spindles 1060 are mounted on the flat surface 1076 of the machine base 1078 where the rotational axis 1077 of the spindle tops 1062 intersects a target point 1068 and where the rotational axes 1077 of the spindle tops 1062 intersect a spindle-circle 1065 where the spindle-circle 1065 is coincident with the machine base 1078 nominally-flat top surface 1076.

Figure 46:
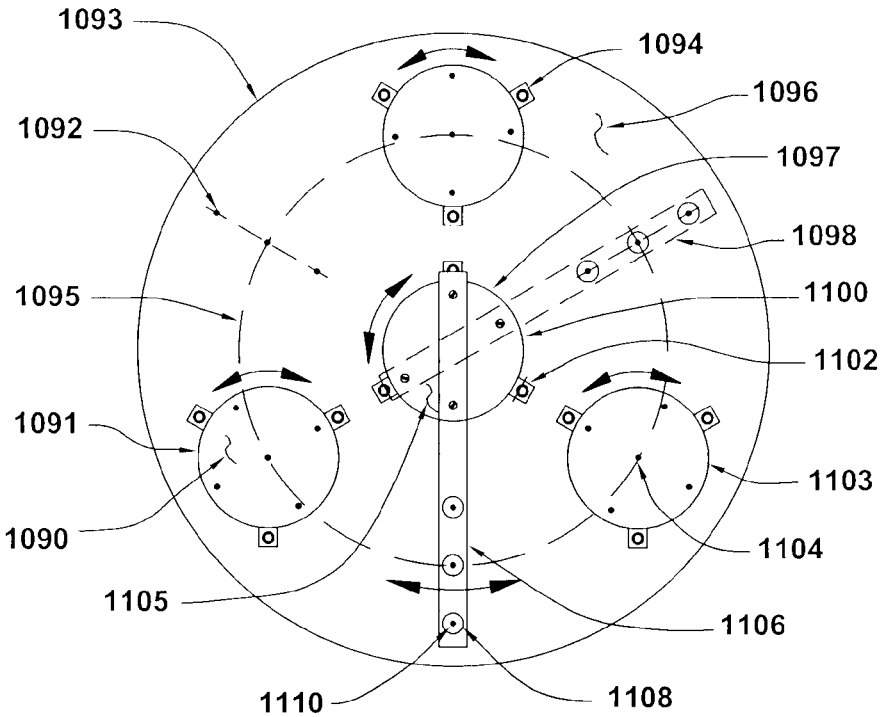
FIG. 46 is a top view of an air bearing spindle laser co-planar spindle top alignment device.

FIG. 46 is a top view of an air bearing spindle mounted laser co-planar spindle top alignment device. An air bearing rotary alignment spindle 1100 is mounted on a granite lapper machine base 1093 having a flat surface 1096 where the rotary alignment spindle 1100 is positioned at the center of the machine base 1093. Rotary workpiece spindles 1091 having flat surfaces 1090 are located at the outer periphery of the circular shaped machine base 1093 where these workpiece spindles 1091 are positioned with near-equal distances between them and they surround the alignment spindle 1100. A laser sensor arm 1106 is attached to the rotary alignment spindle 1100 spindle-top 1097 where the rotary spindle-top 1097 of the alignment spindle 1100 can be rotated to selected positions.

Three laser distance sensors 1108 are shown attached to the laser sensor arm 1106 where the laser distance sensors 1108 having respective laser beam axes 1110 can be used to measure the precise laser span distance between the laser sensor 1108 bottom laser sensor end (not shown) and targets 1104 located on the flat surfaces 1090 of the workpiece spindle's 1091 spindle-tops 1103. One or more of the three laser distance sensors 1108 can also be used to measure the precise laser span distances to select targets 1092 that are located on the flat surface 1096 of the machine base 1093. The select targets 1092 that are located on the flat surface 1096 of the machine base 1093 are typically aligned in a line that extends radially from the center of the machine base 1093 so that the laser span distances of all three select targets 1092 can be measured simultaneously by the distance measuring sensors 1108.

The laser sensor arm 1106 that is attached to the top flat surface of the rotary alignment spindle 1100 spindle-top 1097 can be rotated to align the laser distance sensors 1108 with the selected measurement targets 1104 located on the surfaces of the workpiece spindles 1091 spindle-tops 1103 and also to be aligned with targets 1092 that are located on the flat surface 1096 of the machine base 1093. The laser sensor arm 1106 is shown also in an alternative measurement location as laser sensor arm 1098. Each of the workpiece spindles 1091 have height adjustable support legs 1094 that are adjusted in height to align the workpiece spindle-tops 1103 to be co-planar with the alignment spindle 1100 spindle-top flat surface 1105. Also, the alignment spindle 1100 has height adjustable support legs 1102 that are adjusted in height to align the flat top surface 1105 of the alignment spindle 1100 spindle-tops 1097 to be co-planar with the granite base 1093 flat surface 1096. The three workpiece spindles 1091 are mounted on the flat surface 1096 of the machine base 1093 where the rotational axes of the spindle tops 1103 that intersects the spindle tops 1103 rotation-center target point 1104 intersects a spindle-circle 1095 where the spindle-circle 1095 is coincident with the machine base 1093 nominally-flat top surface 1096.

Figure 47:
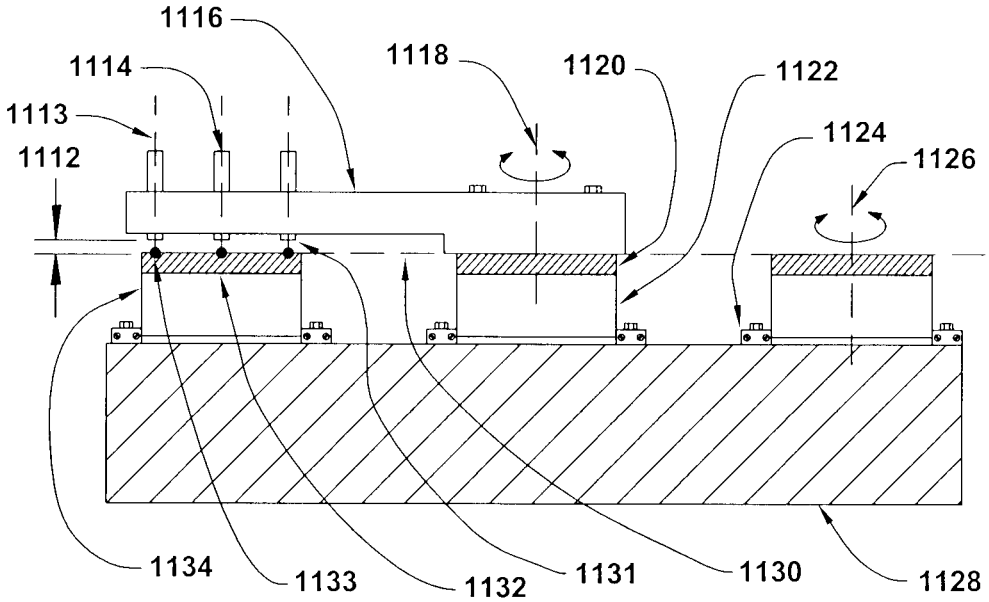
FIG. 47 is a cross section view of an air bearing spindle laser spindle top alignment device.

FIG. 47 is a cross section view of an air bearing spindle mounted laser co-planar spindle top alignment device. An air bearing rotary alignment spindle 1122 is mounted on a granite lapper machine base 1128 having a flat surface where the rotary alignment spindle 1122 is positioned at the center of the machine base 1128. Rotary workpiece spindles 1134 having flat surfaces are located at the outer periphery of the circular or rectangular shaped machine base 1128 where these workpiece spindles 1134 are positioned with near-equal distances between them and they surround the alignment spindle 1122. A laser sensor arm 1116 is attached to the rotary alignment spindle 1122 spindle-top 1120 where the rotary spindle-top 1120 of the alignment spindle 1122 can be rotated about an axis 1118 to selected positions.

Three laser distance sensors 1114 are shown attached to the laser sensor arm 1116 where the laser distance sensors 1114 having respective laser beam axes 1113 can be used to measure the precise laser span distance 1112 between the laser sensor 1114 bottom laser sensor end 1131 and targets 1133 located on the flat surfaces of the workpiece spindle's 1134 spindle-tops 1132. One or more of the three laser distance sensors 1114 can also be used to measure the precise laser span distances to select targets that are located on the flat surface of the machine base 1128. The select targets that are located on the flat surface of the machine base 1128 are typically aligned in a line that extends radially from the center of the machine base 1128 so that the laser span distances of all three select targets can be measured simultaneously by the distance measuring sensors 1114.

The laser sensor arm 1116 that is attached to the top flat surface of the rotary alignment spindle 1122 spindle-top 1120 can be rotated to align the laser distance sensors 1114 with the selected measurement targets 1133 located on the surfaces of the workpiece spindles 1134 spindle-tops 1132 and also to be aligned with targets that are located on the flat surface of the machine base 1128. Each of the workpiece spindles 1134 have height adjustable support legs 1124 that are adjusted in height to align the top flat surfaces of the workpiece spindle-tops 1132 to be co-planar in a plane 1130 with the alignment spindle 1122 spindle-top flat surface. Also, the alignment spindle 1122 has height adjustable support legs that are adjusted in height to align the flat top surface of the alignment spindle 1122 spindle-top 1120 to be co-planar with the granite base 1128 flat top surface.

The workpiece spindles 1134 are rotated about an axis 1126 to incremental positions or the workpiece spindles 1134 are rotated about an axis 1126 at rotational speeds when the laser span distances 1112 are measured to provide span distance 1112 measurements having improved-accuracy dynamic readings by averaging multiple target 1133 points on the circumference of the spindle-tops 1132 as the spindle-tops 1132 are rotated. The granite construction material of the machine base 1128 provides long term dimensional stability and rigidity that allows the workpiece spindle's 1134 spindle-tops 1132 precision co-planar alignment to be maintained over long periods of time even when the workpiece spindles 1134 spindle are subjected to abrading forces during flat lapping operations.

Figure 48:
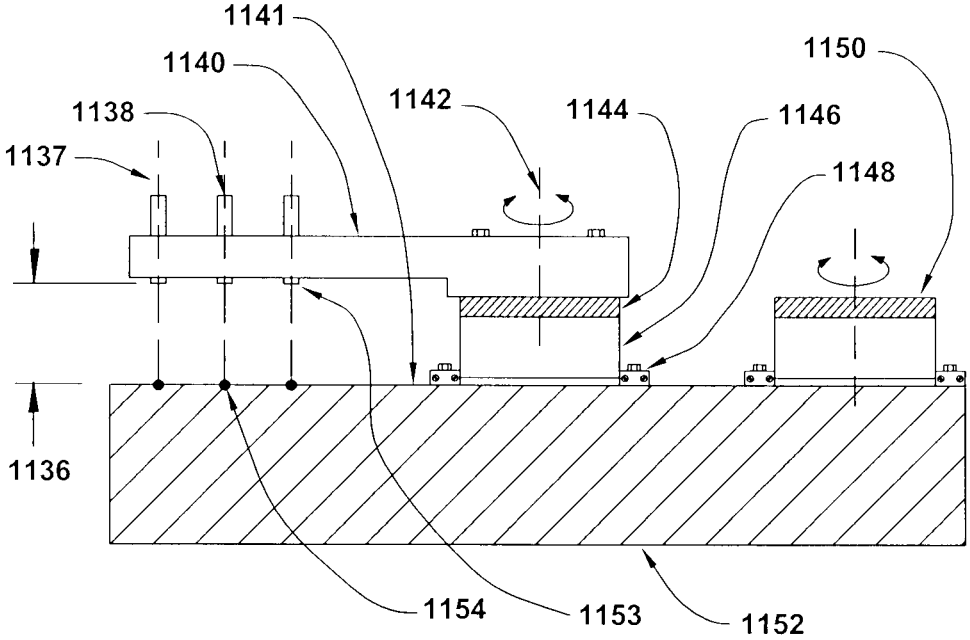
FIG. 48 is a cross section view of an air bearing spindle laser arm used to align spindles.

FIG. 48 is a cross section view of an air bearing spindle mounted laser arm used to align the alignment spindle device. An air bearing rotary alignment spindle 1146 is mounted on a granite lapper machine base 1152 having a flat top surface 1141 where the rotary alignment spindle 1146 is positioned at the center of the machine base 1152. Rotary workpiece spindles 1150 having flat rotary surfaces are located at the outer periphery of the circular or rectangular shaped machine base 1152 where these workpiece spindles 1150 are positioned with near-equal distances between them and they surround the alignment spindle 1146. A laser sensor arm 1140 is attached to the rotary alignment spindle 1146 spindle-top 1144 where the rotary spindle-top 1144 of the alignment spindle 1146 can be rotated about an axis 1142 to selected positions.

Three laser distance sensors 1138 are shown attached to the laser sensor arm 1140 where the laser distance sensors 1138 having respective laser beam axes 1137 can be used to measure the precise laser span distance 1136 between the laser sensors 1138 bottom laser sensor ends 1153 and targets 1154 located on the flat surface 1141 of the machine base 1152. The select targets 1154 that are located on the flat surface 1141 of the machine base 1152 are typically aligned in a line that extends radially from the center of the machine base 1152 so that the laser span distances 1136 of all three select targets can be measured simultaneously by the respective three distance measuring sensors 1138.

The laser sensor arm 1140 that is attached to the top flat surface of the rotary alignment spindle 1146 spindle-top 1144 can be rotated manually or by a rotation drive device (not shown) about the axis 1142 to align the laser distance sensors 1138 with the selected measurement targets 1154 that are located on the flat top surface 1141 of the machine base 1152. The alignment spindle 1146 has height-adjustable support legs 1148 that are adjusted in height to align the flat top surface of the alignment spindle 1146 spindle-top 1144 to be co-planar with the granite base 1152 flat top surface 1141.

Figure 49:
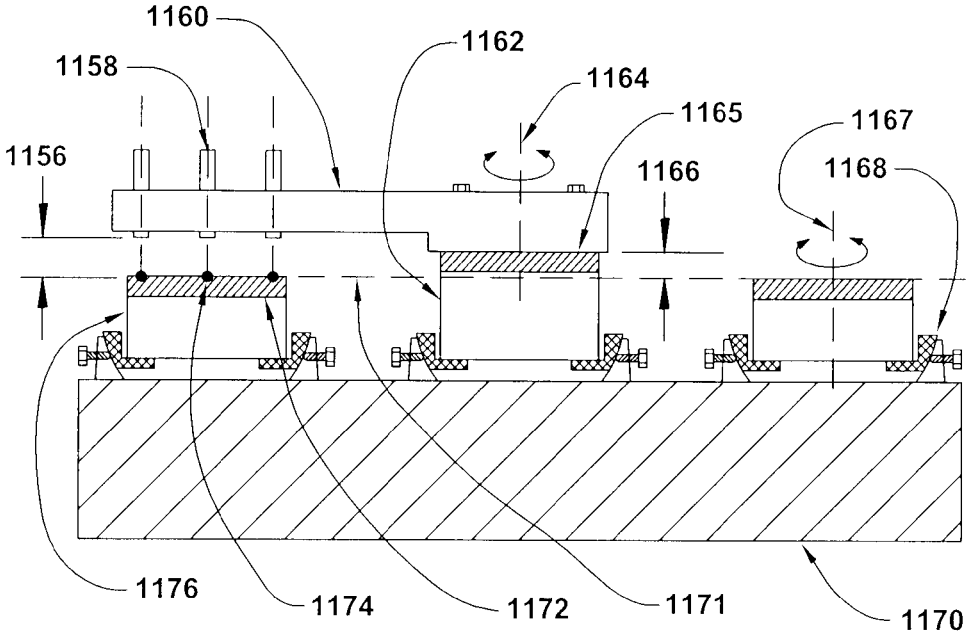
FIG. 49 is a cross section view of an air bearing spindle laser spindle alignment device.

FIG. 49 is a cross section view of an elevated air bearing spindle mounted laser spindle alignment device. An air bearing rotary alignment spindle 1162 is mounted on a granite lapper machine base 1170 having a flat surface where the rotary alignment spindle 1162 is positioned at the center of the machine base 1170. Rotary workpiece spindles 1176 having flat surfaces are located at the outer periphery of the circular or rectangular shaped machine base 1170 where these workpiece spindles 1176 are positioned with near-equal distances between them and they surround the alignment spindle 1162. A laser sensor arm 1160 is attached to the rotary alignment spindle 1162 spindle-top 1165 where the rotary spindle-top 1165 of the alignment spindle 1162 can be rotated about an axis 1164 to selected positions.

Three laser distance sensors 1158 are shown attached to the laser sensor arm 1160 where the laser distance sensors 1158 having respective laser beam axes can be used to measure the precise laser span distance 1156 between the laser sensor 1158 bottom laser sensor end and targets 1174 located on the flat surfaces of the workpiece spindle's 1176 spindle-tops 1172. One or more of the three laser distance sensors 1158 can also be used to measure the precise laser span distances to select targets that are located on the flat surface of the machine base 1170. The select targets that are located on the flat surface of the machine base 1170 are typically aligned in a line that extends radially from the center of the machine base 1170 so that the laser span distances of all three select targets can be measured simultaneously by the distance measuring sensors 1158.

The laser sensor arm 1160 that is attached to the top flat surface of the rotary alignment spindle 1162 spindle-top 1165 can be rotated to align the laser distance sensors 1158 with the selected measurement targets 1174 located on the surfaces of the workpiece spindles 1176 spindle-tops 1172 and also to be aligned with targets that are located on the flat surface of the machine base 1170. Each of the workpiece spindles 1176 have spherical-action spindle mounts 1168 that are rotated to align the top flat surfaces of the workpiece spindle-tops 1172 to be co-planar in a plane 1171 that is offset by a distance 1166 and is parallel to the alignment spindle 1162 spindle-top flat surface. Also, the alignment spindle 1162 has spherical-action spindle mounts 1168 that are rotated to align the flat top surface of the alignment spindle 1162 spindle-top 1165 to be co-planar with the granite base 1170 flat top surface.

The workpiece spindles 1176 are rotated about an axis 1167 to incremental positions or the workpiece spindles 1176 are rotated about an axis 1167 at rotational speeds when the laser span distances 1156 are measured to provide span distance 1156 measurements having improved-accuracy dynamic readings by averaging multiple target 1174 points on the circumference of the spindle-tops 1172 as the spindle-tops 1172 are rotated. The granite construction material of the machine base 1170 provides long term dimensional stability and rigidity that allows the workpiece spindle's 1176 spindle-tops 1172 precision co-planar alignment to be maintained over long periods of time even when the workpiece spindles 1176 spindle are subjected to abrading forces during flat lapping operations.

Figure 50:
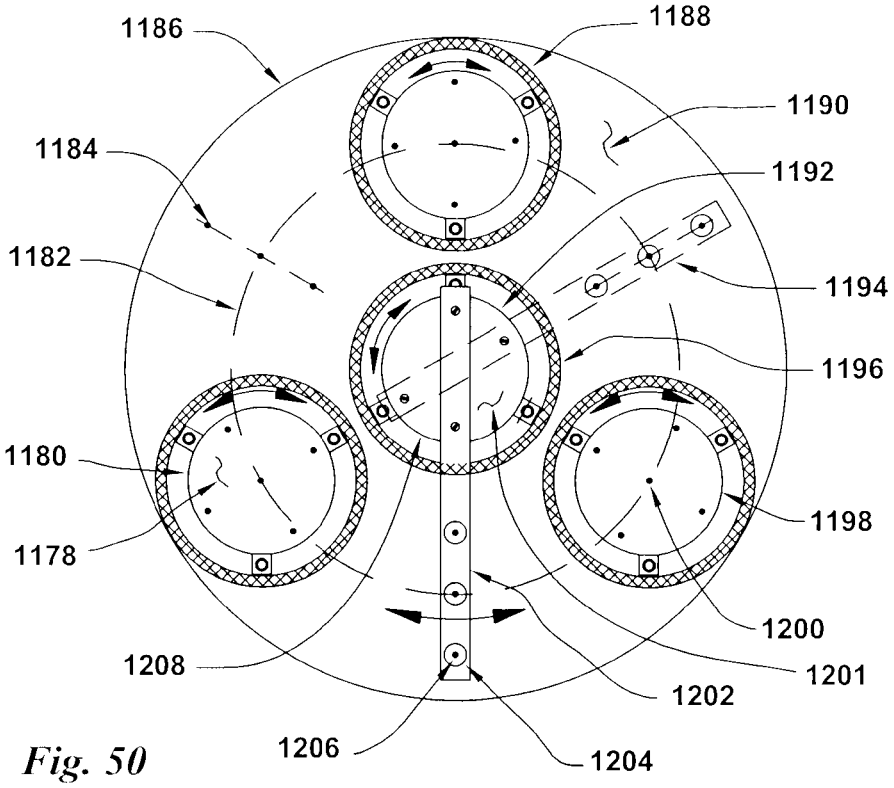
FIG. 50 is a top view of a spherical-action mounted air bearing spindle alignment device.

FIG. 50 is a top view of a spherical-action mounted air bearing spindle laser co-planar spindle top alignment device. An air bearing rotary alignment spindle 1208 is mounted on a granite lapper machine base 1186 having a flat surface 1190 where the rotary alignment spindle 1208 is positioned at the center of the machine base 1186. Rotary workpiece spindles 1180 having flat surfaces 1178 are located at the outer periphery of the circular shaped machine base 1186 where these workpiece spindles 1180 are positioned with near-equal distances between them and they surround the alignment spindle 1208. A laser sensor arm 1202 is attached to the rotary alignment spindle 1208 spindle-top 1192 where the rotary spindle-top 1192 of the alignment spindle 1208 can be rotated to selected positions.

Three laser distance sensors 1204 are shown attached to the laser sensor arm 1202 where the laser distance sensors 1204 having respective laser beam axes 1206 can be used to measure the precise laser span distance between the laser sensor 1204 bottom laser sensor end (not shown) and targets 1200 located on the flat surfaces 1178 of the workpiece spindle's 1180 spindle-tops 1198. One or more of the three laser distance sensors 1204 can also be used to measure the precise laser span distances to select targets 1184 that are located on the flat surface 1190 of the machine base 1186. The select targets 1184 that are located on the flat surface 1190 of the machine base 1186 are typically aligned in a line that extends radially from the center of the machine base 1186 so that the laser span distances of all three select targets 1184 can be measured simultaneously by the distance measuring sensors 1204.

The laser sensor arm 1202 that is attached to the top flat surface of the rotary alignment spindle 1208 spindle-top 1192 can be rotated to align the laser distance sensors 1204 with the selected measurement targets 1200 located on the surfaces of the workpiece spindles 1180 spindle-tops 1198 and also to be aligned with targets 1184 that are located on the flat surface 1190 of the machine base 1186. The laser sensor arm 1202 is shown also in an alternative measurement location as laser sensor arm 1194. Each of the workpiece spindles 1180 is mounted on a spherical-action spindle mount 1188 that can be adjusted by spherical rotation to align the workpiece spindle-top's 1198 flat surfaces 1178 to be co-planar with the alignment spindle 1208 spindle-top flat surface 1201. Also, the alignment spindle 1208 is mounted on a spherical-action spindle mount 1196 that can be adjusted by spherical rotation to align the flat top surface 1201 of the alignment spindle 1208 spindle-tops 1192 to be co-planar with the granite base 1186 flat surface 1190.

The three workpiece spindles 1180 are mounted on the flat surface 1190 of the machine base 1186 where the rotational axes of the spindle tops 1198 that intersects the spindle tops 1198 rotation-center target point 1200 intersects a spindle-circle 1182 where the spindle-circle 1182 is coincident with the machine base 1186 nominally-flat top surface 1190.

Pivot-Balanced Floating-Platen System Description

The pivot-balance floating-platen lapping system has many unique features, configurations and operational procedures. The basic system is an at least three-point, fixed-spindle floating-platen abrading machine comprising:

a) at least three rotary spindles having rotatable flat-surfaced spindle-tops that each have a spindle-top axis of rotation at the center of a respective rotatable flat-surfaced spindle-top for respective rotary spindles;

b) wherein the at least three spindle-tops' axes of rotation are perpendicular to the respective spindle-tops' flat surfaces;

c) an abrading machine base having a horizontal nominally-flat top surface and a spindle-circle where the spindle-circle is coincident with the machine base nominally-flat top surface;

d) wherein the at least three rotary spindles are located with near-equal spacing between the respective at least three of the rotary spindles where the respective at least three spindle-tops' axes of rotation intersect the machine base spindle-circle and where the respective at least three rotary spindles are mechanically attached to the machine base;

e) wherein the at least three spindle-tops' flat surfaces can be aligned to be co-planar with each other;

f) a rotatable floating abrading platen having a flat annular abrading surface where the floating abrading platen is supported by and is rotationally driven about a floating abrading platen cylindrical-rotation axis located at a cylindrical-rotation center of the floating abrading platen and perpendicular to the rotatable floating abrading platen flat annular abrading surface by a spherical-action rotation device located coincident with the cylindrical-rotation axis of the floating abrading platen where the floating abrading platen spherical-action rotation device restrains the floating abrading platen in a radial direction relative to the floating abrading platen cylindrical-rotation axis where the floating abrading platen cylindrical-rotation axis is nominally concentric with and perpendicular to the machine base spindle-circle where the floating abrading platen spherical-action rotation device has a spherical center of rotation that is coincident with the floating abrading platen cylindrical-rotation axis where the floating abrading platen has a center of mass that is coincident with the floating abrading platen cylindrical-rotation axis;

g) wherein the floating abrading platen spherical-action rotation device allows spherical motion of the floating abrading platen about the floating abrading platen spherical-action rotation device spherical center of rotation where the flat annular abrading surface of the floating abrading platen that is supported by the floating abrading platen spherical-action rotation device is nominally horizontal; and h) a pivot frame that has a pivot frame pivot center, a pivot frame floating abrading platen end and a pivot frame floating abrading platen drive motor end where the pivot frame can rotate about a pivot frame rotation axis that intersects the pivot frame pivot center where the pivot frame rotation axis is perpendicular to the length of the pivot frame that extends from the pivot frame floating abrading platen end to the pivot frame floating abrading platen drive motor end where the pivot frame has one or more low friction pivot frame rotation bearings that are concentric with the pivot frame rotation axis;

i) a platen drive motor that is attached to the pivot frame on the pivot frame floating abrading platen drive motor end and a counterbalance weight that is attached to the pivot frame on the pivot frame floating abrading platen drive motor end and a right-angle gearbox having a hollow output platen drive shaft where the right-angle gearbox is attached to the pivot frame on the pivot frame floating abrading platen end and where the floating abrading platen is attached to the pivot frame on the pivot frame floating abrading platen end and where the floating abrading platen spherical-action rotation device is attached to the pivot frame on the pivot frame floating abrading platen end;

j) where the floating abrading platen drive motor is connected to and rotates a platen drive motor drive shaft that is attached to and rotates a right-angle gearbox input drive shaft where the right-angle gearbox hollow output platen drive shaft is attached to a universal joint that is attached to a floating abrading platen rotary drive shaft that rotates the floating abrading platen;

k) where the floating abrading platen drive motor and the counterbalance weight are positioned on the pivot frame floating abrading platen drive motor end to act as a counterbalance to the right-angle gearbox, the rotatable floating abrading platen and the floating abrading platen spherical-action rotation device that are positioned on the pivot frame floating abrading platen end wherein the pivot frame is nominally balanced about the pivot frame pivot rotation axis;

l) flexible abrasive disk articles having annular bands of abrasive coated surfaces where a selected flexible abrasive disk is attached in flat conformal contact with the floating abrading platen flat annular abrading surface such that the attached abrasive disk is concentric with the floating abrading platen flat annular abrading surface;

m) wherein equal-thickness workpieces having parallel opposed flat workpiece top surfaces and flat workpiece bottom surfaces are attached to the respective at least three spindle-tops where the flat workpiece bottom surfaces are in flat-surfaced contact with the flat surfaces of the respective at least three spindle-tops;

n) an elevation frame that supports the pivot frame at the pivot frame pivot center where the elevation frame is attached to a linear slide device that is attached to the abrading machine base wherein the elevation frame can be raised and lowered by an elevation frame lift device;

o) wherein the floating abrading platen can be moved vertically by activating the lift frame lift device to allow the abrasive surface of the flexible abrasive disk that is attached to the floating abrading platen flat annular abrading surface to contact the top surfaces of the workpieces that are attached to the flat surfaces of the respective at least three spindle-tops wherein the at least three rotary spindles provide at least three-point support of the floating abrading platen and wherein the floating abrading platen spherical-action rotation device allows spherical motion of the floating abrading platen about the floating abrading platen spherical-action rotation device spherical center of rotation to provide uniform abrading contact of the abrasive surface of the flexible abrasive disk with the respective workpieces;

p) a pivot frame locking device that is attached to both the pivot frame and the pivot frame lift frame where the pivot frame locking device can be activated to lock the pivot frame that is rotated about the pivot frame rotation axis at selected pivot frame rotated position;

q) an abrading contact force device that is attached to both the pivot frame and the pivot frame lift frame where the abrading contact force device can apply an abrading contact force to the pivot frame wherein the pivot frame tends to be rotated about the pivot frame pivot rotation axis where the abrading contact force device applies an abrading contact force to the pivot frame and the pivot frame applies the abrading contact force to the floating abrading platen spherical-action rotation device that is attached to the pivot frame wherein the applied abrading contact force is applied to the floating abrading platen by the floating abrading platen spherical-action rotation device and the applied abrading contact force is applied to the workpieces by the floating abrading platen;

r) wherein the total floating abrading platen abrading contact force applied to workpieces that are attached to the respective at least three spindle-top flat surfaces by contact of the abrasive surface of the flexible abrasive disk that is attached to the floating abrading platen flat annular abrading surface with the top surfaces of the workpieces is controlled through the floating abrading platen spherical-action floating abrading platen rotation device to allow the total floating abrading platen abrading contact force to be evenly distributed to the workpieces attached to the respective at least three spindle-tops; and s) wherein the at least three spindle-tops having attached equal-thickness workpieces can be rotated about the respective spindle-tops' rotation axes and the floating abrading platen having the attached flexible abrasive disk can be rotated about the floating abrading platen cylindrical-rotation axis to single-side abrade the workpieces that are attached to the flat surfaces of the at least three spindle-tops while the moving abrasive surface of the flexible abrasive disk that is attached to the moving floating abrading platen flat annular abrading surface is in force-controlled abrading contact with the top surfaces of the workpieces that are attached to the respective at least three spindle-tops.

The basic pivot-balance floating-platen lapping system utilizes flexible abrasive disks where each flexible abrasive disk is attached in flat conformal contact with the floating abrading platen flat annular abrading surface by disk attachment techniques selected from the group consisting of vacuum disk attachment techniques, mechanical disk attachment techniques and adhesive disk attachment techniques. Also, the basic lapping system uses dimensionally stable machine bases where the machine base structural material is selected from the group consisting of granite, epoxy-granite, cast iron and steel and wherein the machine base structural material and the machine base structural material is either solid or is temperature controlled by a temperature-controlled fluid that circulates in fluid passageways that are internal to the machine base structural materials. Here, at least three rotary spindles are typically air bearing rotary spindles to provide the precision rotary spindle spindle-top flatness that is required for high speed flat lapping of workpieces.

Further, pivot-balance floating-platen lapping system can utilize an air bearing spherical-action rotation device having a spherical-action rotation device air bearing rotor that supports the floating abrading platen and the abrading platen spherical-action rotation device has a spherical-action rotation device air bearing housing that is attached to the pivot frame where pressurized air is supplied to the air bearing spherical-action rotation device air bearing housing to create a friction-free air film that is positioned between the spherical-action rotation device air bearing rotor and the spherical-action rotation device air bearing housing to allow friction-free spherical rotation of the spherical-action rotation device air bearing rotor. Also, the floating abrading platen spherical-action rotation device can be a roller bearing having spherical-action rotation capabilities where the roller bearing spherical-action rotation device has a spherical-action rotation device roller bearing rotor that supports the floating abrading platen and the abrading platen spherical-action rotation device has a spherical-action rotation device roller bearing housing that is attached to the pivot frame to allow spherical rotation of the spherical-action rotation device air bearing rotor.

In addition, the pivot-balance floating-platen lapping system can utilize pivot frame abrading contact force devices that are selected from the group consisting of air cylinders, air bearing air cylinders, hydraulic cylinders, electric solenoid devices and piezo-electric devices wherein a force sensor can be attached to the pivot frame abrading contact force device to measure the magnitude of the abrading contact force that is applied by the pivot frame abrading contact force device to the pivot frame. Here, the pivot frame locking devices can be selected from the group consisting of hydraulic cylinders, electric solenoid devices and friction brake devices and where the pivot frame locking device can also have the capability to provide vibration damping of the pivot frame.

In particular, the pivot frame locking device can be a hydraulic cylinder comprising:

a) a cylinder body, a cylinder body external surface, a cylinder body internal portion, two cylinder internal hydraulic chambers, a hydraulic by-pass tube, nominally-incompressible non-air-entrained hydraulic fluid that completely fills the cylinder internal hydraulic chambers and fills the hydraulic by-pass tube;

b) a movable linear translating cylinder rod, the cylinder rod having a cylinder rod attachment end and a cylinder rod piston end, a cylinder hydraulic rod seal, a cylinder body rod end and a cylinder body mounting base end where a movable cylinder piston that is positioned internally in the cylinder body internal portion has hydraulic fluid contact with the hydraulic fluid contained in the two cylinder hydraulic chambers and the movable cylinder piston is attached to the cylinder rod piston end;

c) where a cylinder rod end internal hydraulic chamber extends from the cylinder piston to the cylinder rod end of the cylinder and where a cylinder mounting base internal hydraulic chamber extends from the cylinder piston to the cylinder mounting base end of the cylinder where the cylinder piston acts as a hydraulic seal between the cylinder rod end internal hydraulic chamber and the cylinder mounting base internal hydraulic chamber;

d) wherein the cylinder rod has an integral rod section that is located internal to the cylinder body and has an integral rod section that extends external to the cylinder body external surface where the cylinder rod extends continuously from the cylinder piston past a cylinder hydraulic rod seal located at the cylinder body cylinder rod end to the cylinder rod attachment end wherein the cylinder rod attachment end can be attached to the pivot frame;

e) wherein a by-pass tube having an integral by-pass hydraulic shut-off valve and an integral adjustable hydraulic metering valve allows hydraulic fluid to pass between the cylinder rod end internal hydraulic chamber and the cylinder mounting base end internal hydraulic chamber as the moving cylinder rod and the cylinder piston that is attached to the cylinder rod is translated relative to the external surface of the cylinder;

f) wherein the integral by-pass hydraulic shut-off valve can be operated manually or operated by electrical devices such as an electric solenoid and the integral adjustable hydraulic metering valve can be adjusted manually or operated by electrical devices such as an electric screw device;

g) wherein by closing the by-pass hydraulic shut-off valve, the nominally-incompressible hydraulic fluid can not pass between the cylinder rod end internal hydraulic chamber and the cylinder mounting base internal hydraulic chamber with the result that the cylinder piston and the cylinder rod are locked in place relative to the cylinder body and the pivot frame that is attached to the cylinder rod attachment end can not be rotated and is locked in place by the hydraulic cylinder pivot frame locking device.

Also, the pivot frame hydraulic cylinder locking device can be used to limit the rotational speed of the pivot frame and to attenuate vibrations of the pivot frame comprising:

a) where the hydraulic by-pass tube integral adjustable hydraulic metering valve has an adjustable hydraulic flow orifice that acts as a hydraulic fluid flow restriction device that can restrict the flow of hydraulic fluid in the hydraulic by-pass tube as the hydraulic fluid passes between the cylinder rod end internal hydraulic chamber and the cylinder mounting base end internal hydraulic chamber as the moving cylinder rod is translated relative to the external surface of the cylinder body;

b) whereby, when the hydraulic metering valve hydraulic flow orifice is adjusted to be fully open, the hydraulic metering valve hydraulic flow orifice allows the moving hydraulic fluid in the hydraulic by-pass tube to pass freely between the cylinder rod end internal hydraulic chamber and the cylinder mounting base end internal hydraulic chamber of the cylinder as the moving cylinder rod is translated relative to the external surface of the cylinder body;

c) whereby, when the hydraulic metering valve hydraulic flow orifice is adjusted to be partially closed to act as a hydraulic fluid flow restriction device, the fluid orifice provides a hydraulic flow restriction to the moving hydraulic fluid in the hydraulic by-pass tube as hydraulic fluid passes between the cylinder rod end internal hydraulic chamber and the cylinder mounting base end internal hydraulic chamber as the moving cylinder rod is translated relative to the external surface of the cylinder body;

d) whereby, when the hydraulic metering valve hydraulic flow orifice is adjusted to be partially closed, a hydraulic damping force is generated by restricting the flow of the hydraulic fluid as it passes between the cylinder rod end internal hydraulic chamber and the cylinder mounting base end internal hydraulic chamber as the moving cylinder rod and the cylinder piston that is attached to the cylinder rod is translated relative to the external surface of the cylinder wherein the respective hydraulic damping force is applied to the cylinder piston in a direction that opposes the movement of the cylinder rod that is moved by the rotation motion of the pivot frame wherein the rotation motion of the pivot frame is slowed by the respective hydraulic damping force and wherein rotation oscillations of the pivot frame are resisted by hydraulic damping forces that are applied to the cylinder piston in directions that oppose the oscillating movement of the cylinder rod that is moved by the oscillating rotation motion of the pivot frame wherein the rotation motion of the pivot frame is slowed by the respective hydraulic damping forces.

The basic pivot-balance floating-platen lapping system can utilize components where the elevation frame is raised and lowered by a elevation frame lift device where the elevation frame lift device is selected from the group consisting of electric motor driven screw jack lift devices and a hydraulic lift device where the elevation frame lift device can have a elevation frame lift device vertical position sensor that can be used to sense the vertical position of the elevation frame whereby the elevation frame lift device vertical position sensor can be used to control the position of the elevation frame and whereby where the elevation frame lift device vertical position sensor can be used to indirectly control the position of the floating abrading platen abrasive coating relative to the workpieces that are attached to the rotary workpiece spindles. Further, one or more universal joints can be attached to a floating abrading platen idler drive shaft that is used to couple the right-angle gearbox hollow output platen drive shaft to the floating abrading platen rotary drive shaft that rotates the floating abrading platen where the universal joints can be selected from the group consisting of conventional universal joints, plate-type universal joints and constant velocity universal joints.

In addition, a rotary union device can be attached to the right-angle gearbox hollow output platen drive shaft to provide vacuum to the right-angle gearbox hollow output platen drive shaft wherein a flexible vacuum tube can be attached to the right-angle gearbox hollow output platen drive shaft and also attached to the floating abrading platen rotary drive shaft to provide a vacuum passageway from the right-angle gearbox hollow output platen drive shaft to the floating abrading platen rotary drive shaft where vacuum passages within the floating abrading platen are routed to the floating abrading platen flat annular abrading surface such that a flexible abrasive disk can be attached to the floating abrading platen by the vacuum supplied by the rotary union device.

Further, a spherical action locking device can be used to lock the floating abrading platen spherical-action rotation device to prevent spherical rotation of the floating abrading platen spherical-action rotation device which prevents spherical rotation of the floating abrading platen whereby the floating abrading platen is locked in a selected spherical-rotation position.

Another variation is where a floating abrading platen spherical action locking device is an integral part of a floating abrading platen air bearing spherical-action rotation device having a spherical-action rotation device air bearing rotor that supports the floating abrading platen and the abrading platen spherical-action rotation device has a spherical-action rotation device air bearing housing that is attached to the pivot frame where pressurized air is supplied to the air bearing spherical-action rotation device air bearing housing to create a friction-free air film that is positioned between the spherical-action rotation device air bearing rotor and the spherical-action rotation device air bearing housing to allow friction-free spherical rotation of the spherical-action rotation device air bearing rotor and friction-free spherical rotation of the floating abrading platen and wherein vacuum that is supplied to the air bearing spherical-action rotation device spherical-action rotation device air bearing housing can lock the spherical-action rotation device air bearing rotor to the spherical-action rotation device air bearing housing whereby the floating abrading platen is locked in a selected spherical-rotation position.

In another configuration, the basic pivot-balance floating-platen lapping system can have a floating abrading platen spherical action locking device that is a mechanical brake device comprising:

a) a mechanical brake rotor having a spherical brake rotor surface that has a spherical center of rotation that coincides with the floating abrading platen spherical-action rotation device spherical center of rotation;

b) where the floating abrading platen spherical action locking device mechanical brake device has a mechanical brake pad having a spherical brake pad surface that has a spherical center of rotation that coincides with the floating abrading platen spherical-action rotation device spherical center of rotation;

c) wherein the spherical radius of the mechanical brake device mechanical brake pad is nominally equal to the spherical radius of the mechanical brake device mechanical brake rotor; and d) where the floating abrading platen spherical-action rotation device mechanical brake pad can be moved along an axis that intersects the floating abrading platen spherical-action rotation device spherical center of rotation by a floating abrading platen anti-rotation braking force device into forced contact with the floating abrading platen spherical-action rotation device mechanical brake rotor to lock the floating abrading platen spherical-action rotation device mechanical brake pad to the floating abrading platen spherical-action rotation device mechanical brake rotor to prevent spherical rotation of the floating abrading platen spherical-action rotation device which prevents spherical rotation of the floating abrading platen spherical-action rotation device mechanical brake rotor;

e) whereby the floating abrading platen spherical-action rotation device is locked in a selected spherical-rotation position whereby the floating abrading platen is locked in a selected spherical-rotation position.

Also, the floating abrading platen spherical-action rotation device mechanical brake pad can be moved from a position that is separated from the floating abrading platen spherical action locking device mechanical brake rotor into braking contact with the floating abrading platen spherical action locking device mechanical brake rotor by a floating abrading platen anti-rotation braking force device selected from the group consisting of air cylinders, spring-return air cylinders, hydraulic cylinders, electric solenoid devices and piezo-electric devices wherein the anti-rotation braking force device can be activated to move the floating abrading platen spherical action locking device mechanical brake pad manually or by electrical devices into braking contact with the floating abrading platen spherical action locking device mechanical brake rotor.

In addition, the basic pivot-balance floating-platen lapping system can be configured where the center of mass of the floating abrading platen is less than 2 inches from the spherical center of rotation of the floating abrading platen spherical-action rotation device. Also, the lapping system can be configured where the center of mass of the floating abrading platen is less that 0.5 inches from the spherical center of rotation of the floating abrading platen spherical-action rotation device and further, where it is even less than 0.25 inches from the spherical center of rotation of the floating abrading platen spherical-action rotation device.

What is claimed:

1. An at least three-point, fixed-spindle floating-platen abrading machine comprising:

a) at least three rotary spindles having rotatable flat-surfaced spindle-tops that each have a spindle-top axis of rotation at the center of a respective rotatable flat-surfaced spindle-top for each respective rotary spindles;

b) wherein the at least three spindle-tops' axes of rotation are perpendicular to the respective spindle-tops' flat surfaces;

c) an abrading machine base having a horizontal, nominally-flat top surface and a spindle-circle where the spindle-circle is coincident with the machine base nominally-flat top surface;

d) wherein the at least three rotary spindles are located with near-equal spacing between the respective at least three of the rotary spindles where the respective at least three spindle-tops' axes of rotation intersect the machine base spindle-circle and where the respective at least three rotary spindles are mechanically attached to the machine base;

e) wherein the at least three spindle-tops' flat surfaces are adjustably alignable to be co-planar with each other;

f) a rotatable floating abrading platen having a flat annular abrading surface where the floating abrading platen is supported by and is rotationally driven about a floating abrading platen cylindrical-rotation axis located at a cylindrical-rotation center of the floating abrading platen and perpendicular to the rotatable floating abrading platen flat annular abrading surface by a spherical-action rotation device located coincident with the cylindrical-rotation axis of the floating abrading platen where the floating abrading platen spherical-action rotation device restrains the floating abrading platen in a radial direction relative to the floating abrading platen cylindrical-rotation axis where the floating abrading platen cylindrical-rotation axis is nominally concentric with and perpendicular to the machine base spindle-circle where the floating abrading platen spherical-action rotation device has a spherical center of rotation that is coincident with the floating abrading platen cylindrical-rotation axis where the floating abrading platen has a center of mass that is coincident with the floating abrading platen cylindrical-rotation axis;

g) wherein the floating abrading platen spherical-action rotation device allows spherical motion of the floating abrading platen about the floating abrading platen spherical-action rotation device spherical center of rotation where the flat annular abrading surface of the floating abrading platen that is supported by the floating abrading platen spherical-action rotation device is nominally horizontal; and h) a pivot frame that has a pivot frame pivot center, a pivot frame floating abrading platen end and a pivot frame floating abrading platen drive motor end where the pivot frame rotates about a pivot frame rotation axis that intersects the pivot frame pivot center where the pivot frame rotation axis is perpendicular to the length of the pivot frame that extends from the pivot frame floating abrading platen end to the pivot frame floating abrading platen drive motor end where the pivot frame comprises a low friction pivot frame rotation bearing that is concentric with the pivot frame rotation axis;

i) a platen drive motor is attached to the pivot frame on the pivot frame floating abrading platen drive motor end and a counterbalance weight is attached to the pivot frame on the pivot frame floating abrading platen drive motor end, and a right-angle gearbox having a hollow output platen drive shaft is attached to the pivot frame on the pivot frame floating abrading platen end and the floating abrading platen is attached to the pivot frame on the pivot frame floating abrading platen end and the floating abrading platen spherical-action rotation device is attached to the pivot frame on the pivot frame floating abrading platen end;

j) the floating abrading platen drive motor is connected to and rotates a platen drive motor drive shaft attached to and rotates a right-angle gearbox input drive shaft and the right-angle gearbox hollow output platen drive shaft is attached to a universal joint attached to a floating abrading platen rotary drive shaft that rotates the floating abrading platen;

k) wherein the floating abrading platen drive motor and the counterbalance weight are positioned on the pivot frame floating abrading platen drive motor end to act as a counterbalance to the right-angle gearbox, the rotatable floating abrading platen and the floating abrading platen spherical-action rotation device that are positioned on the pivot frame floating abrading platen end wherein the pivot frame is nominally balanced about the pivot frame pivot rotation axis;

l) flexible abrasive disk articles having annular bands of abrasive coated surfaces where a selected flexible abrasive disk is attached in flat conformal contact with the floating abrading platen flat annular abrading surface such that the attached abrasive disk is concentric with the floating abrading platen flat annular abrading surface;

m) wherein equal-thickness workpieces having parallel opposed flat workpiece top surfaces and flat workpiece bottom surfaces are attached to the respective at least three spindle-tops where the flat workpiece bottom surfaces are in flat-surfaced contact with the flat surfaces of the respective at least three spindle-tops;

n) an elevation frame that supports the pivot frame at the pivot frame pivot center where the elevation frame is attached to a linear slide device that is attached to the abrading machine base wherein the elevation frame can be raised and lowered by an elevation frame lift device;

o) wherein the floating abrading platen can be moved vertically by activating the lift frame lift device to allow the abrasive surface of the flexible abrasive disk that is attached to the floating abrading platen flat annular abrading surface to contact the top surfaces of the workpieces that are attached to the flat surfaces of the respective at least three spindle-tops wherein the at least three rotary spindles provide at least three-point support of the floating abrading platen and wherein the floating abrading platen spherical-action rotation device allows spherical motion of the floating abrading platen about the floating abrading platen spherical-action rotation device spherical center of rotation to provide uniform abrading contact of the abrasive surface of the flexible abrasive disk with the respective workpieces;

p) a pivot frame locking device that is attached to both the pivot frame and the pivot frame lift frame where the pivot frame locking device can be activated to lock the pivot frame that is rotated about the pivot frame rotation axis at selected pivot frame rotated position;

q) an abrading contact force device that is attached to both the pivot frame and the pivot frame lift frame where the abrading contact force device can apply an abrading contact force to the pivot frame wherein the pivot frame tends to be rotated about the pivot frame pivot rotation axis where the abrading contact force device applies an abrading contact force to the pivot frame and the pivot frame applies the abrading contact force to the floating abrading platen spherical-action rotation device that is attached to the pivot frame wherein the applied abrading contact force is applied to the floating abrading platen by the floating abrading platen spherical-action rotation device and the applied abrading contact force is applied to the workpieces by the floating abrading platen;

r) wherein the total floating abrading platen abrading contact force applied to workpieces that are attached to the respective at least three spindle-top flat surfaces by contact of the abrasive surface of the flexible abrasive disk that is attached to the floating abrading platen flat annular abrading surface with the top surfaces of the workpieces is controlled through the floating abrading platen spherical-action floating abrading platen rotation device to allow the total floating abrading platen abrading contact force to be evenly distributed to the workpieces attached to the respective at least three spindle-tops; and s) wherein the at least three spindle-tops having attached equal-thickness workpieces can be rotated about the respective spindle-tops' rotation axes and the floating abrading platen having the attached flexible abrasive disk can be rotated about the floating abrading platen cylindrical-rotation axis to single-side abrade the workpieces that are attached to the flat surfaces of the at least three spindle-tops while the moving abrasive surface of the flexible abrasive disk that is attached to the moving floating abrading platen flat annular abrading surface is in force-controlled abrading contact with the top surfaces of the workpieces that are attached to the respective at least three spindle-tops.

2. The machine of claim 1 wherein each flexible abrasive disk is attached in flat conformal contact with the floating abrading platen flat annular abrading surface by disk attachment techniques selected from the group consisting of vacuum disk attachment techniques, mechanical disk attachment techniques and adhesive disk attachment techniques.

3. The machine of claim 1 wherein the machine base structural material is selected from the group consisting of granite, epoxy-granite, cast iron and steel and wherein the machine base structural material and the machine base structural material is either solid or is temperature controlled by a temperature-controlled fluid that circulates in fluid passageways internal to the machine base structural materials.

4. The machine of claim 1 wherein the at least three rotary spindles are air bearing rotary spindles.

5. The machine of claim 1 wherein the floating abrading platen spherical-action rotation device is an air bearing spherical-action rotation device having a spherical-action rotation device air bearing rotor that supports the floating abrading platen and the abrading platen spherical-action rotation device has a spherical-action rotation device air bearing housing that is attached to the pivot frame where pressurized air is supplied to the air bearing spherical-action rotation device air bearing housing to create a friction-free air film that is positioned between the spherical-action rotation device air bearing rotor and the spherical-action rotation device air bearing housing to allow friction-free spherical rotation of the spherical-action rotation device air bearing rotor.

6. The machine of claim 1 wherein the floating abrading platen spherical-action rotation device is a roller bearing having spherical-action rotation capabilities where the roller bearing spherical-action rotation device has a spherical-action rotation device roller bearing rotor that supports the floating abrading platen and the abrading platen spherical-action rotation device has a spherical-action rotation device roller bearing housing that is attached to the pivot frame to allow spherical rotation of the spherical-action rotation device air bearing rotor.

7. The machine of claim 1 wherein the pivot frame abrading contact force devices are selected from the group consisting of air cylinders, air bearing air cylinders, hydraulic cylinders, electric solenoid devices and piezo-electric devices wherein a force sensor can be attached to the pivot frame abrading contact force device to measure the magnitude of the abrading contact force that is applied by the pivot frame abrading contact force device to the pivot frame.

8. The machine of claim 1 wherein the pivot frame locking device is selected from the group consisting of hydraulic cylinders, electric solenoid devices and friction brake devices and where the pivot frame locking device can also have the capability to provide vibration damping of the pivot frame.

9. The pivot frame locking device of claim 8 wherein the pivot frame locking device is a hydraulic cylinder comprising:

a) a cylinder body, a cylinder body external surface, a cylinder body internal portion, two cylinder internal hydraulic chambers, a hydraulic by-pass tube, nominally-incompressible non-air-entrained hydraulic fluid that completely fills the cylinder internal hydraulic chambers and fills the hydraulic by-pass tube;

b) a movable linear translating cylinder rod, the cylinder rod having a cylinder rod attachment end and a cylinder rod piston end, a cylinder hydraulic rod seal, a cylinder body rod end and a cylinder body mounting base end where a movable cylinder piston that is positioned internally in the cylinder body internal portion has hydraulic fluid contact with the hydraulic fluid contained in the two cylinder hydraulic chambers and the movable cylinder piston is attached to the cylinder rod piston end;

c) where a cylinder rod end internal hydraulic chamber extends from the cylinder piston to the cylinder rod end of the cylinder and where a cylinder mounting base internal hydraulic chamber extends from the cylinder piston to the cylinder mounting base end of the cylinder where the cylinder piston acts as a hydraulic seal between the cylinder rod end internal hydraulic chamber and the cylinder mounting base internal hydraulic chamber;

d) wherein the cylinder rod has an integral rod section that is located internal to the cylinder body and has an integral rod section that extends external to the cylinder body external surface where the cylinder rod extends continuously from the cylinder piston past a cylinder hydraulic rod seal located at the cylinder body cylinder rod end to the cylinder rod attachment end wherein the cylinder rod attachment end can be attached to the pivot frame;

e) wherein a by-pass tube having an integral by-pass hydraulic shut-off valve and an integral adjustable hydraulic metering valve allows hydraulic fluid to pass between the cylinder rod end internal hydraulic chamber and the cylinder mounting base end internal hydraulic chamber as the moving cylinder rod and the cylinder piston that is attached to the cylinder rod is translated relative to the external surface of the cylinder;

f) wherein the integral by-pass hydraulic shut-off valve can be operated manually or operated by electrical devices such as an electric solenoid and the integral adjustable hydraulic metering valve can be adjusted manually or operated by electrical devices such as an electric screw device;

g) wherein by closing the by-pass hydraulic shut-off valve, the nominally-incompressible hydraulic fluid can not pass between the cylinder rod end internal hydraulic chamber and the cylinder mounting base internal hydraulic chamber with the result that the cylinder piston and the cylinder rod are locked in place relative to the cylinder body and the pivot frame that is attached to the cylinder rod attachment end can not be rotated and is locked in place by the hydraulic cylinder pivot frame locking device.

10. The pivot frame hydraulic cylinder locking device of claim 9 wherein the pivot frame hydraulic cylinder locking device can be used to limit the rotational speed of the pivot frame and to attenuate vibrations of the pivot frame comprising:

a) where the hydraulic by-pass tube integral adjustable hydraulic metering valve has an adjustable hydraulic flow orifice that acts as a hydraulic fluid flow restriction device that can restrict the flow of hydraulic fluid in the hydraulic by-pass tube as the hydraulic fluid passes between the cylinder rod end internal hydraulic chamber and the cylinder mounting base end internal hydraulic chamber as the moving cylinder rod is translated relative to the external surface of the cylinder body;

b) whereby, when the hydraulic metering valve hydraulic flow orifice is adjusted to be fully open, the hydraulic metering valve hydraulic flow orifice allows the moving hydraulic fluid in the hydraulic by-pass tube to pass freely between the cylinder rod end internal hydraulic chamber and the cylinder mounting base end internal hydraulic chamber of the cylinder as the moving cylinder rod is translated relative to the external surface of the cylinder body;

c) whereby, when the hydraulic metering valve hydraulic flow orifice is adjusted to be partially closed to act as a hydraulic fluid flow restriction device, the fluid orifice provides a hydraulic flow restriction to the moving hydraulic fluid in the hydraulic by-pass tube as hydraulic fluid passes between the cylinder rod end internal hydraulic chamber and the cylinder mounting base end internal hydraulic chamber as the moving cylinder rod is translated relative to the external surface of the cylinder body;

d) whereby, when the hydraulic metering valve hydraulic flow orifice is adjusted to be partially closed, a hydraulic damping force is generated by restricting the flow of the hydraulic fluid as it passes between the cylinder rod end internal hydraulic chamber and the cylinder mounting base end internal hydraulic chamber as the moving cylinder rod and the cylinder piston that is attached to the cylinder rod is translated relative to the external surface of the cylinder wherein the respective hydraulic damping force is applied to the cylinder piston in a direction that opposes the movement of the cylinder rod that is moved by the rotation motion of the pivot frame wherein the rotation motion of the pivot frame is slowed by the respective hydraulic damping force and wherein rotation oscillations of the pivot frame are resisted by hydraulic damping forces that are applied to the cylinder piston in directions that oppose the oscillating movement of the cylinder rod that is moved by the oscillating rotation motion of the pivot frame wherein the rotation motion of the pivot frame is slowed by the respective hydraulic damping forces.

11. The machine of claim 1 wherein the elevation frame is raised and lowered by a elevation frame lift device where the elevation frame lift device is selected from the group consisting of electric motor driven screw jack lift devices and a hydraulic lift device where the elevation frame lift device can have a elevation frame lift device vertical position sensor that can be used to sense the vertical position of the elevation frame whereby the elevation frame lift device vertical position sensor can be used to control the position of the elevation frame and whereby where the elevation frame lift device vertical position sensor can be used to indirectly control the position of the floating abrading platen abrasive coating relative to the workpieces that are attached to the rotary workpiece spindles.

12. The machine of claim 1 wherein one or more universal joints can be attached to a floating abrading platen idler drive shaft that is used to couple the right-angle gearbox hollow output platen drive shaft to the floating abrading platen rotary drive shaft that rotates the floating abrading platen where the universal joints can be selected from the group consisting of conventional universal joints, plate-type universal joints and constant velocity universal joints.

13. The machine of claim 1 where a rotary union device is attached to the right-angle gearbox hollow output platen drive shaft to provide vacuum to the right-angle gearbox hollow output platen drive shaft wherein a flexible vacuum tube can be attached to the right-angle gearbox hollow output platen drive shaft and also attached to the floating abrading platen rotary drive shaft to provide a vacuum passageway from the right-angle gearbox hollow output platen drive shaft to the floating abrading platen rotary drive shaft where vacuum passages within the floating abrading platen are routed to the floating abrading platen flat annular abrading surface such that a flexible abrasive disk can be attached to the floating abrading platen by the vacuum supplied by the rotary union device.

14. The machine of claim 1 where a spherical action locking device can be used to lock the floating abrading platen spherical-action rotation device to prevent spherical rotation of the floating abrading platen spherical-action rotation device which prevents spherical rotation of the floating abrading platen whereby the floating abrading platen is locked in a selected spherical-rotation position.

15. The machine of claim 14 where a floating abrading platen spherical action locking device is an integral part of a floating abrading platen air bearing spherical-action rotation device having a spherical-action rotation device air bearing rotor that supports the floating abrading platen and the abrading platen spherical-action rotation device has a spherical-action rotation device air bearing housing that is attached to the pivot frame where pressurized air is supplied to the air bearing spherical-action rotation device air bearing housing to create a friction-free air film that is positioned between the spherical-action rotation device air bearing rotor and the spherical-action rotation device air bearing housing to allow friction-free spherical rotation of the spherical-action rotation device air bearing rotor and friction-free spherical rotation of the floating abrading platen and wherein vacuum that is supplied to the air bearing spherical-action rotation device spherical-action rotation device air bearing housing can lock the spherical-action rotation device air bearing rotor to the spherical-action rotation device air bearing housing whereby the floating abrading platen is locked in a selected spherical-rotation position.

16. The machine of claim 14 where a floating abrading platen spherical action locking device is a mechanical brake device comprising:

a) a mechanical brake rotor having a spherical brake rotor surface that has a spherical center of rotation that coincides with the floating abrading platen spherical-action rotation device spherical center of rotation;

b) where the floating abrading platen spherical action locking device mechanical brake device has a mechanical brake pad having a spherical brake pad surface that has a spherical center of rotation that coincides with the floating abrading platen spherical-action rotation device spherical center of rotation;

c) wherein the spherical radius of the mechanical brake device mechanical brake pad is nominally equal to the spherical radius of the mechanical brake device mechanical brake rotor; and d) where the floating abrading platen spherical-action rotation device mechanical brake pad can be moved along an axis that intersects the floating abrading platen spherical-action rotation device spherical center of rotation by a floating abrading platen anti-rotation braking force device into forced contact with the floating abrading platen spherical-action rotation device mechanical brake rotor to lock the floating abrading platen spherical-action rotation device mechanical brake pad to the floating abrading platen spherical-action rotation device mechanical brake rotor to prevent spherical rotation of the floating abrading platen spherical-action rotation device which prevents spherical rotation of the floating abrading platen spherical-action rotation device mechanical brake rotor;

e) whereby the floating abrading platen spherical-action rotation device is locked in a selected spherical-rotation position whereby the floating abrading platen is locked in a selected spherical-rotation position.

17. The floating abrading platen mechanical brake device of claim 16 where the floating abrading platen spherical action locking device mechanical brake pad can be moved from a position that is separated from the floating abrading platen spherical action locking device mechanical brake rotor into braking contact with the floating abrading platen spherical action locking device mechanical brake rotor by a floating abrading platen anti-rotation braking force device selected from the group consisting of air cylinders, spring-return air cylinders, hydraulic cylinders, electric solenoid devices and piezo-electric devices wherein the anti-rotation braking force device can be activated to move the floating abrading platen spherical action locking device mechanical brake pad manually or by electrical devices into braking contact with the floating abrading platen spherical action locking device mechanical brake rotor.

18. The machine of claim 1 where the center of mass of the floating abrading platen is less that 2 inches from the spherical center of rotation of the floating abrading platen spherical-action rotation device.

19. The machine of claim 1 where the center of mass of the floating abrading platen is less that 0.5 inches from the spherical center of rotation of the floating abrading platen spherical-action rotation device.

20. A process of providing abrasive flat lapping using an at least three-point, fixed-spindle floating-platen abrading machine comprising:

a) providing least three rotary spindles having rotatable flat-surfaced spindle-tops that each have a spindle-top axis of rotation at the center of a respective rotatable flat-surfaced spindle-top for respective rotary spindles;

b) providing that the at least three spindle-tops' axes of rotation are perpendicular to the respective spindle-tops' flat surfaces;

c) providing an abrading machine base having a horizontal nominally-flat top surface and a spindle-circle where the spindle-circle is coincident with the machine base nominally-flat top surface;

d) positioning the at least three rotary spindles to be located with near-equal spacing between the respective at least three of the rotary spindles where the respective at least three spindle-tops' axes of rotation intersect the machine base spindle-circle and where the respective at least three rotary spindles are mechanically attached to the machine base;

e) aligning the at least three spindle-tops' flat surfaces to be co-planar with each other;

f) providing a rotatable floating abrading platen having a flat annular abrading surface where the floating abrading platen is supported by and is rotationally driven about a floating abrading platen cylindrical-rotation axis located at a cylindrical-rotation center of the floating abrading platen and perpendicular to the rotatable floating abrading platen flat annular abrading surface by a spherical-action rotation device located coincident with the cylindrical-rotation axis of the floating abrading platen where the floating abrading platen spherical-action rotation device restrains the floating abrading platen in a radial direction relative to the floating abrading platen cylindrical-rotation axis where the floating abrading platen cylindrical-rotation axis is nominally concentric with and perpendicular to the machine base spindle-circle where the floating abrading platen spherical-action rotation device has a spherical center of rotation that is coincident with the floating abrading platen cylindrical-rotation axis where the floating abrading platen has a center of mass that is coincident with the floating abrading platen cylindrical-rotation axis;

g) providing that the floating abrading platen spherical-action rotation device allows spherical motion of the floating abrading platen about the floating abrading platen spherical-action rotation device spherical center of rotation where the flat annular abrading surface of the floating abrading platen that is supported by the floating abrading platen spherical-action rotation device is nominally horizontal; and h) providing a pivot frame that has a pivot frame pivot center, a pivot frame floating abrading platen end and a pivot frame floating abrading platen drive motor end where the pivot frame can rotate about a pivot frame rotation axis that intersects the pivot frame pivot center where the pivot frame rotation axis is perpendicular to the length of the pivot frame that extends from the pivot frame floating abrading platen end to the pivot frame floating abrading platen drive motor end where the pivot frame has one or more low friction pivot frame rotation bearings that are concentric with the pivot frame rotation axis;

i) providing a platen drive motor that is attached to the pivot frame on the pivot frame floating abrading platen drive motor end and providing a counterbalance weight that is attached to the pivot frame on the pivot frame floating abrading platen drive motor end and providing a right-angle gearbox having a hollow output platen drive shaft where the right-angle gearbox is attached to the pivot frame on the pivot frame floating abrading platen end and where the floating abrading platen is attached to the pivot frame on the pivot frame floating abrading platen end and where the floating abrading platen spherical-action rotation device is attached to the pivot frame on the pivot frame floating abrading platen end;

j) providing that the floating abrading platen drive motor is connected to and rotates a platen drive motor drive shaft that is attached to and rotates a right-angle gearbox input drive shaft where the right-angle gearbox hollow output platen drive shaft is attached to a provided universal joint that is attached to a floating abrading platen rotary drive shaft that rotates the floating abrading platen;

k) positioning the floating abrading platen drive motor and the counterbalance weight on the pivot frame floating abrading platen drive motor end to act as a counterbalance to the right-angle gearbox, the rotatable floating abrading platen and the floating abrading platen spherical-action rotation device that are positioned on the pivot frame floating abrading platen end wherein the pivot frame is nominally balanced about the pivot frame pivot rotation axis;

l) providing flexible abrasive disk articles having annular bands of abrasive coated surfaces where a selected flexible abrasive disk is attached in flat conformal contact with the floating abrading platen flat annular abrading surface such that the attached abrasive disk is concentric with the floating abrading platen flat annular abrading surface;

m) providing equal-thickness workpieces having parallel opposed flat workpiece top surfaces and flat workpiece bottom surfaces that are attached to the respective at least three spindle-tops where the flat workpiece bottom surfaces are in flat-surfaced contact with the flat surfaces of the respective at least three spindle-tops;

n) providing an elevation frame that supports the pivot frame at the pivot frame pivot center where the elevation frame is attached to a linear slide device that is attached to the abrading machine base wherein the elevation frame can be raised and lowered by an elevation frame lift device;

o) moving the floating abrading platen vertically by activating the lift frame lift device to position the abrasive surface of the flexible abrasive disk that is attached to the floating abrading platen flat annular abrading surface to contact the top surfaces of the workpieces that are attached to the flat surfaces of the respective at least three spindle-tops wherein the at least three rotary spindles provide at least three-point support of the floating abrading platen and wherein the floating abrading platen spherical-action rotation device allows spherical motion of the floating abrading platen about the floating abrading platen spherical-action rotation device spherical center of rotation to provide uniform abrading contact of the abrasive surface of the flexible abrasive disk with all of the workpieces;

p) providing a pivot frame locking device that is attached to both the pivot frame and the pivot frame lift frame where the pivot frame locking device can be activated to lock the pivot frame that is rotated about the pivot frame rotation axis at that pivot frame rotated position;

q) providing an abrading contact force device that is attached to both the pivot frame and the pivot frame lift frame where the abrading contact force device can apply an abrading contact force to the pivot frame wherein the pivot frame tends to be rotated about the pivot frame pivot rotation axis where the abrading contact force device applies an abrading contact force to the pivot frame and the pivot frame applies the abrading contact force to the floating abrading platen spherical-action rotation device that is attached to the pivot frame wherein the applied abrading contact force is applied to the floating abrading platen by the floating abrading platen spherical-action rotation device and the applied abrading contact force is applied to the workpieces by the floating abrading platen;

r) providing that the total floating abrading platen abrading contact force applied to workpieces that are attached to the respective at least three spindle-top flat surfaces by contact of the abrasive surface of the flexible abrasive disk that is attached to the floating abrading platen flat annular abrading surface with the top surfaces of the workpieces is controlled through the floating abrading platen spherical-action floating abrading platen rotation device to allow the total floating abrading platen abrading contact force to be evenly distributed to the workpieces attached to the respective at least three spindle-tops; and s) rotating the at least three spindle-tops having the attached equal-thickness workpieces about the respective spindle-tops' rotation axes and rotating the floating abrading platen having the attached flexible abrasive disk about the floating abrading platen cylindrical-rotation axis to single-side abrade the workpieces that are attached to the flat surfaces of the at least three spindle-tops while the moving abrasive surface of the flexible abrasive disk that is attached to the moving floating abrading platen flat annular abrading surface is in force-controlled abrading contact with the top surfaces of the workpieces that are attached to the respective at least three spindle-tops.

* * * * *